US006951711B2

(12) United States Patent
Miki et al.

(10) Patent No.: US 6,951,711 B2
(45) Date of Patent: Oct. 4, 2005

(54) SILVER HALIDE COLOR PHOTOGRAPHIC LIGHTSENSITIVE MATERIAL

(75) Inventors: Masaaki Miki, Minami-Ashigara (JP); Yoshiyasu Inami, Minami-Ashigara (JP); Junichiro Hosokawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/690,746

(22) Filed: Oct. 23, 2003

(65) Prior Publication Data

US 2004/0086812 A1 May 6, 2004

(30) Foreign Application Priority Data

Oct. 25, 2002 (JP) ..... 2002-311604
Mar. 6, 2003 (JP) ..... 2003-060367
Sep. 18, 2003 (JP) ..... 2003-326547

(51) Int. Cl.[7] ..... G03C 1/005; G03C 1/494

(52) U.S. Cl. ..... 430/567; 430/505; 430/544; 430/611; 430/613; 430/614

(58) Field of Search ..... 430/567, 505, 430/544, 611, 613, 614

(56) References Cited

U.S. PATENT DOCUMENTS 6,350,564 B1 * 2/2002 Bringley et al. ..... 430/502
6,426,180 B1 * 7/2002 Bringley et al. ..... 430/614
6,455,242 B1 9/2002 Allway et al.
6,696,235 B2 * 2/2004 Miki ..... 430/567

* cited by examiner

*Primary Examiner*—Geraldine Letscher
(74) *Attorney, Agent, or Firm*—Sughrue Mion, PLLC

(57) ABSTRACT

A silver halide color photographic lightsensitive material containing at least one compound capable of increasing photographic speed, the compound having at least three heteroatoms in its molecule, and wherein at least one layer of the silver halide emulsion layers comprises an emulsion, the emulsion consisting of a lightsensitive silver halide emulsion wherein 50% or more in number of all the silver halide grains are occupied by tabular grains having (111) faces as main planes, the tabular grains (i) composed of silver iodobromide or silver chloroiodobromide, (ii) having an equivalent circle diameter of 1.0 $\mu$m or more and a thickness of 0.15 $\mu$m or less, and (iii) composed of core portions of 0.1 $\mu$m or less thickness free of growth ring structure and composed of silver iodobromide and shell portions having ten or more dislocation lines.

8 Claims, No Drawings

SILVER HALIDE COLOR PHOTOGRAPHIC LIGHTSENSITIVE MATERIAL

CROSS-REFERENCE TO RELATED APPLICATIONS

This application is based upon and claims the benefit of priority from the prior Japanese Patent Applications No. 2002-311604, filed Oct. 25, 2002; No. 2003-60367, filed Mar. 6, 2003; and No. 2003-326547, filed Sep. 18, 2003, the entire contents of all of which are incorporated herein by reference.

BACKGROUND OF THE INVENTION

1. Field of the Invention

The present invention relates to a silver halide color photographic lightsensitive material. More particularly, the present invention relates to a silver halide color photographic lightsensitive material which is highly sensitive, is excellent in graininess and exhibits high sharpness.

2. Description of the Related Art

With respect to the silver halide color photographic lightsensitive material, further sensitivity enhancement is being urged for increasing the user benefit of color negative films. Especially in recent years, the regular use of highly sensitive films of 800 or higher specific photographic speed (ISO speed) is being promoted in accordance with the penetration of compact cameras with zooming capability and lens-equipped films which enable readily and easily coping with various exposure conditions.

This film sensitivity enhancement realizes an expansion of the photographing range of lightsensitive materials to, for example, photographing without the use of stroboscopic flash in dark rooms, fast-shutter photographing with the use of telephoto lens like sports photography, photographing requiring long-time exposure like astronomical photography, etc. Thus, the users can have tremendous benefits therefrom. Therefore, the sensitivity enhancement of films is one of everlasting themes to be tackled in this industry.

The conventional high-speed films have been those whereby only images of low grade far above the threshold of user's tolerance can be obtained as a result of the pursuit of sensitivity enhancement. Therefore, the users have been forced to choose between speed and image quality, and often the user's choice has resulted in having to take image quality rather than speed.

For enhancing the sensitivity of lightsensitive materials, it is old trick in this industry to increase the size of silver halide grains as photosensitive elements and further simultaneously employ other sensitivity enhancement technologies.

The sensitivity enhancement can be realized to a certain level by an increase of the size of silver halide grains. However, as long as the content of silver halides stays constant, the size increase would inevitably lead to a decrease of the number of silver halide grains, namely, a decrease of the number of development initiation centers and would consequently cause a disadvantage of extreme graininess deterioration.

Moreover, a design intended to increase the number of silver halide grains per area, namely, an increase of the amount of silver halides used in lightsensitive material coating would invite such a problem that deteriorations of photographic performance, such as fog increase, sensitivity lowering and graininess deterioration, occur during the storage of lightsensitive material after production and before use thereof.

Meanwhile, recently, there has been disclosed a technology of achieving a sensitivity enhancement without detriment to graininess by incorporating a compound, the compound having at least three heteroatoms that do not react with oxidizing developing agents, in a silver halide photographic lightsensitive material (see, for example, Jpn. Pat. Appln. KOKAI Publication No. (hereinafter referred to as JP-A-) 2000-194085).

Tabular silver halide grains have been employed for the sensitivity enhancement of lightsensitive materials. With respect to the tabular silver halide grains, not only have processes for producing the same and technologies for use thereof been disclosed but also the advantages, such as improvements of the relationship of speed/graininess including an improvement of color sensitization efficiency by spectral sensitizing dyes, are known (see, for example, U.S. Pat. No. 4,434,226).

Extensive studies have been conducted for the performance enhancement of these advantageous tabular grains. Tabular grains of large equivalent circle diameter and reduced thickness are advantageous for the sensitivity enhancement from the viewpoint that spectral sensitizing dyes can be adsorbed thereto in greater amounts. The thinner the tabular grains, the greater the amount of adsorbed dyes. However, practically, attaining a sensitivity enhancement effect conforming to an increase of the amount of adsorbed sensitizing dyes becomes difficult in accordance with the reduction of grain thickness. As a reason therefor, there can be mentioned, for example, the influence of unfavorable electron trap within grains. Technologies for attaining sensitivity enhancement by removing the electron trap are disclosed (see, for example, JP-A-2001-281778).

However, even when these technologies are employed, there occurs such a problem that the introduction of dislocation lines that are effective in sensitivity enhancement becomes difficult in accordance with the reduction of the thickness of tabular grains. Thus, the intended sensitivity enhancement has not been attained. Therefore, there is a demand for a further technology attaining sensitivity enhancement.

On the other hand, it is known that the sharpness of lightsensitive materials can be improved by reducing the thickness of the protective layer thereof. Further, it is described that the sharpness of lightsensitive materials can be improved by reducing the thickness thereof with the use of tabular grains (see, for example, JP-A-5-034857). However, the light scattering by tabular grains per se is increased in accordance with the reduction of the thickness of tabular grains. Consequently, there has occurred such a problem that the reduction of the thickness of tabular grains employed rather leads to a deterioration of the sharpness of lightsensitive materials.

Under these circumstances, it has been difficult to obtain a lightsensitive material that is highly sensitive by virtue of the advantage of tabular grains and simultaneously exhibits high sharpness.

BRIEF SUMMARY OF THE INVENTION

The present invention has been developed with a view toward solving the above problems of the prior art. It is an object of the present invention to provide a silver halide color photographic lightsensitive material that is highly sensitive, being excellent in graininess and exhibits high sharpness.

The object of the present invention has been attained by the following means.

(1) A silver halide color photographic lightsensitive material comprising a support and, superimposed thereon, at least one blue-sensitive silver halide emulsion layer, green-sensitive silver halide emulsion layer, red-sensitive silver halide emulsion layer and protective layer, which silver halide color photographic lightsensitive material contains at least one compound capable of increasing photographic speed, the compound having at least three heteroatoms in its molecule, and wherein at least one layer of the silver halide emulsion layers comprises an emulsion, the emulsion consisting of a lightsensitive silver halide emulsion wherein 50% or more in number of all the silver halide grains are occupied by tabular grains having (111) faces as main planes, the tabular grains:

(i) composed of silver iodobromide or silver chloroiodobromide;

(ii) having an equivalent circle diameter of 1.0 μm or more and a thickness of 0.15 μm or less; and (iii) composed of core portions of 0.1 μm or less thickness free of growth ring structure and composed of silver iodobromide and shell portions having ten or more dislocation lines.

(2) The silver halide color photographic lightsensitive material according to item (1) above, wherein the sum of protective layer thicknesses is 3 μm or less.

(3) The silver halide color photographic lightsensitive material according to item (1) or (2) above, wherein the compound capable of increasing photographic speed, the compound having at least three heteroatoms in its molecule, is a 1,3,4,6-tetraazaindene compound.

(4) The silver halide color photographic lightsensitive material according to any of items (1) to (3) above, wherein the compound capable of increasing photographic speed, the compound having at least three heteroatoms in its molecule, is represented by the following general formula (A) or general formula (B).

(A)

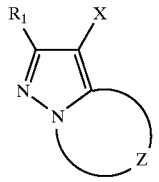

In the general formula (A), $R_1$ represents a hydrogen atom or a substituent. Z represents a nonmetallic atom group required for forming a 5-membered azole ring containing 2 to 4 nitrogen atoms. The azole ring may have a substituent (including a condensed ring). X represents a hydrogen atom or a substituent.

(B)

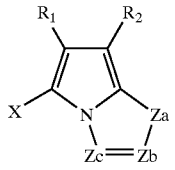

In the general formula (B), Za represents —NH— or —CH($R_3$)—. Each of Zb and Zc independently represents —C($R_4$)= or —N=. Each of $R_1$, $R_2$ and $R_3$ independently represents an electron withdrawing group whose Hammett substituent constant σp value is in the range of 0.2 to 1.0. $R_4$ represents a hydrogen atom or a substituent, provided that when there are two $R_4$s in the formula, the two $R_4$s may be identical with or different from each other. X represents a hydrogen atom or a substituent.

DETAILED DESCRIPTION OF THE INVENTION

The present invention will be described in detail below.

First, the compound capable of increasing photographic speed, the compound having at least three heteroatoms in its molecule, according to the present invention (hereinafter also referred to as "compound of the present invention") will be described. Herein, the heteroatom comprehends any of the atoms other than carbon and hydrogen, but is preferably selected from among nitrogen, sulfur, phosphorus and oxygen.

When the compound of the present invention is a heterocycle, the heterocycle means that three or more heteroatoms are present in constituent parts of a ring system, or means that at least one heteroatom is present in constituent parts of a ring system while at least two heteroatoms are present outside the ring system, namely, at positions separated from the ring system through at least one nonconjugated single bond, or part of further substituents of the ring system.

In the present invention, the expression "increase of photographic speed with respect to lightsensitive materials" means that the value S0.2 is increased by 0.02 or more, preferably 0.03 or more, and more preferably 0.04 or more. The value S0.2 refers to the logarithm of inverse number of exposure intensity required for realizing a density of fog+0.2 with respect to lightsensitive materials having been developed according to the development processing procedure described in Example 1. The compound capable of increasing photographic speed refers to a compound which causes the S0.2 value of a lightsensitive material containing the compound to be 0.02 or more higher than that of the lightsensitive material not containing the compound.

The compound of the present invention, although may be used in any of silver halide lightsensitive layers and nonsensitive layers of a lightsensitive material, is preferably used in silver halide lightsensitive layers.

When the compound of the present invention is used in two or more silver halide lightsensitive layers whose sensitivities are different from each other, although the compound may be incorporated in layers of any sensitivity, it is preferred that the compound be incorporated in the layer of the highest sensitivity.

When the compound of the present invention is used in a nonsensitive layer, it is preferred that the compound be incorporated in an interlayer disposed between a red-sensitive layer and a green-sensitive layer or between a green-sensitive layer and a blue-sensitive layer.

Although the method of introducing the compound of the present invention in a lightsensitive material is not particularly limited and use can be made of, for example, any of the method of emulsifying the compound together with a high-boiling organic solvent, etc., the method of solid dispersion, the method of dissolving the compound in an organic solvent such as methanol and adding the solution to coating liquids and the method of adding the compound at the time of preparation of silver halide emulsions, it is preferred to introduce the compound in a lightsensitive material through emulsification.

The compounds of the present invention comprehend a compound that reacts with developing agent oxidation products to thereby release residues of the compound having at least three heteroatoms, which compound can preferably be employed.

The content of compound of the present invention, although not particularly limited, is preferably in the range of 0.1 to 1000 mg/m$^2$, more preferably 1 to 500 mg/m$^2$, and most preferably 5 to 100 mg/m$^2$ of lightsensitive material.

In the use of the compound of the present invention in lightsensitive silver halide emulsion layers, the content thereof per layer is preferably in the range of $1\times10^{-4}$ to $1\times10^{-1}$ mol, more preferably $1\times10^{-3}$ to $5\times10^{-2}$ mol per mol of silver.

Specific examples of the compounds of the present invention will be shown below, which however in no way limit the scope of compounds according to the present invention.

HET-1

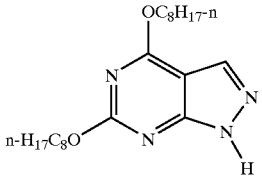

HET-2

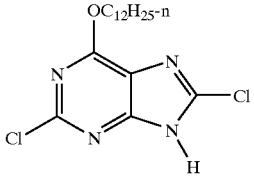

HET-3

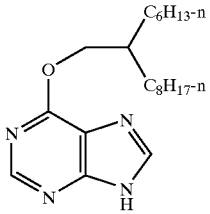

HET-4

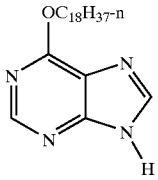

HET-5

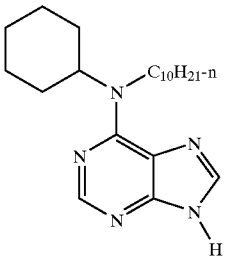

HET-6

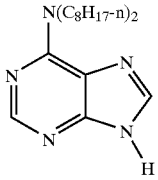

-continued

HET-7

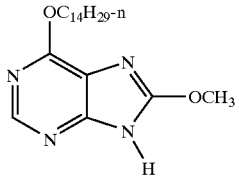

HET-8

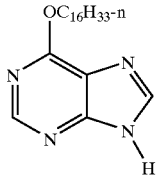

HET-9

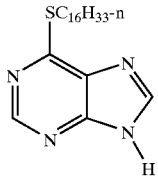

HET-10

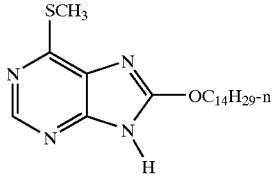

HET-11

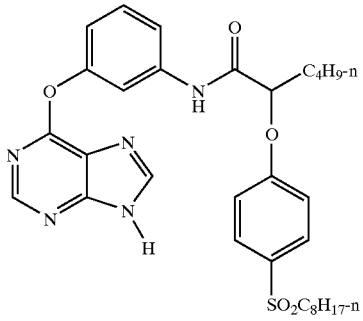

HET-12

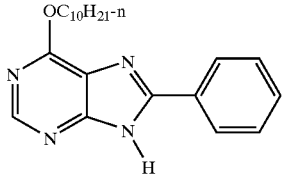

HET-13

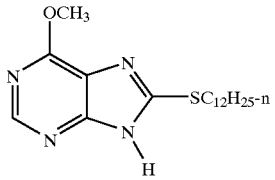

HET-14

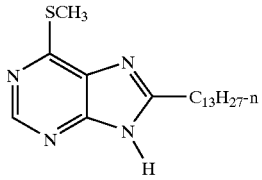

-continued
HET-15
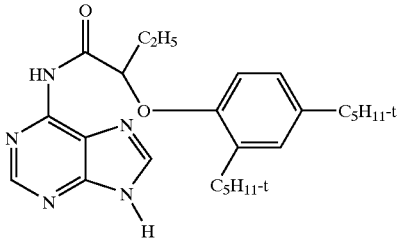
HET-16
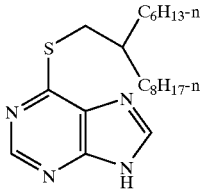
HET-17
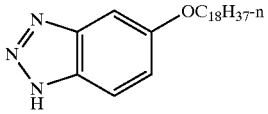
HET-18
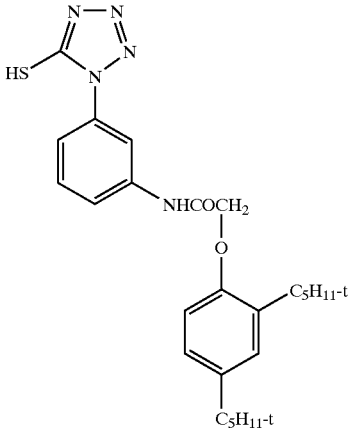
HET-19
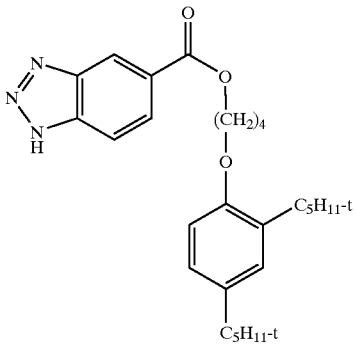
HET-20
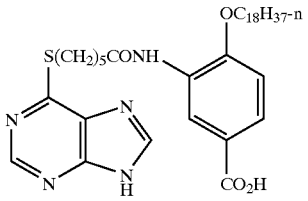
-continued
HET-21
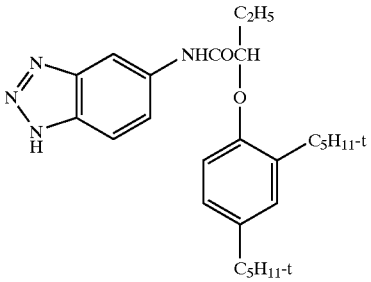
HET-22
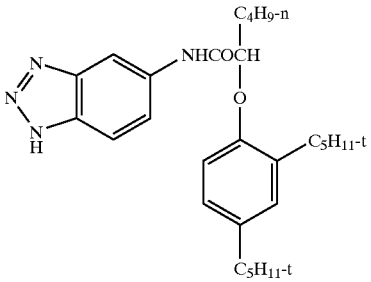
HET-23
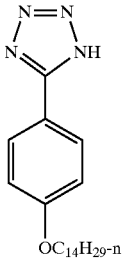
HET-24
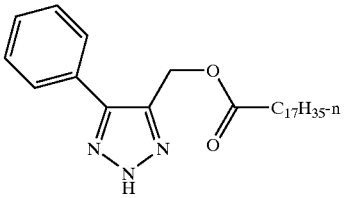
HET-25
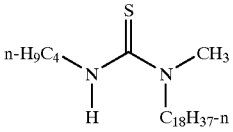
HET-26
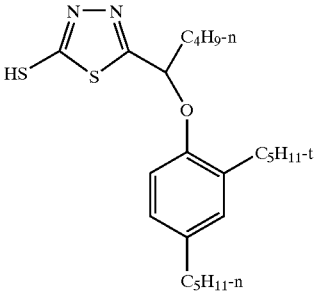

-continued
HET-27
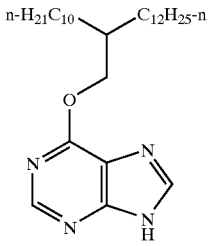
HET-28
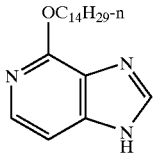
HET-29
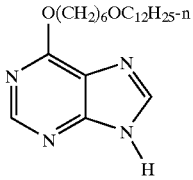
HET-30
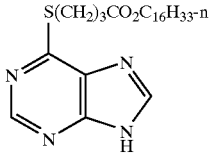
HET-31
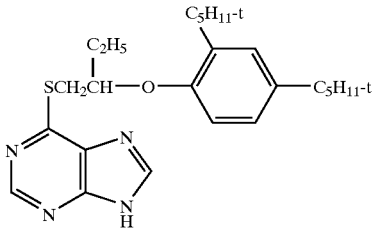
HET-32
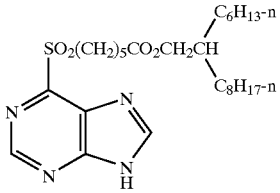
HET-33
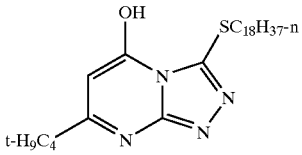
-continued
HET-34
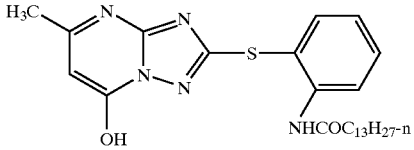
HET-35
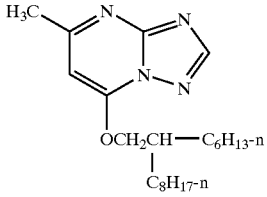
HET-36
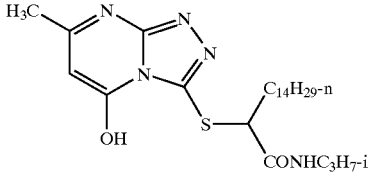
HET-37
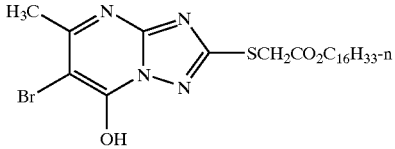
HET-38
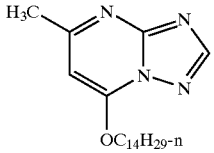
HET-39
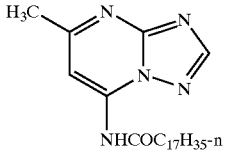
HET-40
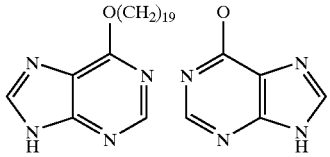
HET-41
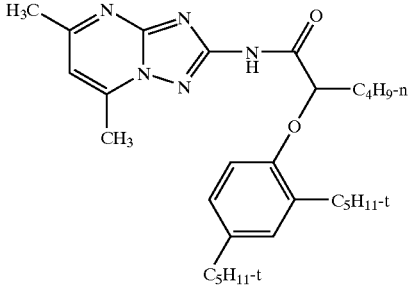

-continued

HET-42

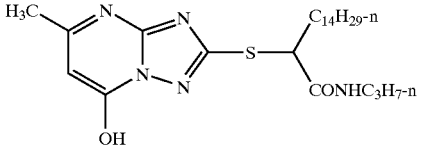

HET-43

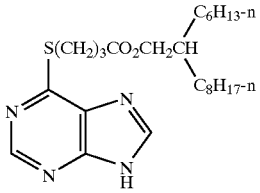

HET-44

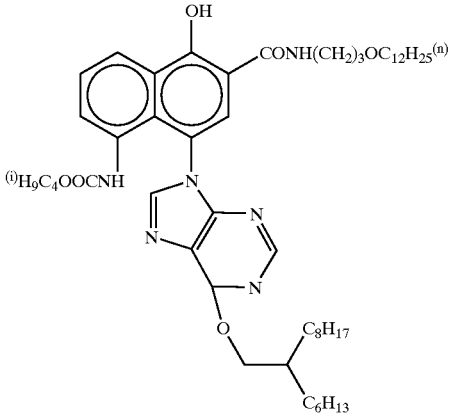

HET-45

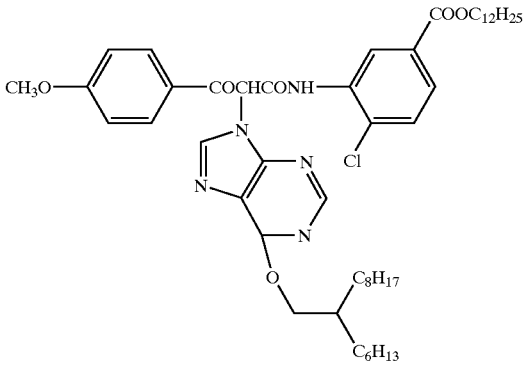

HET-46

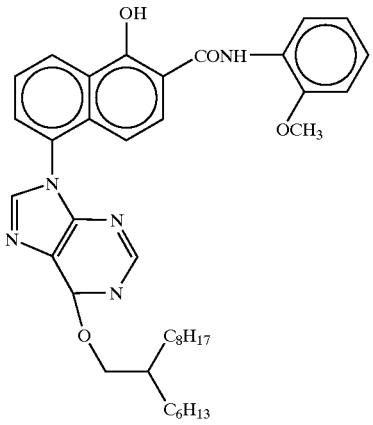

-continued

HET-47

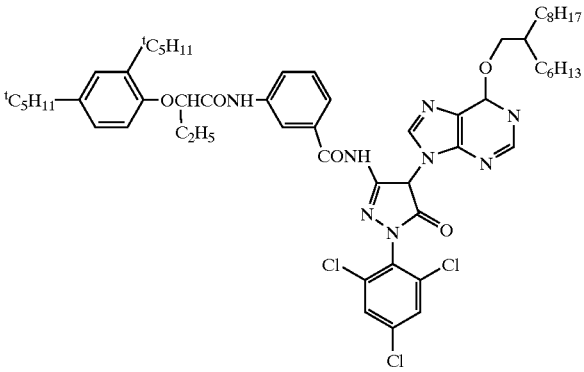

Now, the compounds of the general formula (A) or general formula (B) that can preferably be used in the present invention will be described.

(A)

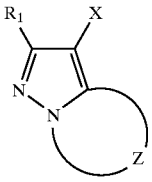

(B)

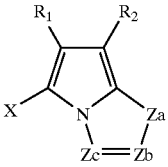

In the general formula (A), $R_1$ represents a hydrogen atom or a substituent. Z represents a nonmetallic atom group required for forming a 5-membered azole ring containing 2 to 4 nitrogen atoms. The azole ring may have a substituent (including a condensed ring). X represents a hydrogen atom or a substituent.

In the general formula (B), Za represents —NH— or —CH($R_3$)—. Each of Zb and Zc independently represents —C($R_4$)= or —N=. Each of $R_1$, $R_2$ and $R_3$ independently represents an electron withdrawing group whose Hammett substituent constant σp value is in the range of 0.2 to 1.0. $R_4$ represents a hydrogen atom or a substituent, provided that when there are two $R_4$s in the formula, the two $R_4$s may be identical with or different from each other. X represents a hydrogen atom or a substituent.

These compounds will be described in detail below. Among the skeletons represented by the general formula (A), those preferred are 1H-pyrazolo[1,5-b][1,2,4]triazole and 1H-pyrazolo[5,1-c][1,2,4]triazole, which are represented by the general formula (A-1) and general formula (A-2), respectively.

(A-1)

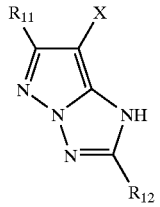

(A-2)

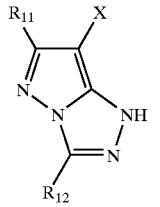

In the formulae, each of $R_{11}$ and $R_{12}$ represents a substituent. X represents a hydrogen atom or a substituent.

The substituents $R_{11}$, $R_{12}$ and X of the general formulae (A-1) and (A-2) will be described in detail below.

As the substituent $R_{11}$, there can be mentioned, for example, a halogen atom (e.g., a chlorine atom, a bromine atom or a fluorine atom); an alkyl group (having 1 to 60 carbon atoms, such as methyl, ethyl, propyl, isobutyl, t-butyl, t-octyl, 1-ethylhexyl, nonyl, undecyl, pentadecyl, n-hexadecyl or 3-decanamidopropyl); an alkenyl group (having 2 to 60 carbon atoms, such as vinyl, allyl or oleyl); a cycloalkyl group (having 5 to 60 carbon atoms, such as cyclopentyl, cyclohexyl, 4-t-butylcyclohexyl, 1-indenyl or cyclododecyl); an aryl group (having 6 to 60 carbon atoms, such as phenyl, p-tolyl or naphthyl); an acylamino group (having 2 to 60 carbon atoms, such as acetylamino, n-butanamido, octanoylamino, 2-hexyldecanamido, 2-(2',4'-di-t-amylphenoxy)butanamido, benzoylamino or nicotinamido); a sulfonamido group (having 1 to 60 carbon atoms, such as methanesulfonamido, octanesulfonamido or benzenesulfonamido); a ureido group (having 2 to 60 carbon atoms, such as decylaminocarbonylamino or di-n-octylaminocarbonylamino); a urethane group (having 2 to 60 carbon atoms, such as dodecyloxycarbonylamino, phenoxycarbonylamino or 2-ethylhexyloxycarbonylamino); an alkoxy group (having 1 to 60 carbon atoms, such as methoxy, ethoxy, butoxy, n-octyloxy, hexadecyloxy or methoxyethoxy); an aryloxy group (having 6 to 60 carbon atoms, such as phenoxy, 2,4-di-t-amylphenoxy, 4-t-octylphenoxy or naphthoxy); an alkylthio group (having 1 to 60 carbon atoms, such as methylthio, ethylthio, butylthio or hexadecylthio); an arylthio group (having 6 to 60 carbon atoms, such as phenylthio or 4-dodecyloxyphenylthio); an acyl group (having 1 to 60 carbon atoms, such as acetyl, benzoyl, butanoyl or dodecanoyl); a sulfonyl group (having 1 to 60 carbon atoms, such as methanesulfonyl, butanesulfonyl or toluenesulfonyl); a cyano group; a carbamoyl group (having 1 to 60 carbon atoms, such as N,N-dicyclohexylcarbamoyl); a sulfamoyl group (having 0 to 60 carbon atoms, such as N,N-dimethylsulfamoyl); a hydroxyl group; a sulfo group; a carboxyl group; a nitro group; an alkylamino group (having 1 to 60 carbon atoms, such as methylamino, diethylamino, octylamino or octadecylamino); an arylamino group (having 6 to 60 carbon atoms, such as phenylamino, naphthylaminor or N-methyl-N-phenylamino); a heterocyclic group (having 0 to 60 carbon atoms, preferably heterocyclic group wherein an atom selected from among a nitrogen atom, an oxygen atom and a sulfur atom is used as a heteroatom being a constituent of the ring, more preferably heterocyclic group wherein not only a heteroatom but also a carbon atom is used as constituent atoms of the ring, especially heterocyclic group having a 3 to 8-, preferably 5 to 6-membered ring, such as heterocyclic groups listed later with respect to the substituent X); an acyloxy group (having 1 to 60 carbon atoms, such as formyloxy, acetyloxy, myristoyloxy or benzoyloxy); or the like.

Among these groups, the alkyl, cycloalkyl, aryl, acylamino, ureido, urethane, alkoxy, aryloxy, alkylthio, arylthio, acyl, sulfonyl, cyano, carbamoyl and sulfamoyl groups include those having substituents and those, if practicable, having condensed rings. Examples of such substituents include an alkyl group, a cycloalkyl group, an aryl group, an acylamino group, a ureido group, a urethane group, an alkoxy group, an aryloxy group, an alkylthio group, an arylthio group, an acyl group, a sulfonyl group, a cyano group, a carbamoyl group and a sulfamoyl group. As the condensed rings, there can be mentioned benzene and the like.

Among these substituents, an alkyl group, an aryl group, an alkoxy group or an aryloxy group can be mentioned as preferred $R_{11}$. An alkyl group, an alkoxy group or an aryloxy group can be mentioned as more preferred $R_{11}$. The most preferred $R_{11}$ is a branched alkyl group.

X represents a hydrogen atom or a substituent. This substituent can be any of the substituents listed as $R_{11}$ above. The substituent represented by X is preferably an alkyl group, an alkoxycarbonyl group, a carbamoyl group or a group split off at the reaction with developing agent oxidation products. As this group, there can be mentioned, for example, a halogen atom (e.g., a fluorine atom, a chlorine atom or a bromine atom); an alkoxy group (e.g., ethoxy, methoxycarbonylmethoxy, carboxypropyloxy, methanesulfonylethoxy or perfluoropropoxy); an aryloxy group (e.g., 4-carboxyphenoxy, 4-(4-hydroxyphenylsulfonyl)phenoxy, 4-methanesulfonyl-3-carboxyphenoxy or 2-methanesulfonyl-4-acetylsulfamoylphenoxy); an acyloxy group (e.g., acetoxy or benzoyloxy); a sulfonyloxy group (e.g., methanesulfonyloxy or benzenesulfonyloxy); an acylamino group (e.g., heptafluorobutyrylamino); a sulfonamido group (e.g., methanesulfonamido); an alkoxycarbonyloxy group (e.g., ethoxycarbonyloxy); a carbamoyloxy group (e.g., diethylcarbamoyloxy, piperidinocarbonyloxy or morpholinocarbonyloxy); an alkylthio group (e.g., 2-carboxyethylthio); an arylthio group (e.g., 2-octyloxy-5-t-octylphenylthio or 2-(2,4-di-t-amylphenoxy) butyrylaminophenylthio); a hetrocyclic thio group (e.g., 1-phenyltetrazolylthio or 2-benzimidazolylthio); a heterocyclic oxy group (e.g., 2-pyridyloxy or 5-nitro-2-pyridyloxy); a 5- or 6-membered nitrogenous heterocyclic group (e.g., 1-triazolyl, 1-imidazolyl, 1-pyrazolyl, 5-chloro-1-tetrazolyl, 1-benzotriazolyl, 2-phenylcarbamoyl-1-imidazolyl, 5,5-dimethylhydantoin-3-yl, 1-benzylhydantoin-3-yl, 5,5-dimethyloxazolidine-2,4-dion-3-yl or purine); or an azo group (e.g., 4-methoxyphenylazo or 4-pivaloylaminophenylazo).

The substituent represented by X is preferably an alkyl group, an alkoxycarbonyl group, a carbamoyl group, a halogen atom, an alkoxy group, an aryloxy group, an alkyl- or arylthio group or a 5- or 6-membered nitrogenous heterocyclic group having coupling-active nitrogen atom bonding. The substituent is more preferably an alkyl group, a carbamoyl group, a halogen atom, a substituted aryloxy group, a substituted arylthio group, an alkylthio group or a 1-pyrazolyl group.

The substituent represented by $R_{12}$ can be the same as listed with respect to $R_{11}$. The substituent represented by $R_{12}$ is preferably an alkyl group, an aryl group, a heterocyclic group, an alkoxy group or an aryloxy group. The substituent is more preferably a substituted alkyl group or a substituted aryl group, and is most preferably a substituted aryl group. Compounds of the general formulae (A-3) and (A-4) are preferred. In the general formulae (A-3) and (A-4), the position of —$NHSO_2R_{13}$ substitution, although not particularly limited, is preferably m- or p-position, most preferably p-position.

(A-3)

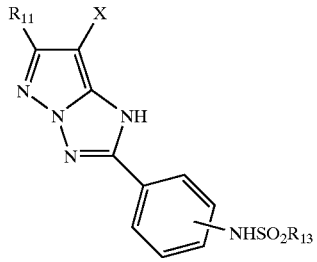

(A-4)

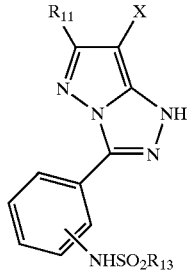

In the general formulae, $R_{11}$ and X are as defined above with respect to the general formulae (A-1) and (A-2), and $R_{13}$ represents a substituent. The substituent represented by $R_{13}$ can be any of those listed as $R_{11}$ above. The substituent represented by $R_{13}$ is preferably a substituted aryl group or a substituted or unsubstituted alkyl group. This substituent can be any of those listed as $R_{11}$ above.

The compounds represented by the general formulae (A-1) and (A-2) and preferably employed in the present invention may form a dimer or oligomer through $R_{11}$ or $R_{12}$, or may be bonded to a polymer chain. In the present invention, the compounds of the general formula (A-1) are preferred, and the compounds of the general formula (A-3) are more preferred.

Now, the general formula (B) will be described.

Examples of the compounds represented by the general formula (B) according to the present invention include those of the following general formulae (B3) to (B10).

(B3)

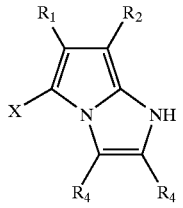

-continued (B4)

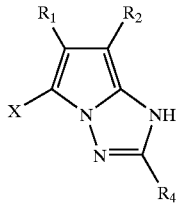

(B5)

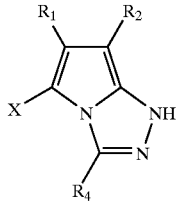

(B6)

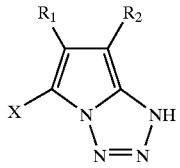

(B7)

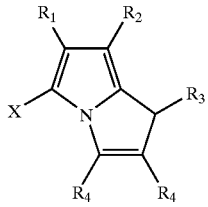

(B8)

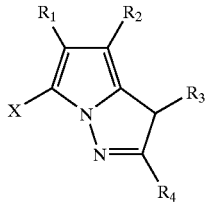

(B9)

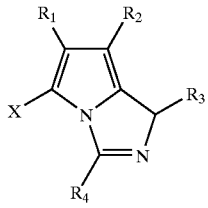

(B10)

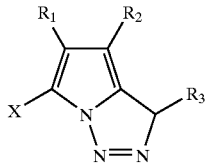

In these general formulae, $R_1$ to $R_4$ and X have the same meaning as in the general formula (B).

In the present invention, the compounds of the general formulae (B3), (B4), (B5) and (B8) are preferred, and the compounds of the general formula (B4) are most preferred.

In the general formula (B), the substituent represented by $R_1$, $R_2$ or $R_3$ is an electron withdrawing group whose Hammett substituent constant σp value is in the range of 0.20 to 1.0. Preferably, the σp value is in the range of 0.2 to 0.8. Hammett's rule is a rule of thumb advocated by L. P. Hammett in 1935 for quantitatively considering the effect of substituents on the reaction or equilibrium of benzene derivatives, and the appropriateness thereof is now widely recognized. The substituent constant determined in the Hammett's rule involves σp value and σm value. These values can be found in a multiplicity of general publications, and are detailed in, for example, "Lange's Handbook of Chemistry" 12th edition by J. A. Dean, 1979 (Mc Graw-Hill), "Kagaku no Ryoiki" special issue, no. 122, p.p. 96 to 103, 1979 (Nankodo), and Chemical Review, vol. 91, pp. 165–195, 1991.

Although in the present invention, the substituents $R_1$, $R_2$ and $R_3$ are limited by the Hammett substituent constant values, this should not be construed as limitation to only substituents whose values are known from literature and can be found in the above publications, and should naturally be construed as including substituents whose values, even if unknown from literature, would be included in stated ranges when measured according to the Hammett's rule.

Examples of the electron withdrawing groups whose σp values are in the range of 0.2 to 1.0 include an acyl group, an alkoxycarbonyl group, an aryloxycarbonyl group, a carbamoyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group and the like. Groups capable of having further substituents among these substituents may have further substituents as mentioned later with respect to $R_4$.

Each of $R_1$, $R_2$ and $R_3$ preferably represents an acyl group, an alkoxycarbonyl group, a cycloalkoxycarbonyl group, an aryloxycarbonyl group, a carbamoyl group, a cyano group or a sulfonyl group; and more preferably represents a cyano group, an acyl group, an alkoxycarbonyl group, a cycloalkoxycarbonyl group, an aryloxycarbonyl group or a carbamoyl group.

In a preferred combination of $R_1$ and $R_2$, $R_1$ represents a cyano group while $R_2$ represents a cycloalkoxycarbonyl group or an alkoxycarbonyl group.

$R_4$ represents a hydrogen atom or a substituent. This substituent can be any of the substituents listed as $R_{11}$ above.

Preferred examples of the substituents represented by $R_4$ include an alkyl group, an aryl group, a heterocyclic group, an alkoxy group, an aryloxy group and an acylamino group. The substituent represented by $R_4$ is more preferably an alkyl group or a substituted aryl group, and most preferably a substituted aryl group. This substituent can be any of those mentioned above.

X has the same meaning as in the general formula (A).

Specific examples of the preferably employed compounds of the present invention will be shown below, which however in no way limit the scope of the present invention.

(1)

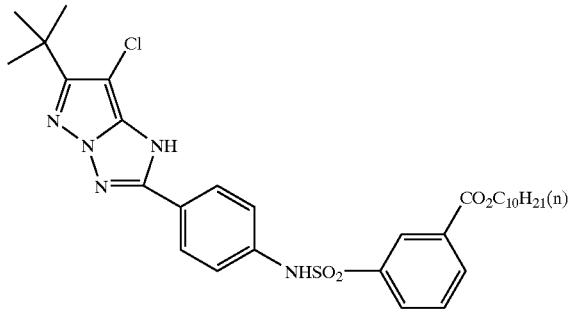

(2)

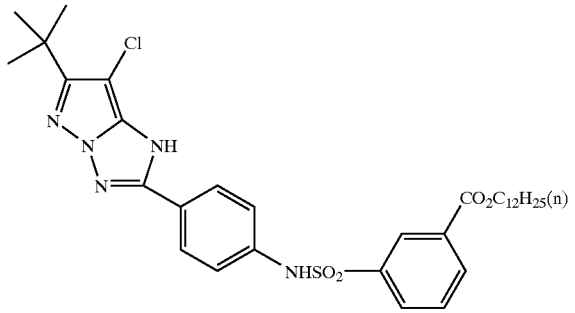

(3)

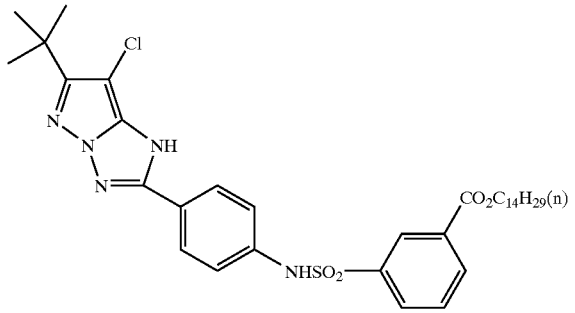

(4)

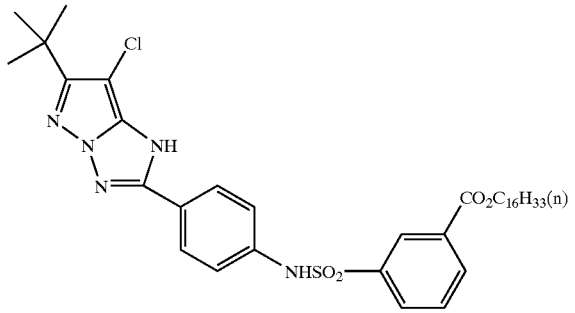

(5)

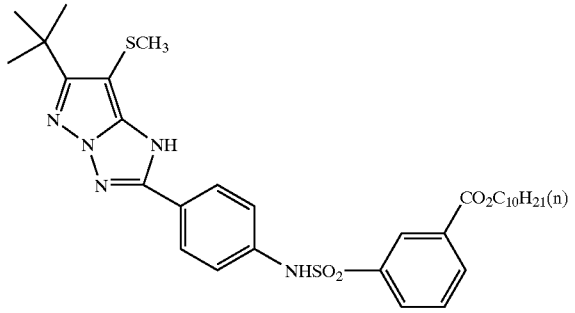

-continued
(6)
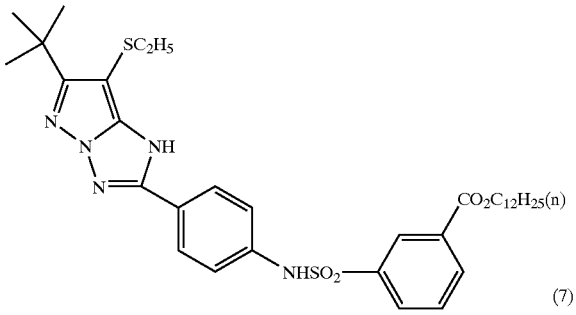
(7)
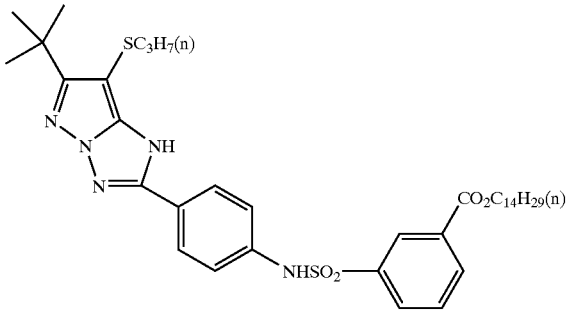
(8)
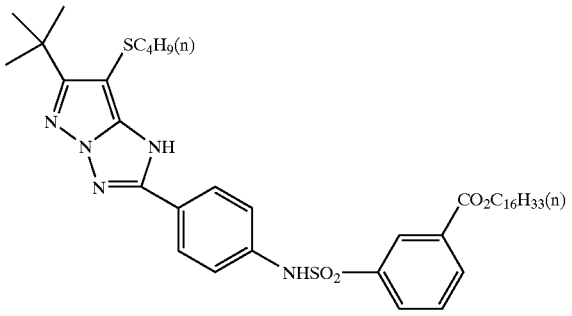
(9)
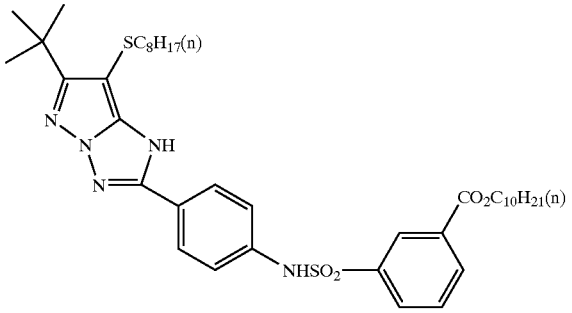
(10)
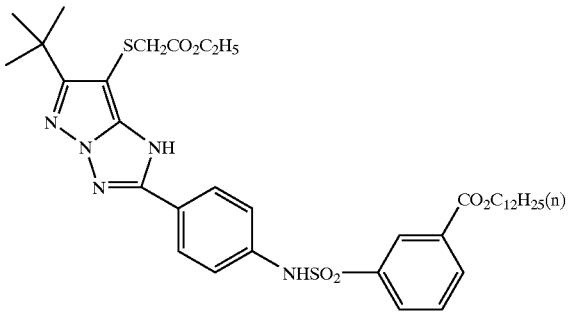
-continued
(11)
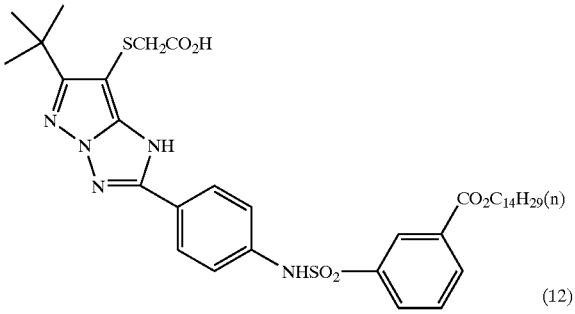
(12)
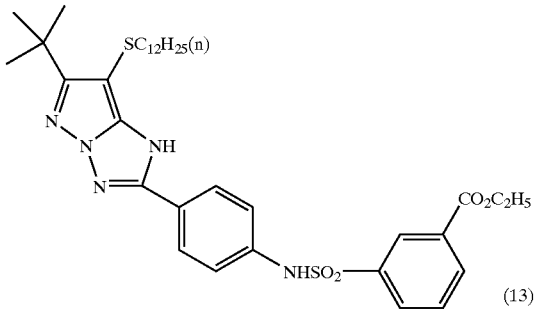
(13)
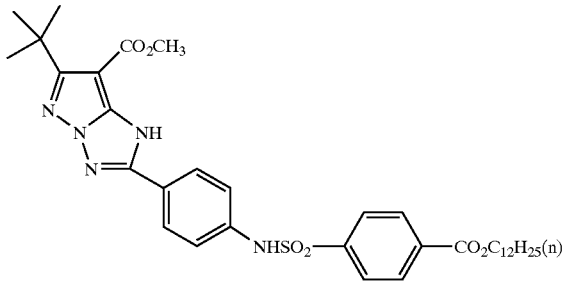
(14)
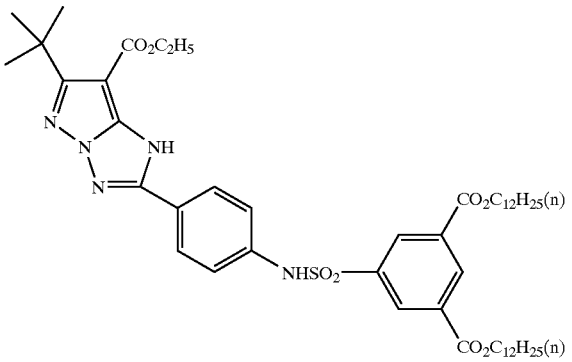
(15)
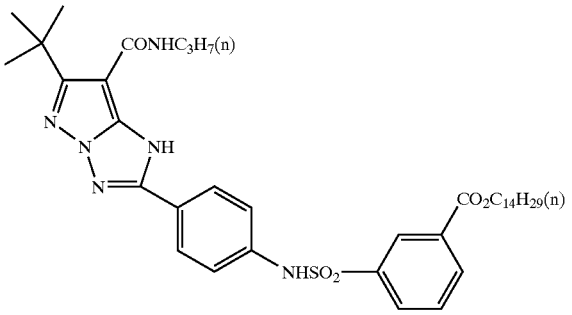

-continued
(16)
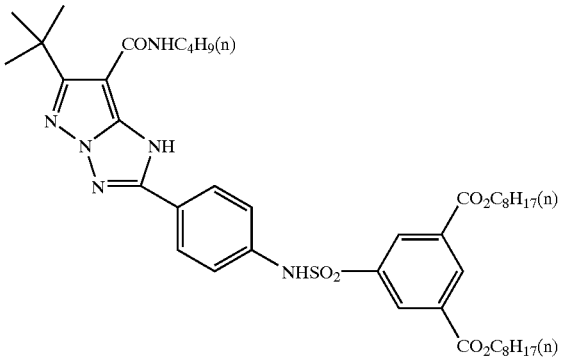
(17)
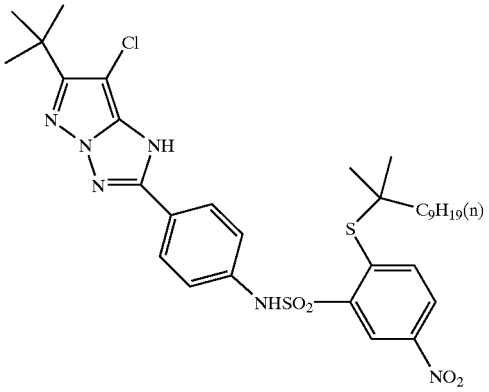
(18)
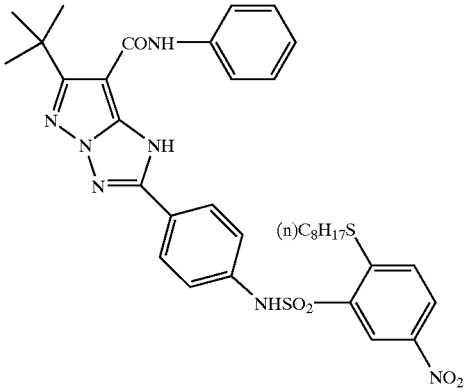
(19)
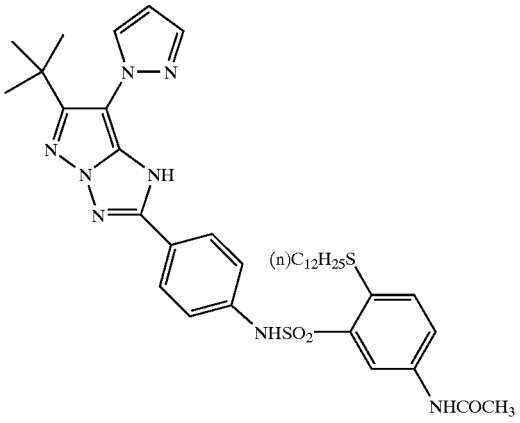
-continued
(20)
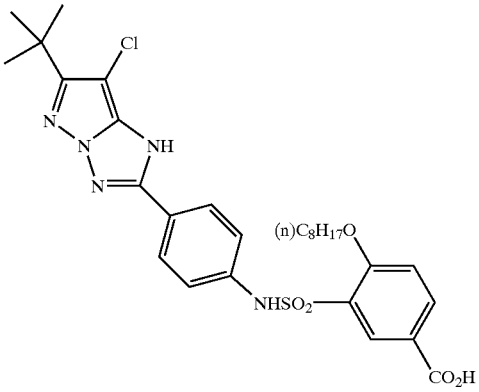
(21)
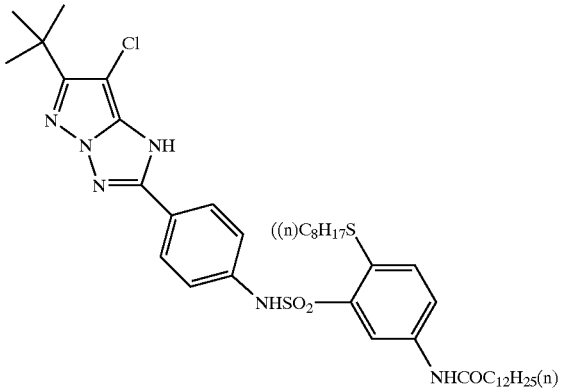
(22)
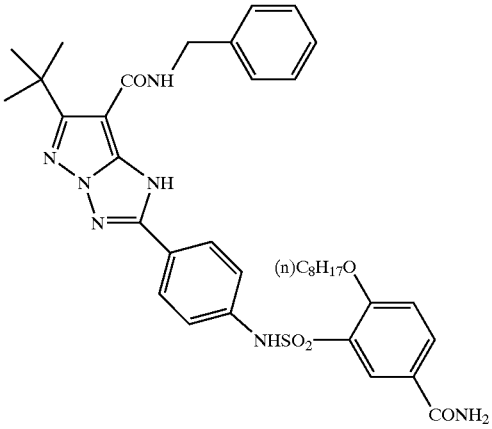
(23)
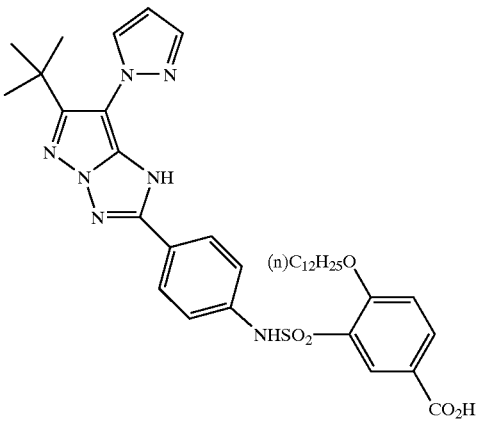

-continued
(24)
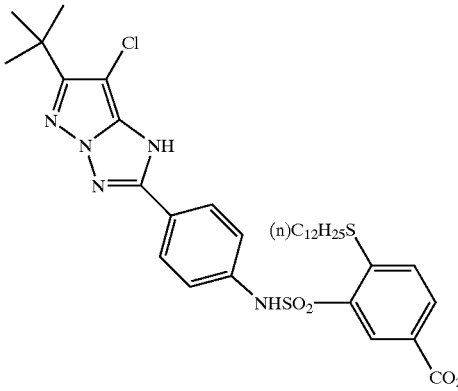
(25)
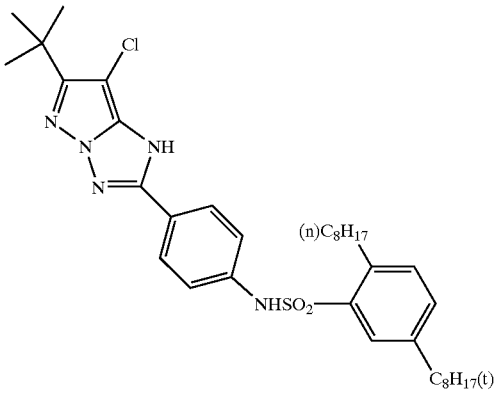
(26)
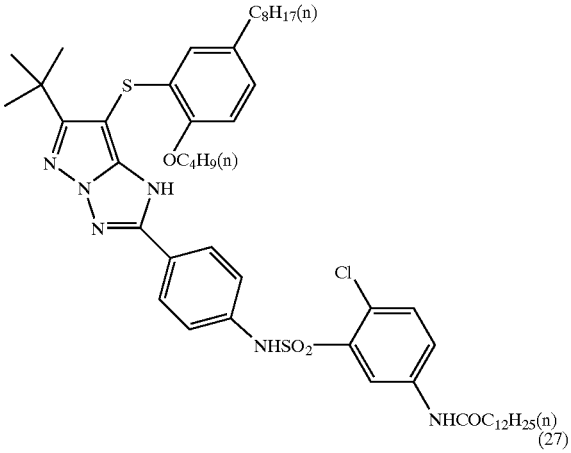
(27)
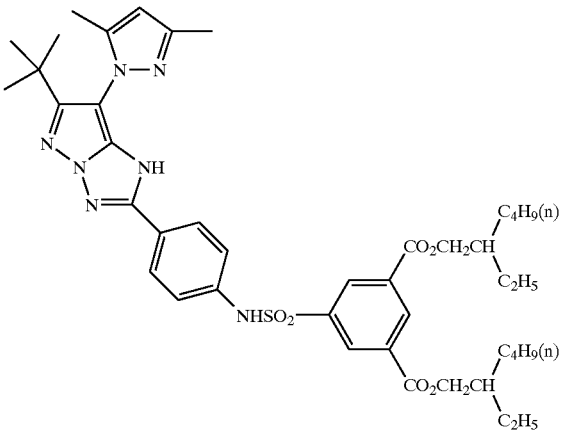
-continued
(28)
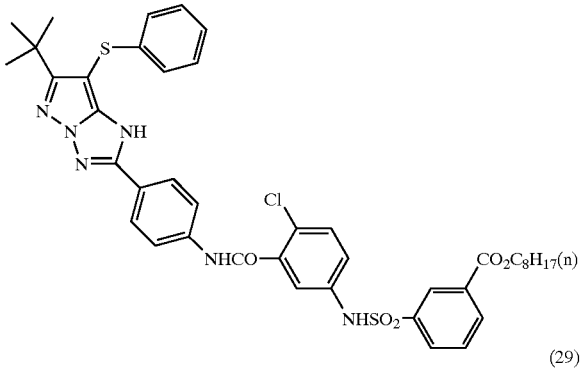
(29)
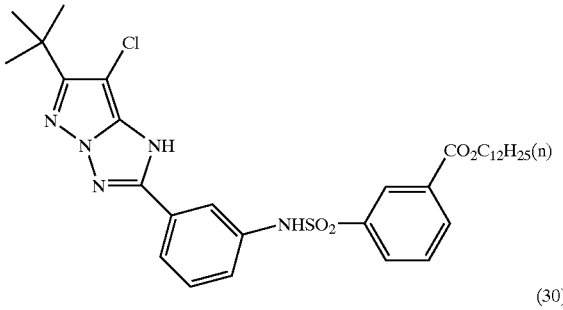
(30)
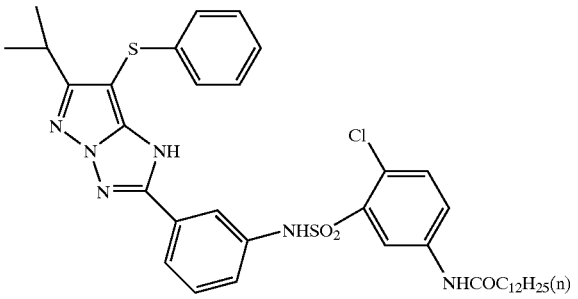
(31)
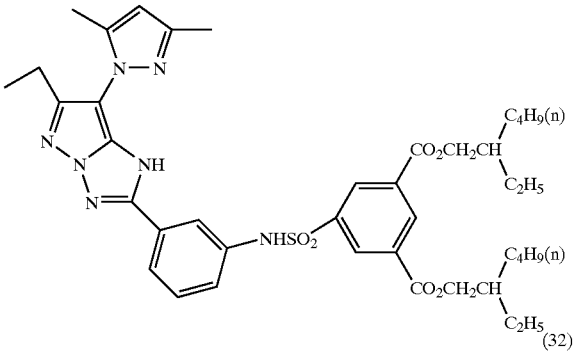
(32)
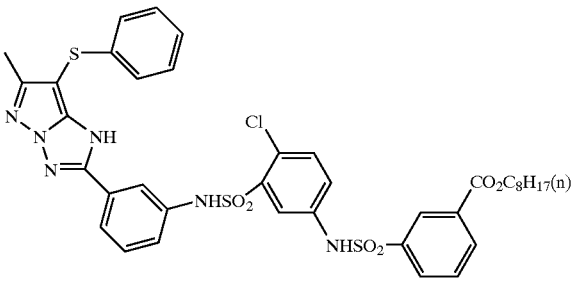

-continued
(33)
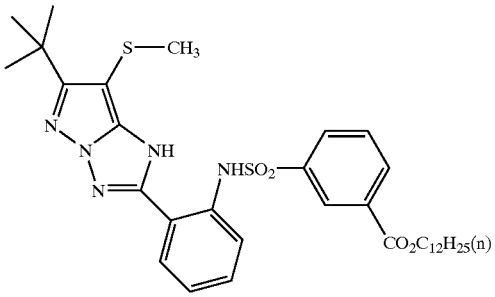
(34)
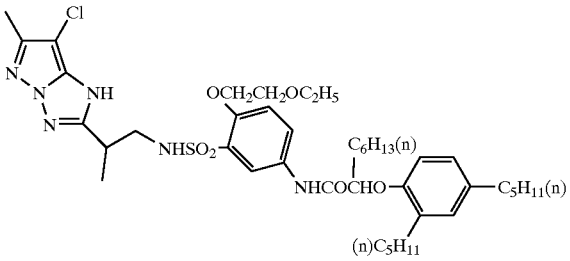
(35)
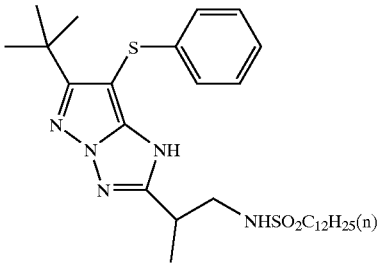
(36)
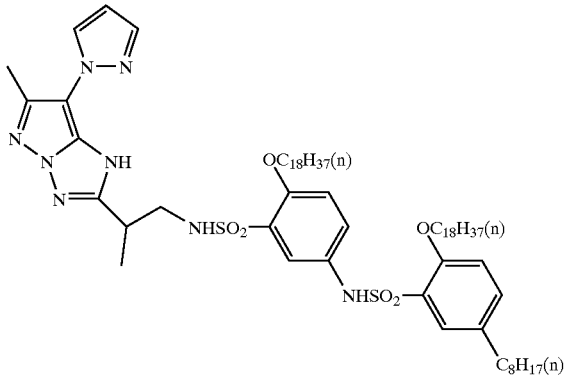
(37)
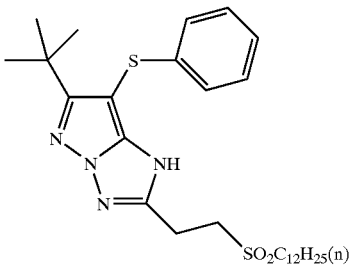
-continued
(38)
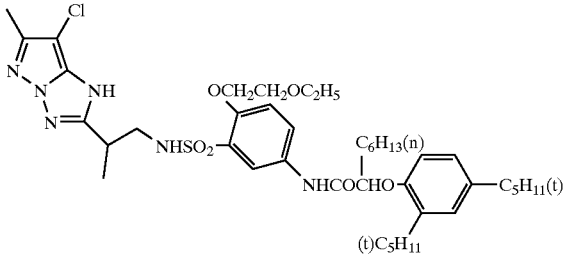
(39)
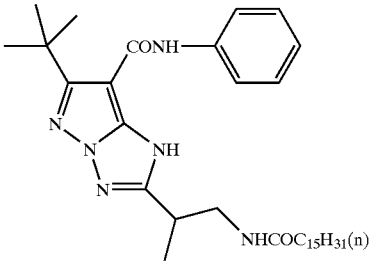
(40)
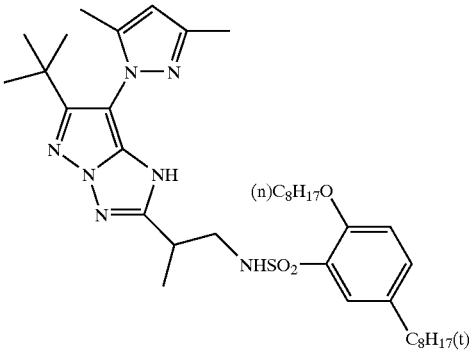
(41)
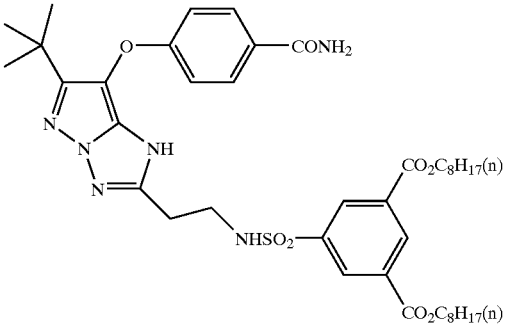
(42)
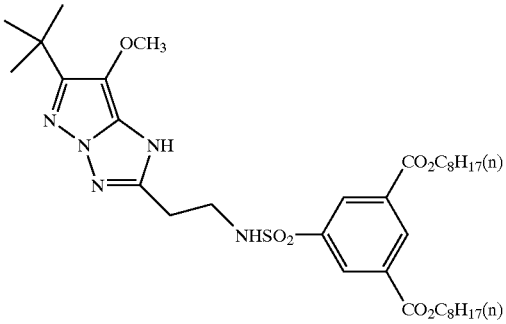

-continued
(43)
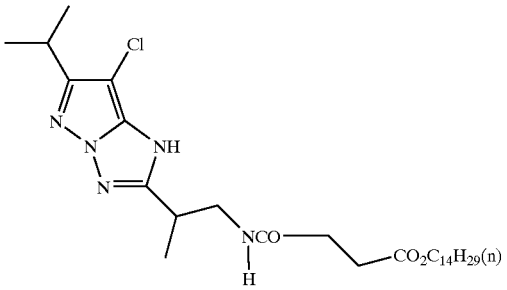
(44)
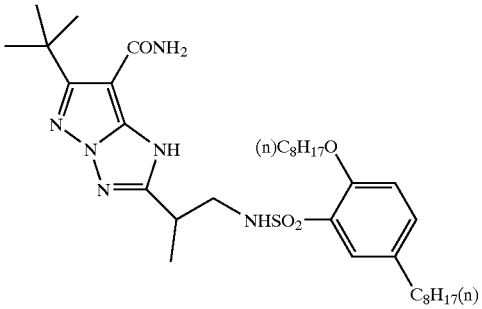
(45)
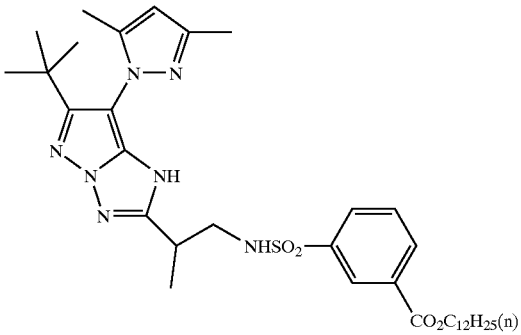
(46)
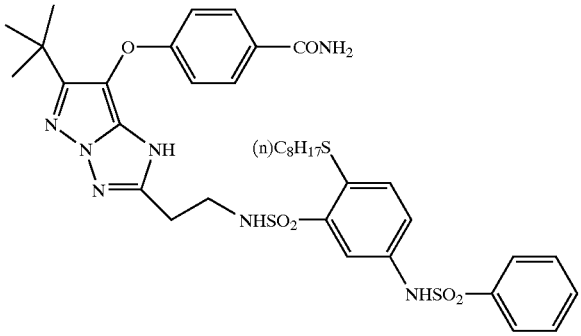
(47)
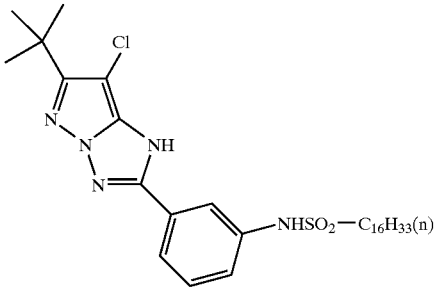
-continued
(48)
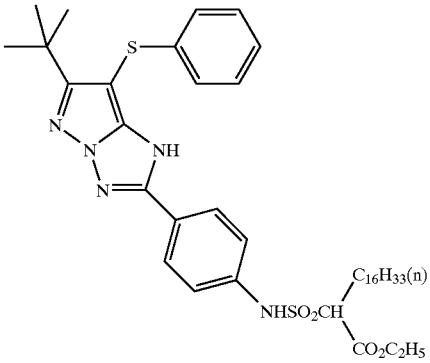
(49)
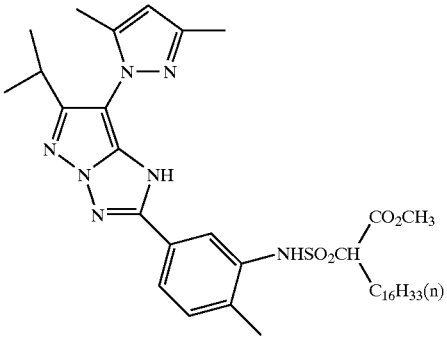
(50)
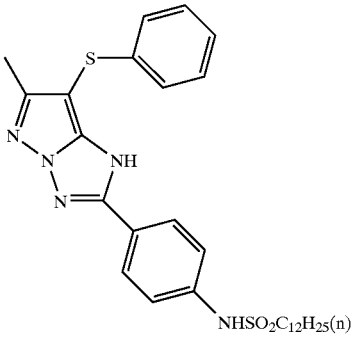
(51)
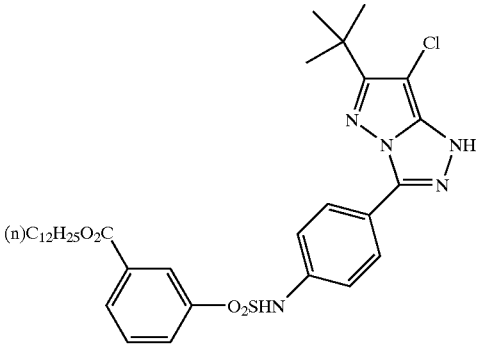

-continued
(52)
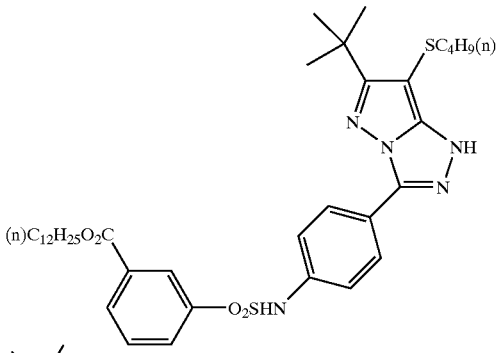
(53)
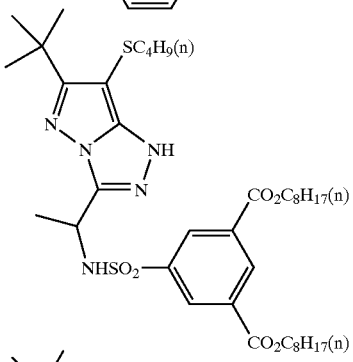
(54)
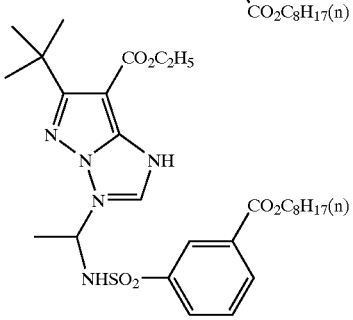
(55)
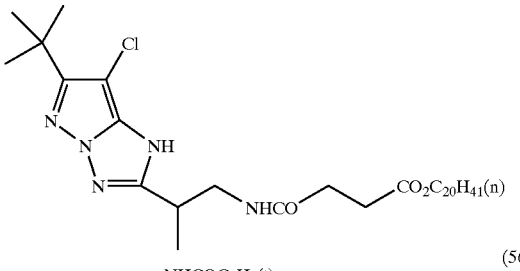
(56)
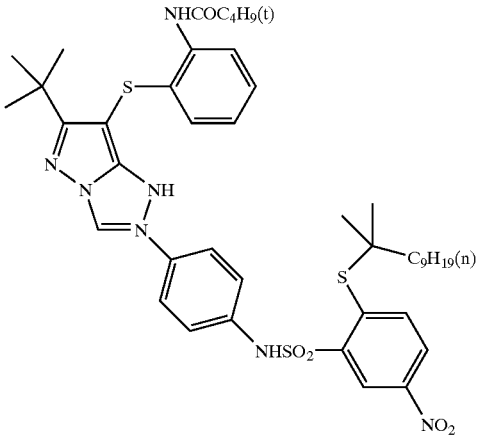
-continued
(57)
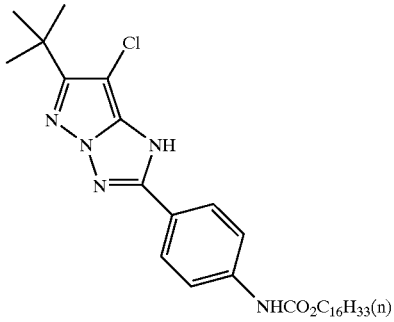
(58)
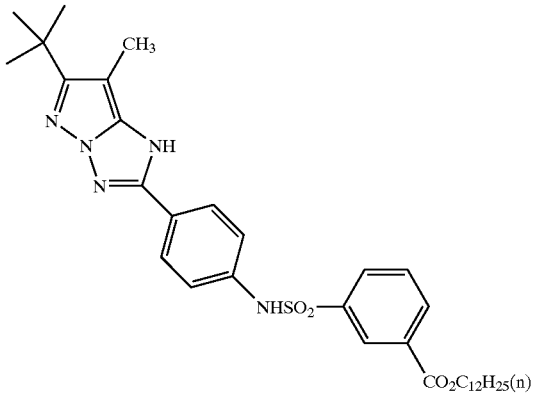
(59)
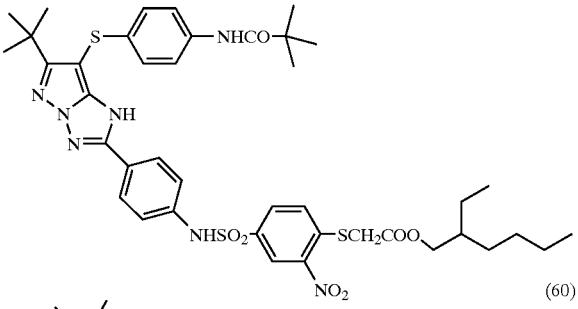
(60)
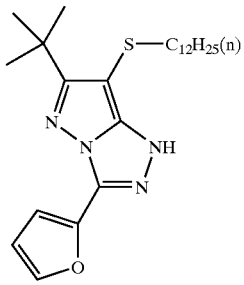
(61)
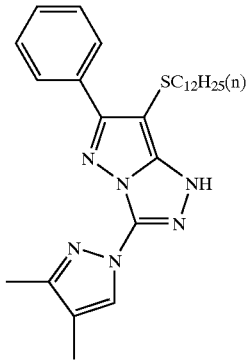

-continued
(62)
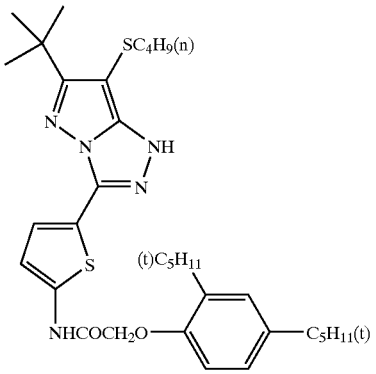
(63)
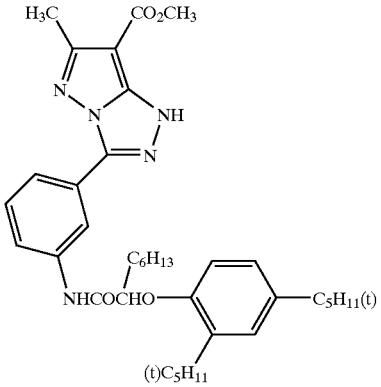
(64)
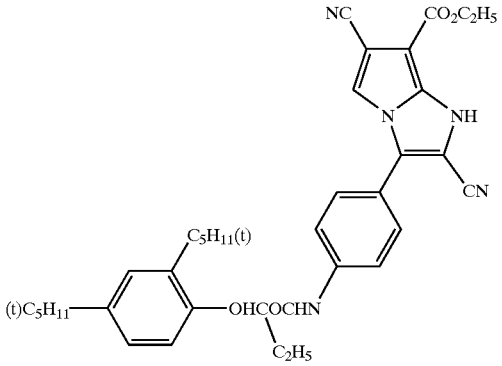
(65)
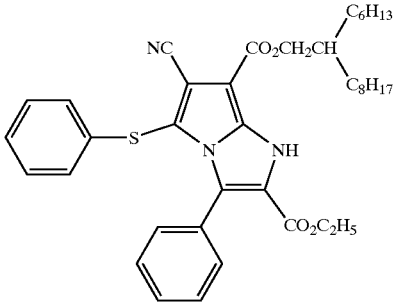
-continued
(66)
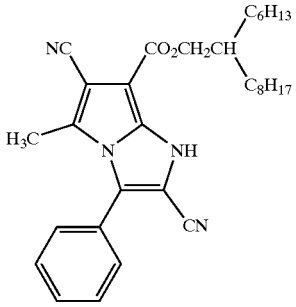
(67)
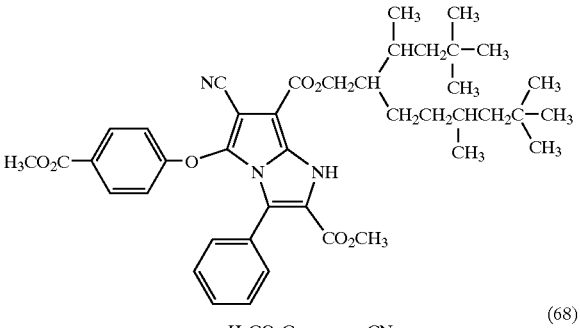
(68)
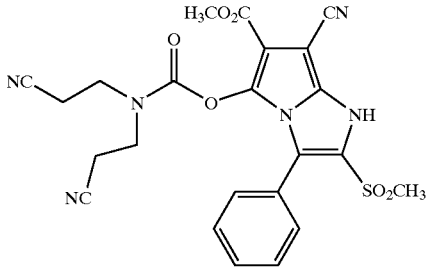
(69)
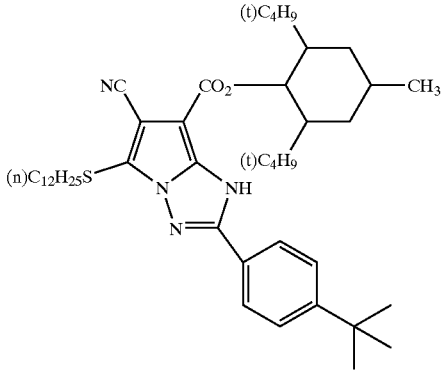
(70)
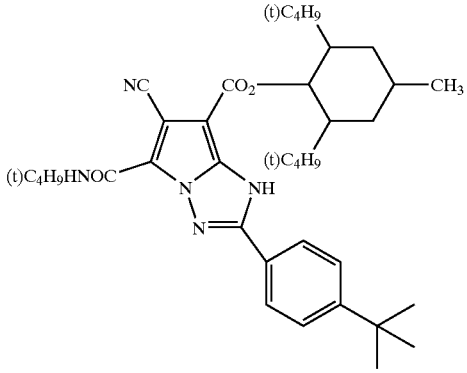

-continued
(71)
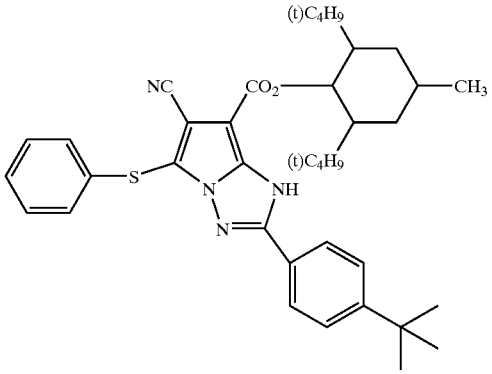
(72)
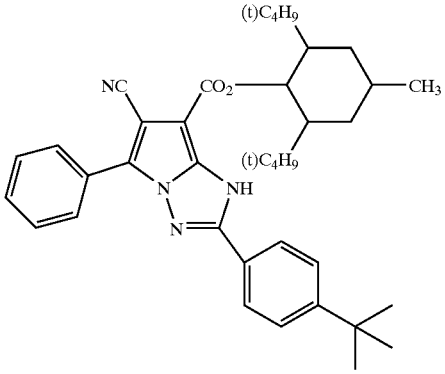
(73)
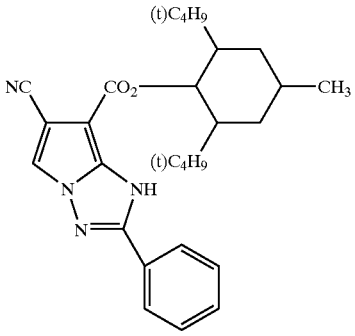
(74)
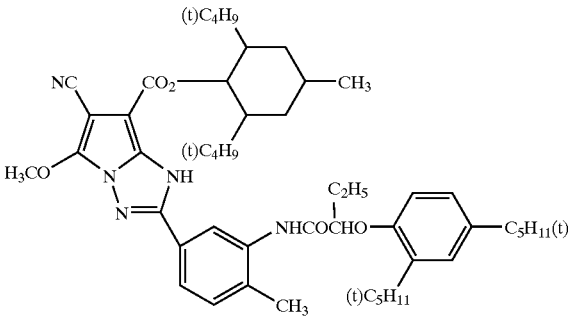
-continued
(75)
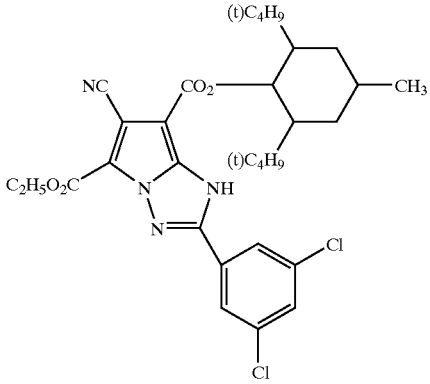
(76)
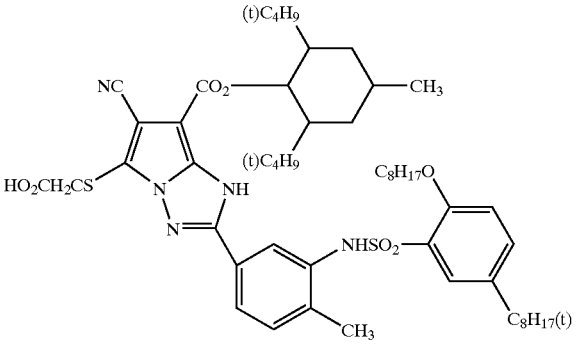
(77)
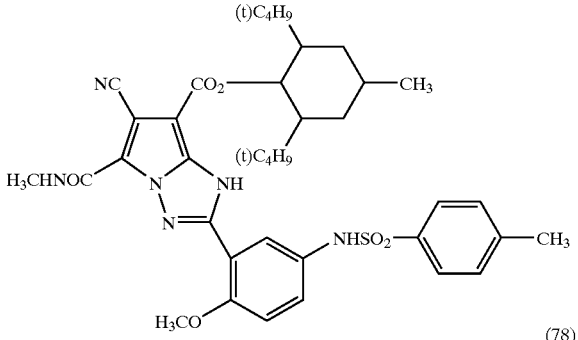
(78)
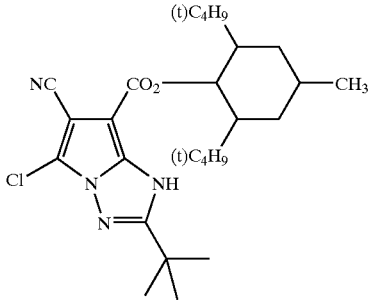
(79)
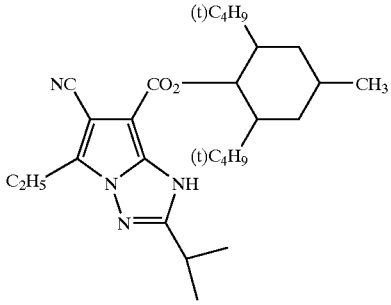

-continued (80)

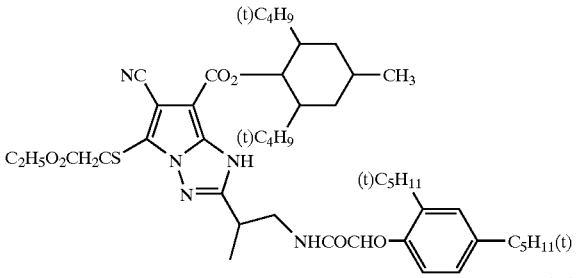

(81)

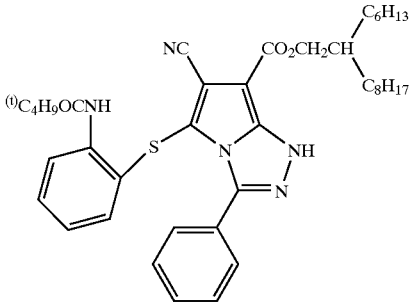

(82)

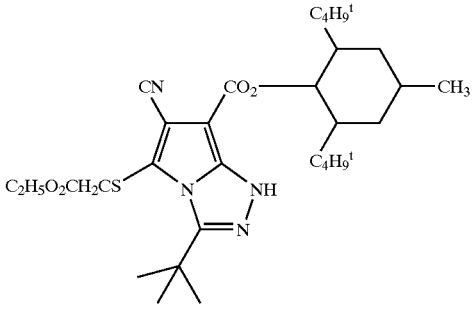

(83)

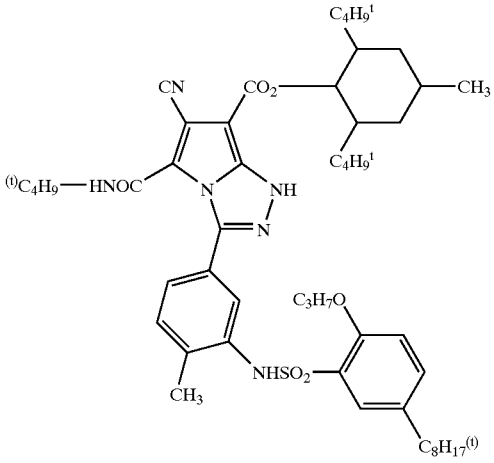

(84)

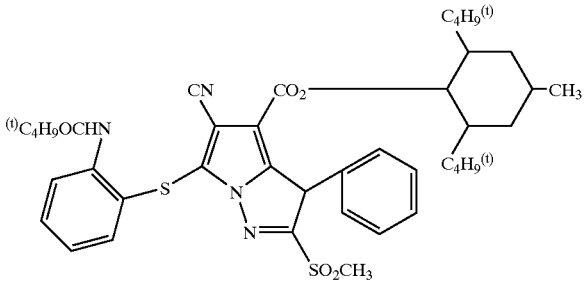

-continued (85)

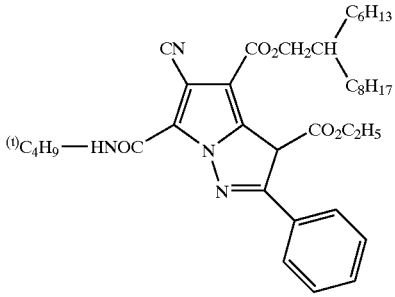

The compounds represented by the general formulae (A) and (B) according to the present invention can be easily synthesized by the synthetic methods described in, for example, JP-A's-61-65245, 61-65246, 61-147254 and 8-122984.

The color photographic lightsensitive material of the present invention comprises a support and, superimposed thereon, at least one blue-sensitive silver halide emulsion layer, green-sensitive silver halide emulsion layer, red-sensitive silver halide emulsion layer and protective layer. It is preferred that each color-sensitive layer unit be composed of two or more layers of different speeds.

Further, it is preferred that the color photographic light-sensitive material be provided with not only the lightsensitive emulsion layers and protective layer but also various nonsensitive layers, such as a color mixing prevention layer, a yellow filter layer (simultaneously functioning as a color mixing prevention layer) and an antihalation layer.

Although the order of layer arrangement is not particularly limited, as a typical example, there can be mentioned a color photographic lightsensitive material comprising, arranged in the following sequence from the position most remote from a support toward the support, a protective layer, two or more blue-sensitive emulsion layers, a yellow filter layer (simultaneously functioning as a color mixing prevention layer), two or more green-sensitive emulsion layers, a color mixing prevention layer, two or more red-sensitive emulsion layers, a color mixing prevention layer and an antihalation layer.

When each color-sensitive layer unit is composed of emulsion layers of different speeds, although the order of layer arrangement is not particularly limited, it is common practice to dispose an emulsion layer of higher speed at a position remoter from the support.

With respect to the blue-sensitive silver halide emulsion layer unit according to the present invention, when it means a unit composed of two or more blue-sensitive layers of different speeds, it is not necessary to dispose the two or more blue-sensitive layers adjacent to each other.

The green-sensitive silver halide emulsion layer unit and red-sensitive silver halide emulsion layer unit are the same as the above blue-sensitive silver halide emulsion layer unit except that the emulsion layers are sensitive to green and red, respectively.

For the purpose of sensitivity enhancement, as different from the above typical arrangement, the layer of highest speed of each of the units of different color sensitivities, namely, blue-, green- and red-sensitive emulsion layer units can be arranged on positions most remote from the support. That is, for example, there can be employed a layer arrangement comprising, disposed in the following sequence from the position most remote from a support toward the support, a protective layer, a blue-sensitive emulsion layer of highest speed, a color mixing prevention layer, a green-sensitive emulsion layer of highest speed, a color mixing prevention layer, a red-sensitive emulsion layer of highest speed, a color mixing prevention layer, two or more blue-sensitive emulsion layers, a yellow filter layer (simultaneously functioning as a color mixing prevention layer), two or more green-sensitive emulsion layers, a color mixing prevention layer, two or more red-sensitive emulsion layers, a color mixing prevention layer and an antihalation layer.

Further, for the purpose of sensitivity enhancement, the layer arrangement can be such that a highest-speed layer unit consisting of a blue-sensitive emulsion layer of highest speed (if necessary, a color mixing prevention layer), a green-sensitive emulsion layer of highest speed (if necessary, a color mixing prevention layer) and a red-sensitive emulsion layer of highest speed (if necessary, a color mixing prevention layer) is disposed as an emulsion layer most remote from the support while furthermore, one or two or more blue-sensitive emulsion layers, a color mixing prevention layer, one or two or more green-sensitive emulsion layers, a color mixing prevention layer, one or two or more red-sensitive emulsion layers, a color mixing prevention layer and an antihalation layer are disposed in this sequence toward the support.

Still further, for the purpose of sensitivity enhancement, the silver halide color photographic lightsensitive material can be appropriately provided with a light reflection layer so as to efficiently utilize light incident on the lightsensitive material. As the reflection substance contained in the light reflection layer, there can be mentioned any of microsized silver halide grains and inorganic crystals, such as those of $TiO_2$. For example, when microsized silver halide grains are used, it is preferred to set the grain thickness in conformity with given light wavelength for the purpose of attaining selective reflection of incident light wavelength.

The total amount of silver contained in the color photographic lightsensitive material of the present invention is preferably in the range of 3.0 to 8.5 g/m$^2$ in terms of coating amount.

The specific photographic speed of the color photographic lightsensitive material of the present invention, although not particularly limited, is preferably 640 or higher, more preferably 800 or higher. The use with a specific photographic speed of 1000 or higher is most preferred from the viewpoint of exertion of the effect of the present invention.

The silver halide grains of the present invention will be described at length below.

With respect to the halogen composition of the tabular grains of the present invention, the tabular grains are composed of silver halides containing silver iodide, namely, silver iodobromide or silver chloroiodobromide.

In the present invention, a tabular grain is a silver halide grain having two opposing, parallel (111) main planes. A tabular grain of the present invention has one twin plane or two or more parallel twin planes. The twin plane is a (111) plane on the two sides of which ions at all lattice points have a mirror image relationship. When this tabular grain is viewed in a direction perpendicular to the main planes of the grain, it has any of triangular, square, hexagonal, and intermediate truncated triangular shapes, each having parallel outer surfaces.

The silver halide grains not comprehended in the tabular grains include regular crystal grains and grains having two or more nonparallel twin planes. The grains having two nonparallel twin planes include those having the configuration of a triangular pyramid or a rod. These are collectively referred to as "nontabular grains".

In the measurement of the equivalent circle diameter and thickness of the tabular grains, a transmission electron micrograph according to the replica method is taken, from which the diameter of a circle having an area equal to the projected area of the parallel external surfaces of each individual grain (equivalent circle diameter) and the thickness thereof are determined. The grain thickness is calculated from the length of the shadow of the replica. With respect to the nontabular grains, the equivalent circle diameter is defined as the diameter of a circle having an area equal to the maximized projected area of each individual grain. When there is no plane parallel to a base as encountered in, for example, grains having the shape of a triangular pyramid among the nontabular grains, the thickness of the nontabular grains is defined as the distance between the base and the vortex thereof.

The nontabular grains are not favorable because the specific surface area thereof is so small that using them at a high proportion would cause a sensitivity enhancement to be difficult. A decrease of the equivalent circle diameter of tabular grains means a reduction of grain size and would render the attainment of sensitivity enhancement difficult. On the other hand, an increase of grain thickness means a decrease of specific surface area and would render the sustaining of high sensitivity/graininess ratio difficult.

In the silver halide photographic emulsion of the present invention, 50% or more of all the silver halide grains are occupied by tabular grains of 1.0 $\mu$m or greater equivalent circle diameter and 0.15 $\mu$m or less grain thickness. In the silver halide photographic emulsions of the present invention, 50% or more of all the silver halide grains are preferably occupied by tabular grains of 1.5 $\mu$m or greater equivalent circle diameter and 0.15 $\mu$m or less grain thickness, and more preferably occupied by tabular grains of 2.0 $\mu$m or greater equivalent circle diameter and 0.15 $\mu$m or less grain thickness. Further, preferably, the equivalent circle diameter is not greater than 10 $\mu$m, and the grain thickness is not less than 0.02 $\mu$m.

The silver halide emulsion of the present invention is comprised of a photosensitive silver halide emulsion wherein 50% or more of all the silver halide grains are occupied by silver halide tabular grains having the above-mentioned composition and preferred configuration and having (111) faces as the main planes, the tabular grains composed of core portions of silver iodobromide which are free of growth ring structure and have a thickness of 0.1 $\mu$m or less and shell portions having 10 or more dislocation lines at fringe areas thereof (the silver halide tabular grains hereinafter referred to as "tabular grains of the present invention").

In the tabular grains of the present invention, the silver iodide content of core portions is preferably in the range of 1 to 40 mol %, more preferably 1 to 20 mol %, and most preferably 1 to 10 mol %.

The tabular grains of the present invention are characterized in that any growth ring structure is not observed in the core portions. The growth ring structure refers to a growth ring pattern observed when tabular grains are produced by carrying out growth of silver iodobromide according to the common DJ (main plane jet) method. It is considered as a transition of twinned crystal introduced by the presence of iodide ions, and considered as providing unwanted electron traps on grain surfaces. The growth ring structure is observed as lines parallel to grain sides. The growth ring structure can be observed in the same manner as employed in the observation of dislocation lines described later.

As for the thin tabular grains like the tabular grains of the present invention, because of the large surface area, the above transition of twinned crystal has caused serious inefficiency.

The tabular grains free of the above growth ring structure can be obtained by carrying out the grain growth according to the fine grain addition growth method in place of the common DJ method. With respect to this fine grain addition growth method, reference can be made to, for example, JP-A-10-43570.

The tabular grains of the present invention have a grain thickness of 0.15 μm or less and have 10 or more dislocation lines. The inventors have found that reducing of the thickness of core portions is preferred for enhancing the sensitivity of these grains. Reducing of the thickness of core portions, providing that the grain thickness is constant, leads to increase of the shell thickness. Since the occurrence of dislocation lines is high in shell portions, an increase of the shell portion thickness would increase the occurrence of long dislocation lines. Although increasing of the number of dislocation lines is difficult in thin grains, this disadvantage would be compensated for by increasing the length of dislocation lines. The thickness of the core portions of the tabular grains of the present invention is 0.1 μm or less, preferably 0.09 μm or less, and more preferably 0.08 μm or less.

The core portions and the shell portions can be distinguished from each other by observing an extremely thin cross section of tabular grains, the cross section perpendicular to the main planes of the tabular grains, through a transmission electron microscope, and hence the core portion thickness can be measured. The extremely thin cross section can be obtained by first applying a silver halide photographic emulsion onto a support so as to produce a specimen comprising tabular grains arranged on the support in substantially parallel relationship to the support and thereafter cutting the specimen to a thickness of about 0.06 μm by means of a diamond knife.

When an extremely thin section of tabular grains having dislocation lines introduced in the fringe portions is observed through a transmission electron microscope, generally four contrast straight lines parallel to the main planes are observed. These are classified into two lines close to the grain surface and two inner lines.

The two inner lines are attributed to twin planes. Most of the tabular grains contain two twin planes, so that the two lines corresponding thereto are observed. In such rare cases that there are three twin planes, three lines corresponding thereto are observed. In these cases, five lines are observed on the extremely thin section of tabular grains.

The two lines close to the main planes are attributed to the step of epitaxial growth of silver halide on fringe portions at the time of dislocation introduction. The silver halides for use in the epitaxial growth have a silver iodide content higher than that of the core grains and are grown under such conditions that deposition occurs mainly on the fringe portions. Under such conditions as well, however, a small amount of phase with high silver iodide content is also formed on the main plane portions. This phase with high silver iodide content, because of the halogen composition difference from that of the surrounding portions, is observed as straight lines. That is, on the basis of these two lines as a border, the grain inner portions and the grain surface-side portions can be identified as the core portions and the shell portions, respectively.

In the present invention, tabular grains have dislocation lines. Dislocation lines in tabular grains can be observed by a direct method performed using a transmission electron microscope at a low temperature, as described in, e.g., J. F. Hamilton, Phot. Sci. Eng., 11, 57, (1967) or T. Shiozawa, J. Soc. Phot. Sci. Japan, 3, 5, 213, (1972). That is, silver halide grains, carefully extracted from an emulsion so as not to apply any pressure by which dislocations are produced in the grains, are placed on a mesh for electron microscopic observation. Observation is performed by a transmission method while the sample is cooled to prevent damage (e.g., print out) due to electron rays. In this observation, as the thickness of a grain is increased, it becomes more difficult to transmit electron rays through it. Therefore, grains can be observed more clearly by using an electron microscope of a high voltage type (200 kV or more for a grain having a thickness of 0.25 μm). From photographs of grains obtained by the above method, it is possible to obtain the positions and the number of dislocations in each grain viewed in a direction perpendicular to the principal planes of the grain.

50% or more in number of all the silver halide grains contained in the silver halide emulsion of the present invention are occupied by tabular grains having dislocation lines of 10 or more, preferably 20 or more, and most preferably 30 or more. If dislocation lines are densely present or cross each other, it is sometimes impossible to correctly count dislocation lines per grain. Even in these situations, however, dislocation lines can be roughly counted to such an extent that their number is approximately 10, 20, or 30. This makes it possible to distinguish these grains from those in which obviously only a few dislocation lines are present. The average number of dislocation lines per grain is obtained as a number average by counting dislocation lines of 100 or more grains. Several hundreds of dislocation lines are sometimes found.

Dislocation lines can be introduced in, for example, the vicinity of the periphery of tabular grains. In this instance, the dislocation lines are nearly perpendicular to the periphery, and each dislocation line extends from a position corresponding to x % of the distance from the center of tabular grains to the side (periphery) to the periphery. The value of x preferably ranges from 10 to less than 100, more preferably from 30 to less than 99, and most preferably from 50 to less than 98. In this instance, the figure created by binding the positions from which the dislocation lines start is nearly similar to the configuration of the grain. The created figure may be one which is not a complete similar figure but deviated. The dislocation lines of this type are not observed around the center of the grains. The dislocation lines are crystallographically oriented approximately in the (211) direction. However, the dislocation lines often meander and may also cross each other.

Dislocation lines may be positioned either nearly uniformly over the entire zone of the periphery of the tabular grains or on local points of the periphery. That is, referring to, for example, hexagonal tabular silver halide grains, dislocation lines may be localized either only in the vicinity of six vertexes or only in the vicinity of one of the vertexes. Contrarily, dislocation lines may be localized only in the sides excluding the vicinity of six vertexes.

Furthermore, dislocation lines may be formed over regions including the centers of two mutually parallel main planes of tabular grains. In the case where dislocation lines are formed over the entire regions of the main planes, the dislocation lines may crystallographically be oriented approximately in the (211) direction when viewed in the direction perpendicular to the main planes, but the formation of the dislocation lines may be effected either in the (110) direction or randomly. Further, the length of each of the dislocation lines may be random, and the dislocation lines may be observed as short lines on the main planes or as long lines extending to the side (periphery). The dislocation lines may be straight or often meander. In many instances, the dislocation lines cross each other.

The position of dislocation lines may be limited to the periphery, main planes or local points as mentioned above, or the formation of dislocation lines may be effected on a combination thereof. That is, dislocation lines may be concurrently present on both the periphery and the main planes.

The introduction of dislocation lines in the tabular grains can be accomplished by disposing a specified phase of high silver iodide content within the grains. In the dislocation line introduction, the phase of high silver iodide content may be provided with discontinuous regions of high silver iodide content. Practically, the phase of high silver iodide content within the grains can be obtained by first preparing base grains (core portions), then providing them with a phase of high silver iodide content and thereafter covering the outside thereof with a phase of silver iodide content lower than that of the phase of high silver iodide content. The silver iodide content of tabular grains as core portions is lower than that of the phase of high silver iodide content, and is preferably 0 to 20 mol %, more preferably 0 to 15 mol %.

The terminology "phase of high silver iodide content within the grains" refers to a silver halide solid solution containing silver iodide. The silver halide of this solid solution is preferably silver iodide, silver iodobromide or silver chloroiodobromide, more preferably silver iodide or silver iodobromide (the silver iodide content is in the range of 10 to 40 mol % based on the silver halides contained in the phase of high silver iodide content). For selectively causing the phase of high silver iodide content within the grains (hereinafter referred to as "internal high silver iodide phase") to be present on any of the sides, corners and planes of the base grains, it is desirable to control forming conditions for the base grains, forming conditions for the internal high silver iodide phase and forming conditions for the phase covering the outside thereof.

Important factors as the formation conditions of a substrate grain are the pAg (the logarithm of the reciprocal of a silver ion concentration), the presence/absence, type, and amount of a silver halide solvent, and the temperature. By controlling the pAg to preferably 8.5 or less, more preferably, 8 or less during the growth of substrate grains, the internal silver iodide rich phase can be made to selectively exist in portions near the corners or on the surface of the substrate grain, when this silver iodide rich phase is formed later.

On the other hand, by controlling the pAg to preferably 8.5 or more, more preferably, 9 or more during the growth of substrate grains, the internal silver iodide rich phase can be made to exist on the edges of the substrate grain.

The threshold value of the pAg rises and falls depending on the temperature and the presence/absence, type, and amount of a silver halide solvent. When thiocyanate is used as the silver halide solvent, this threshold value of the pAg shifts to higher values. The value of the pAg at the end of the growth of substrate grains is particularly important, among other pAg values during the growth. On the other hand, even if the pAg during the growth does not meet the above value, the position of the internal silver iodide rich phase can be controlled by performing ripening by controlling the pAg to the above proper value after the growth of substrate grains. In this case, ammonia, an amine compound, a thiourea derivative, or thiocyanate salt can be effectively used as the silver halide solvent. The internal silver iodide rich phase can be formed by a so-called conversion method.

This method includes a method which, at a certain point during grain formation, adds halogen ion smaller in solubility for salt for forming silver ion than halogen ion that forms grains or portions near the surfaces of grains at that point. In the present invention, the amount of halogen ion having a smaller solubility to be added preferably takes a certain value (related to a halogen composition) with respect to the surface area of grains at that point. For example, at a given point during grain formation, it is preferable to add a certain amount or more of KI with respect to the surface area of silver halide grains at that point. More specifically, it is preferable to add $8.2\times10^{-5}$ mol/m$^2$ or more of iodide salt.

A more preferable method of forming the internal silver iodide rich phase is to add an aqueous silver salt solution simultaneously with addition of an aqueous silver halide solution containing iodide salt.

As an example, an aqueous $AgNO_3$ solution is added simultaneously with addition of an aqueous KI solution by the main plane-jet method. In this case, the addition start timings and the addition end timings of the aqueous KI solution and the aqueous $AgNO_3$ solution can be shifted from each other. The addition molar ratio of the aqueous $AgNO_3$ solution to the aqueous KI solution is preferably 0.1 or more, more preferably, 0.5 or more, and most preferably, 1 or more. The total addition molar quantity of the aqueous $AgNO_3$ solution can exit in a silver excess region with respect to halogen ion in the system and iodine ion added. During the addition of the aqueous silver halide solution containing iodine ion and the addition of the aqueous silver salt solution by the main plane-jet method, the pAg preferably decreases with the addition time by the main plane-jet. The pAg before the addition is preferably 6.5 to 13, and more preferably, 7.0 to 11. The pAg at the end of the addition is most preferably 6.5 to 10.0.

In carrying out the above method, the solubility of a silver halide in the mixing system is preferably as low as possible. Therefore, the temperature of the mixing system at which the silver iodide rich phase is formed is preferably 30° C. to 80° C., and more preferably, 30° C. to 70° C.

The formation of the internal silver iodide rich phase is most preferably performed by adding fine-grain silver iodide, fine-grain silver iodobromide, fine-grain silver chloroiodide, or fine-grain silver bromochloroiodide. The addition of fine-grain silver iodide is particularly preferred. These fine grains normally have a grain size of 0.01 to 0.1 μm, but those having a grain size of 0.01 μm or less or 0.1 μm or more can also be used. Methods of preparing these fine silver halide grains are described in JP-A's-1-183417, 2-44335, 1-183644, 1-183645, 2-43534, and 2-43535, the disclosures of which are incorporated herein by reference. The internal silver iodide rich phase can be formed by adding and ripening these fine silver halide grains. In dissolving the fine grains by ripening, the silver halide solvent described above can also be used. These fine grains added need not immediately, completely dissolve to disappear but need only disappear by dissolution when the final grains are completed.

The internal silver iodide rich phase is located in a region of, when measuring from the center of, e.g., a hexagon formed in a plane by projecting a grain thereon, preferably 5 to less than 100 mol %, more preferably, 20 to less than 95 mol %, and most preferably, 50 to less than 90 mol % with respect to the total silver amount of the grain. The amount of a silver halide which forms the internal silver iodide rich phase is, as a silver amount, preferably 50 mol % or less, and more preferably, 20 mol % or less of the total silver amount of a grain. These values of amounts of the silver iodide rich phase are not those obtained by measuring the halogen composition of the final grain by using various analytical methods but formulated values in the producing of a silver halide emulsion. The internal silver iodide rich phase often disappears from the final grain owing to, e.g., recrystallization, and so all silver amounts described above are related to their formulated values.

It is, therefore, readily possible to observe dislocation lines in the final grains by the above method, but the internal silver iodide rich phase introduced to introduce dislocation lines cannot be observed as a definite phase in many cases because the silver iodide composition in the boundary continuously changes. The halogen compositions in each portion of a grain can be checked by combining X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain).

The silver iodide content of an outer phase covering the internal silver iodide rich phase is lower than that of the silver iodide rich phase, and is preferably 0 to 30 mol %, more preferably, 0 to 20 mol %, and most preferably, 0 to 10 mol % with respect to a silver halide amount contained in the outer phase.

Although the temperature and the pAg, at which the outer phase covering the internal silver iodide rich phase is formed, can take arbitrary values, the temperature is preferably 30° C. to 80° C., and most preferably, 35° C. to 70° C., and the pAg is preferably 6.5 to 11.5. The use of the silver halide solvents described above is sometimes preferable, and the most preferable silver halide solvent is thiocyanate salt.

Another method of introducing dislocation lines to tabular grains is to use an iodide ion releasing agent as described in JP-A-6-11782, the disclosure of which is incorporated herein by reference. This method is also preferably used.

Dislocation lines can also be introduced by appropriately combining this dislocation line introducing method with the above-mentioned dislocation line introducing method.

In the chemical sensitization of silver halide grains, nonuniformity between grains in, for example, the size thereof would cause attaining the optimum sensitization of the individual grains to be difficult, thereby inviting a deterioration of photographic sensitivity. From this viewpoint, it is preferred that the equivalent circle diameter and thickness of silver halide tabular grains according to the present invention be monodisperse. With respect to all the silver halide grains of the present invention, the variation coefficient of equivalent circle diameter is preferably 40% or less, more preferably 30% or less, and even more preferably 20% or less. With respect to all the silver halide grains, the variation coefficient of thickness is preferably 20% or less. The terminology "variation coefficient of equivalent circle diameter" used herein means the value obtained by dividing a standard deviation of equivalent circle diameters of individual silver halide grains by an average equivalent circle diameter and by multiplying the quotient by 100. On the other hand, the terminology "variation coefficient of thickness" used herein means the value obtained by dividing a standard deviation of thicknesses of individual silver halide grains by an average thickness and by multiplying the quotient by 100.

The twin plane spacing of the tabular grains is preferably 0.014 μm or less, more preferably 0.012 μm or less. In the formation of fringe dislocation type grains, uniformity of the side faces of tabular grains is important because it influences the uniformity of fringe dislocation between individual grains. From this viewpoint, with respect to the twin plane spacing, it is preferred that the variation coefficient of twin plane spacing of tabular grains be 40% or less, especially 30% or less. The terminology "fringe dislocation type grains" used herein means grains having dislocation lines at fringe portions thereof upon viewing the tabular grains from the main plane side thereof.

The tabular grains having (111) faces as main planes generally have the shape of a hexagon, a triangle or an intermediate triangle with angle portions cut off, and have three-fold symmetry. With respect to the six sides, the ratio of the length of three relatively long sides to that of three relatively short sides is referred to as the ratio of long side/short side. The triangle with angle portions cut off refers to the shape resulting from cutting off of angle portions of a triangle. In the formation of fringe dislocation type grains, it has been observed that the density of dislocation lines at the fringe portions is lower in the grains having the shape close to a triangle than in the grains having the shape close to a hexagon. It is preferred that the ratio of long side/short side of tabular grains be close to 1. The average of the ratio of long side/short side of tabular grains is preferably 1.6 or less, more preferably 1.3 or less.

The tabular grains for use in the present invention are formed through the steps of nucleation, Ostwald ripening and growth. Although all of these steps are important for suppressing the spread of grain size distribution, attention should be paid so as to prevent the spread of size distribution at the first nucleation step because it is difficult to narrow the spread of size distribution brought about in a previous step by an ensuing step. What is important in the nucleation step is the relationship between the temperature of reaction mixture and the period of nucleation comprising adding silver ions and bromide ions to a reaction mixture according to the main plane jet technique and producing precipitates. JP-A-63-92942 by Saito describes that it is preferred that the temperature of the reaction mixture at the time of nucleation be in the range of from 20 to 45° C. for realizing a monodispersity enhancement. Further, JP-A-2-222940 by Zola et al describes that the suitable temperature at nucleation is 60° C. or below.

Supplemental addition of gelatin may be effected during the grain formation in order to obtain thin grain thickness, monodisperse tabular grains. The added gelatin is preferably a chemically modified gelatin as described in JP-A's-10-148897 and 11-143002. This chemically modified gelatin is a gelatin characterized in that at least two carboxyl groups have newly been introduced at a chemical modification of amino groups contained in the gelatin, and it is preferred that gelatin trimellitate be used as the same. Also, gelatin succinate is preferably used. The chemically modified gelatin is preferably added prior to the growth step, more preferably immediately after the nucleation. The addition amount thereof is preferably 60% or greater, more preferably 80% or greater, and most preferably 90% or greater, based on the total mass of dispersion medium used in grain formation.

Although the composition of the tabular grain used in the present invention is not limited, it is preferably silver iodobromide or silver chloroiodobromide.

The silver chloride content is preferably 8 mol % or less, more preferably 3 mol % or less, and most preferably 0 mol %. With respect to the silver iodide content, it is preferably 20 mol % or less inasmuch as the variation coefficient of the grain size distribution of the tabular grain emulsion is preferably 30% or less. The lowering of the variation coefficient of the distribution of equivalent circle diameter of the tabular grain emulsion can be facilitated by decreasing the silver iodide content.

It is especially preferred that the variation coefficient of the grain size distribution of the tabular grain emulsion be 20% or less while the silver iodide content be 10 mol % or less.

Furthermore, it is preferred that the tabular grains have some intragranular structure with respect to the silver iodide distribution. The silver iodide distribution may have a main plane structure, a treble structure, a quadruple structure or a structure of higher order.

The variation coefficient of the inter-grain silver iodide content distribution of silver halide grains used in the present invention is preferably 20% or less, more preferably, 15% or less, and most preferably, 10% or less. If the variation coefficient of the silver iodide content is larger than 20%, no high contrast can be obtained in the photographic properties, and a reduction of the sensitivity upon application of a pressure increases.

Any known method can be used as a method of producing silver halide grains having a narrow inter-grain silver iodide content distribution. Examples are a method of adding fine grains as disclosed in JP-A-1-183417 and a method which uses an iodide ion releasing agent as disclosed in JP-A-2-68538, the disclosures of which are incorporated herein by reference. These methods can be used alone or in combination.

The silver iodide content of each grain can be measured by analyzing the composition of the grain by using an X-ray microanalyzer. The variation coefficient of an inter-grain silver iodide content distribution is a value defined by (standard deviation/average silver iodide content)×100= variation coefficient (%) by using the standard deviation of silver iodide contents and the average silver iodide content when the silver iodide contents of at least 100, more preferably, 200, and most preferably, 300 emulsion grains are measured. The measurement of the silver iodide content of each individual grain is described in, e.g., European Patent 147,868. A silver iodide content Yi [mol %] and an equivalent-sphere diameter Xi [$\mu$m] of each grain sometimes have a correlation and sometimes do not. However, Yi and Xi desirably have no correlation. The halogen composition structure of a tabular grain of the present invention can be checked by combining, e.g., X-ray diffraction, an EPMA (also called an XMA) method (a method of scanning a silver halide grain by electron rays to detect its silver halide composition), and an ESCA (also called an XPS) method (a method of radiating X-rays to spectroscopically detect photoelectrons emitted from the surface of a grain). When the silver iodide content is measured in the present invention, the grain surface is a region about 5 nm deep from the surface, and the grain interior is a region except for the surface. The halogen composition of this grain surface can usually be measured by the ESCA method.

Silver halide emulsions of the present invention can also be subjected to reduction sensitization during grain formation, after grain formation and before or during chemical sensitization, or after chemical sensitization.

Reduction sensitization can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be used together.

The method of adding reduction sensitizers is preferred in that the level of reduction sensitization can be finely adjusted.

Known examples of reduction sensitizers are stannous salt, ascorbic acid and its derivative, amines and polyamines, a hydrazine derivative, formamidinesulfinic acid, a silane compound, and a borane compound. In reduction sensitization of the present invention, it is possible to selectively use these known reduction sensitizers or to use two or more types of compounds together. Preferred compounds as reduction sensitizers are stannous chloride, thiourea dioxide, dimethylamineborane, and ascorbic acid and its derivative. Although the addition amount of reduction sensitizers must be so selected as to meet the emulsion producing conditions, a preferable amount is $10^{-7}$ to $10^{-3}$ mol per mol of a silver halide.

Reduction sensitizers are dissolved in water or an organic solvent such as alcohols, glycols, ketones, esters, or amides, and the resultant solution is added during grain growth. Although adding to a reactor vessel in advance is also preferred, adding at a given timing during grain growth is more preferred. It is also possible to add reduction sensitizers to an aqueous solution of a water-soluble silver salt or of a water-soluble alkali halide to precipitate silver halide grains by using this aqueous solution. Alternatively, a solution of reduction sensitizers can be added separately several times or continuously over a long time period with grain growth.

It is preferable to use an oxidizer for silver during the process of producing emulsions of the present invention. An oxidizer for silver is a compound having an effect of converting metal silver into silver ion. A particularly effective compound is the one that converts very fine silver grains, formed as a by-product in the process of formation and chemical sensitization of silver halide grains, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of an inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of an organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are inorganic oxidizers such as ozone, hydrogen peroxide and its adduct, a halogen element, and thiosulfonate, and organic oxidizers such as quinones.

It is preferable to use the reduction sensitization described above and the oxidizer for silver together. In this case, the reduction sensitization can be performed after the oxidizer is used or vice versa, or the oxidizer can be used simultaneously with the reduction sensitization. These methods can be applied to both the grain formation step and the chemical sensitization step.

Metal complexes can be added to the silver halide emulsion of the present invention during grain formation, after grain formation and before or during chemical sensitization. Also, metal complexes can be divisionally added a plurality of times. However, 50% or more of the total content of metal complexes contained in a silver halide grain are preferably contained in a layer ½ or less as a silver amount from the outermost surface of the grain. A layer not containing metal complexes can also be formed on the outside, i.e., on the side away from a support, of the layer containing metal complexes herein mentioned.

These metal complexes are preferably contained by dissolving them in water or an appropriate solvent and directly adding the solution to a reaction solution during the formation of silver halide grains, or by forming silver halide grains by adding them to an aqueous silver salt solution, aqueous silver salt solution, or some other solution for forming the grains. Alternatively, these metal complexes are also favorably contained by adding and dissolving fine silver halide grains previously made to contain the metal complexes, and depositing these grains on other silver halide grains.

When these metal complexes are to be added, the hydrogen ion concentration in a reaction solution is such that the pH is preferably 1 to 10, and more preferably, 3 to 7.

Silver halide emulsions of the present invention are preferably subjected to selenium sensitization.

As selenium sensitizers usable in the present invention, selenium compounds disclosed in conventionally known patents can be used. Usually, a labile selenium compound and/or a non-labile selenium compound is used by adding it to an emulsion and stirring the emulsion at a high temperature, preferably 40° C. or more for a predetermined period of time. As non-labile selenium compounds, it is preferable to use compounds described in, e.g., Jpn. Pat. Appln. KOKOKU Publication No. (hereinafter referred to as JP-B-)44-15748, JP-B-43-13489, and JP-A's-4-25832 and 4-109240, the disclosures of which are incorporated herein by reference.

The non-labile selenium sensitizer refers to the sensitizer which causes the amount of silver selenide formed upon the addition of non-labile selenium sensitizer only without the use of any nucleophilic agent to be 30% or less based on the amount of added non-labile selenium sensitizer. As the non-labile selenium sensitizer, there can be mentioned compounds described in, for example, JP-B's-46-4553, 52-34492 and 52-34491. When the non-labile selenium sensitizer is used, it is preferred to simultaneously use a nucleophilic agent. As the nucleophilic agent, there can be mentioned compounds described in, for example, JP-A-9-15776.

Selenium sensitization can be achieved more effectively in the presence of a silver halide solvent.

Examples of a silver halide solvent usable in the present invention are (a) organic thioethers described in, e.g., U.S. Pat. Nos. 3,271,157, 3,531,289, and 3,574,628, and JP-A's-54-1019 and 54-158917, the disclosures of which are incorporated herein by reference, (b) thiourea derivatives described in, e.g., JP-A's-53-82408, 55-77737, and 55-2982, the disclosures of which are incorporated herein by reference, (c) a silver halide solvent having a thiocarbonyl group sandwiched between an oxygen or sulfur atom and a nitrogen atom, described in, e.g., JP-A-53-144319, the disclosure of which is incorporated herein by reference, (d) imidazoles described in, e.g., JP-A-54-100717, the disclosure of which is incorporated herein by reference, (e) sulfite, and (f) thiocyanate.

Most preferred examples of a silver halide solvent are thiocyanate and tetramethylthiourea. Although the amount of a solvent to be used changes in accordance with its type, a preferred amount is, for example, $1\times10^{-4}$ to $1\times10^{-2}$ mol per mol of a silver halide.

A gold sensitizer for use in gold sensitization of the present invention can be any compound having an oxidation number of gold of +1 or +3, and it is possible to use gold compounds normally used as gold sensitizers. Representative examples are chloroaurate, potassium chloroaurate, auricrichloride, potassium auricthiocyanate, potassium iodoaurate, tetracyanoauric acid, ammonium aurothiocyanate, pyridyltrichloro gold, gold sulfide, and gold selenide. Although the addition amount of gold sensitizers changes in accordance with various conditions, the amount is preferably $1\times10^{-7}$ to $5\times10^{-5}$ mol per mol of a silver halide.

Emulsions of the present invention are preferably subjected to sulfur sensitization during chemical sensitization.

This sulfur sensitization is commonly performed by adding sulfur sensitizers and stirring the emulsion for a predetermined time at a high temperature, preferably 40° C. or more.

Sulfur sensitizers known to those skilled in the art can be used in sulfur sensitization. Examples are thiosulfate, allylthiocarbamidothiourea, allylisothiacyanate, cystine, p-toluenethiosulfonate, and rhodanine. It is also possible to use sulfur sensitizers described in, e.g., U.S. Pat. Nos. 1,574,944, 2,410,689, 2,278,947, 2,728,668, 3,501,313, and 3,656,955, German Patent 1,422,869, JP-B-56-24937, and JP-A-55-45016, the disclosures of which are incorporated herein by reference. The addition amount of sulfur sensitizers need only be large enough to effectively increase the sensitivity of an emulsion. This amount changes over a wide range in accordance with various conditions, such as the pH, the temperature, and the size of silver halide grains. However, the amount is preferably $1\times10^{-7}$ to $5\times10^{-5}$ mol per mol of a silver halide.

The photographic emulsion of the present invention is preferably subjected to a spectral sensitization with at least one methine dye or the like, from the viewpoint that the effects desired in the present invention can be exerted. Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be contained in these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have at least one substituent on carbon atoms thereof.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, and GB 1,344,281 and 1,507,803, JP-B's-43-4936 and 53-12375 and JP-A's-52-110618 and 52-109925.

The emulsion of the present invention may be doped with a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and before the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization as described in JP-A-58-113928, and also, the spectral sensitizing dye can be added prior to the completion of silver halide grain precipitation to thereby initiate the spectral sensitization. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains, such as the method disclosed in U.S. Pat. No. 4,183,756 and other methods.

The addition amount of sensitizing dyes can be $4\times10^{-6}$ to $8\times10^{-3}$ mol per mol of a silver halide. For a silver halide grain size of average equivalent-sphere diameter 0.2 to 1.2 $\mu$m, an addition amount of about $5\times10^{-5}$ to $2\times10^{-3}$ mol is more effective.

Fog occurring while a silver halide emulsion of the present invention is aged can be improved by adding and dissolving a previously prepared silver iodobromide emulsion during chemical sensitization. This silver iodobromide emulsion can be added at any timing during chemical sensitization. However, it is preferable to first add and dissolve the silver iodobromide emulsion and then add sensitizing dyes and chemical sensitizers in this order. The silver iodobromide emulsion used has an silver iodide content lower than the surface silver iodide content of a host grain, and is preferably a pure silver bromide emulsion. The size of this silver iodobromide emulsion is not limited as long as the emulsion can be completely dissolved. However, the equivalent-sphere diameter is preferably 0.1 $\mu$m or less, and more preferably, 0.05 $\mu$m or less. Although the addition amount of the silver iodobromide emulsion changes in accordance with a host grain used, the amount is basically preferably 0.005 to 5 mol %, and more preferably, 0.1 to 1 mol % per mol of silver.

In order to upgrade the color reproduction, a donor layer (CL) of interlayer effect having a spectral sensitivity distribution different from those of main lightsensitive layers BL, GL and RL as described in U.S. Pat. Nos. 4,663,271, 4,705,744 and 4,707,436 and JP-A's-62-160448 and 63-89850 is preferably arranged adjacent to or close to the main lightsensitive layers.

The silver halide color photographic lightsensitive material of the present invention has a protective layer. The protective layer refers to a layer superimposed on a lightsensitive layer most remote from the support on a surface side of the lightsensitive layer. JP-A-5-34857 describes that the sharpness can be upgraded by reducing the thickness of the protective layer and that tabular grains can be preferably used because of the less degree of light scattering.

However, as a result of investigations, it has become apparent that when use is made of tabular grains whose thickness is as small as 0.15 $\mu$m or less, the light scattering by the tabular grains rather tends to increase. Although it is considered that simultaneous use of the protective layer and the tabular grains is not favorable in such a case from the viewpoint of sharpness, it has been found that when use is made of the tabular grains of the present invention, high sensitivity can be attained with lowering of sharpness suppressed by combination thereof with a thin protective layer. In the silver halide color photographic lightsensitive material of the present invention, the thickness of the protective layer is preferably 3 $\mu$m or less, more preferably in the range of 2 to 0.5 $\mu$m. When the protective layer consists of two or more layers, the thickness of protective layer refers to the sum of layer thicknesses.

The thickness of films including the protective layer is measured in the following manner. Specimen is conditioned in a relative humidity of 55% at 25° C. for 2 days, and the thickness thereof is measured by means of commercially available contact type film thickness meter (K-402 BSTAND manufactured by Anritsu Electric Co., Ltd.). The total thickness of all the hydrophilic colloid layers disposed on the emulsion layer side is calculated as a difference between the thickness of sample and that of sample from which the coating layers on the support have been removed. The thickness of each of the layers of a multilayer silver halide color lightsensitive material can be measured by taking a magnified photograph of a section thereof by means of a scanning electron microscope. In the measurement by means of a scanning electron microscope, the specimen must generally be measured in vacuum to thereby disenable maintaining the state of conditioned specimen, so that loss of water and substances of relatively low boiling point from the specimen may result in inaccurate thickness measuring. Therefore, specimen forming methods, such as freeze dry, are being tested, but none of them is satisfactory. The measuring by photographing of a section with the use of a scanning electron microscope is utilized as measuring means for calculating the thickness of each layer of dry sample on the basis of the total film thickness measured with the use of a contact type film thickness meter.

In the present invention, a non-light-sensitive fine-grain silver halide is preferably used. The non-light-sensitive fine-grain silver halide preferably consists of silver halide grains which are not exposed during imagewise exposure for obtaining a dye image and are not substantially developed during development. These silver halide grains are preferably not fogged in advance. In the non-light-sensitive fine-grain silver halide, the content of silver bromide is 0 to 100 mol %, and silver chloride and/or silver iodide can be added if necessary. The non-light-sensitive fine-grain silver halide preferably contains 0.5 to 10 mol % of silver iodide. The average grain size (the average value of equivalent-circle diameters of projected areas) of the fine-grain silver halide is preferably 0.01 to 0.5 μm, and more preferably, 0.02 to 2 μm.

The non-light-sensitive fine-grain silver halide can be prepared following the same procedures as for a common light-sensitive silver halide. The surface of the non-light-sensitive fine-grain silver halide need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine-grain silver halide grain-containing layer.

The present invention can be applied to not only black-and-white printing paper, black-and-white negative film and X-ray film but also various color lightsensitive materials such as color negative film for general purposes or cinema, color reversal film for slide or TV, color paper, color positive film and color reversal paper. Moreover, the present invention is suitable to lens equipped film units described in JP-B-2-32615 and Jpn. Utility Model Appln. KOKOKU Publication No. 3-39784.

Supports which can be appropriately used in the present invention are described in, e.g., the aforementioned RD. No. 17643, page 28; RD. No. 18716, from the right column of page 647 to the left column of page 648; and RD. No. 307105, page 879.

In the lightsensitive material of the present invention, hydrophilic colloid layers (referred to as "back layers") having a total dry film thickness of 2 to 20 μm are preferably provided on the side opposite to the side having emulsion layers. These back layers preferably contain the aforementioned light absorbent, filter dye, ultraviolet absorbent, antistatic agent, film hardener, binder, plasticizer, lubricant, coating aid and surfactant. The swelling ratio of these back layers is preferably in the range of 150 to 500%.

The lightsensitive material according to the present invention can be developed by conventional methods described in the aforementioned RD. No. 17643, pages 28 and 29; RD. No. 18716, page 651, left to right columns; and RD No. 307105, pages 880 and 881.

The color negative film processing solution for use in the present invention will be described below.

The compounds listed in page 9, right upper column, line 1 to page 11, left lower column, line 4 of JP-A-4-121739 can be used in the color developing solution for use in the present invention. Preferred color developing agents for use in especially rapid processing are 2-methyl-4-[N-ethyl-N-(2-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline.

These color developing agents are preferably used in an amount of 0.01 to 0.08 mol, more preferably 0.015 to 0.06 mol, and most preferably 0.02 to 0.05 mol per liter (hereinafter also referred to as "L") of the color developing solution. The replenisher of the color developing solution preferably contains the color developing agent in an amount corresponding to 1.1 to 3 times the above concentration, more preferably 1.3 to 2.5 times the above concentration.

Hydroxylamine can widely be used as a preservative of the color developing solution. When enhanced preserving properties are required, it is preferred to use hydroxylamine derivatives having substituents such as alkyl, hydroxyalkyl, sulfoalkyl and carboxyalkyl groups. Preferred examples thereof include N,N-di(sulfoehtyl)hydroxylamine, monomethylhydroxylamine, dimethylhydroxylamine, monoethylhydroxylamine, diethylhydroxylamine and N,N-di(carboxyethyl)hydroxylamine. Of these, N,N-di(sulfoehtyl)hydroxylamine is most preferred. Although these may be used in combination with hydroxylamine, it is preferred that one or two or more members thereof be used in place of hydroxylamine.

These preservatives are preferably used in an amount of 0.02 to 0.2 mol, more preferably 0.03 to 0.15 mol, and most preferably 0.04 to 0.1 mol per L of the color developing solution. The replenisher of the color developing solution preferably contains the preservatives in an amount corresponding to 1.1 to 3 times the concentration of the mother liquor (processing tank solution) as in the color developing agent.

Sulfurous salts are used as tarring preventives for the color developing agent oxidation products in the color developing solution. Sulfurous salts are preferably used in the color developing solution in an amount of 0.01 to 0.05 mol, more preferably 0.02 to 0.04 mol per L. In the replenisher, sulfurous salts are preferably used in an amount corresponding to 1.1 to 3 times the above concentration.

The pH value of the color developing solution preferably ranges from 9.8 to 11.0, more preferably from 10.0 to 10.5. The pH of the replenisher is preferably set for a value 0.1 to 1.0 higher than the above value. Common buffers, such as carbonic acid salts, phosphoric acid salts, sulfosalicylic acid salts and boric acid salts, are used for stabilizing the above pH value.

Although the amount of the replenisher of the color developing solution preferably ranges from 80 to 1300 mL per $m^2$ of the lightsensitive material, the employment of smaller amount is desirable from the viewpoint of reduction of environmental pollution load. Specifically, the amount of the replenisher more preferably ranges from 80 to 600 mL, most preferably from 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C represented by formula below takes a negative value, however, no bromide ions are preferably added to a replenisher.

$$C=A-W/V$$

where

C: the bromide ion concentration (mol/L) in a color developer replenisher

A: the target bromide ion concentration (mol/L) in a color developer

W: the amount (mol) of bromide ions dissolving into the color developer from 1 $m^2$ of a light-sensitive material when the sensitive material is color-developed V: the replenishment rate (L) of the color developer replenisher for 1 $m^2$ of the light-sensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Color reversal film processing solutions used in the present invention will be described below.

Processing for a color reversal film is described in detail in Aztech Ltd., Known Technology No. 6 (1991, April 1), page 1, line 5 to page 10, line 5 and page 15, line 8 to page 24, line 2, and any of the contents can be preferably applied.

Photographic additives usable in the present invention are also described in RDs, and the relevant portions are summarized in the following table.

| Additives | RD17643 | RD18716 | RD307105 |
|---|---|---|---|
| 1. Chemical sensitizers | page 23 | page 648, right column | page 866 |
| 2. Sensitivity increasing agents | | page 648, right column | |
| 3. Spectral sensitizers, super sensitizers | pages 23–24 | page 648, right column to page 649, right column | pages 866–868 |
| 4. Brighteners | page 24 | page 647, right column | page 868 |
| 5. Light absorbents, filter dyes, ultraviolet absorbents | pages 25–26 | page 649, right column to page 650, left column | page 873 |
| 6. Binders | page 26 | page 651, left column | pages 873–874 |
| 7. Plasticizers, lubricants | page 27 | page 650, right column | page 876 |
| 8. Coating aids, surface active agents | pages 26–27 | page 650, right column | pages 875–876 |
| 9. Antistatic agents | page 27 | page 650, right column | pages 876–877 |
| 10. Matting agents | | | pages 878–879 |

Techniques such as a layer arrangement technique, silver halide emulsions, dye forming couplers, functional couplers such as DIR couplers, various additives, and development usable in silver halide photographic light-sensitive materials are described in European Patent No. 0565096A1 (laid open in Oct. 13, 1993) and the patents cited in it, the disclosures of which are incorporated herein by reference. The individual items and the corresponding portions are enumerated below.

1. Layer arrangements: page 61, lines 23–35, page 61, line 41-page 62, line 14
2. Interlayers: page 61, lines 36–40
3. Interlayer effect donor layers: page 62, lines 15–18
4. Silver halide halogen compositions: page 62, lines 21–25
5. Silver halide grain crystal habits: page 62, lines 26–30
6. Silver halide grain size: page 62, lines 31–34
7. Emulsion preparation methods: page 62, lines 35–40
8. Silver halide grain size distribution: page 62, lines 41–42
9. Tabular grains: page 62, lines 43–46
10. Internal structures of grains: page 62, lines 47–53
11. Latent image formation types of emulsions: page 62, line 54-page 63, line 5
12. Physical ripening and chemical sensitization of emulsions: page 63, lines 6–9
13. Use of emulsion mixtures: page 63, lines 10–13
14. Fogged emulsions: page 63, lines 14–31
15. Non-light-sensitive emulsions: page 63, lines 32–43
16. Silver coating amount: page 63, lines 49–50
17. Formaldehyde scavengers: page 64, lines 54–57
18. Mercapto-based antifoggants: page 65, lines 1–2
19. Agents releasing, e.g., fogging agent: page 65, lines 3–7
20. Dyes: page 65, lines 7–10
21. General color couplers: page 65, lines 11–13
22. Yellow, magenta, and cyan couplers: page 65, lines 14–25
23. Polymer couplers: page 65, lines 26–28
24. Diffusing dye forming couplers: page 65, lines 29–31
25. Colored couplers: page 65, lines 32–38
26. General functional couplers: page 65, lines 39–44
27. Bleaching accelerator release couplers: page 65, lines 45–48
28. Development accelerator release couplers: page 65, lines 49–53
29. Other DIR couplers: page 65, line 54-page 66, line 4
30. Coupler diffusing methods: page 66, lines 5–28
31. Antiseptic agents and mildewproofing agents: page 66, lines 29–33
32. Types of light-sensitive materials: page 66, lines 34–36
33. Light-sensitive layer film thickness and swell speed: page 66, line 40-page 67, line 1
34. Back layers: page 67, lines 3–8
35. General development processing: page 67, lines 9–11
36. Developers and developing agents: page 67, lines 12–30
37. Developer additives: page 67, lines 31–44
38. Reversal processing: page 67, lines 45–56
39. Processing solution aperture ratio: page 67, line 57-page 68, line 12
40. Development time: page 68, lines 13–15
41. Bleach-fix, bleaching, and fixing: page 68, line 16-page 69, line 31
42. Automatic processor: page 69, lines 32–40
43. Washing, rinsing, and stabilization: page 69, line 41-page 70, line 18
44. Replenishment and reuse of processing solutions: page 70, lines 19–23
45. Incorporation of developing agent into light-sensitive material: page 70, lines 24–33
46. Development temperature: page 70, lines 34–38
47. Application to film with lens: page 70, lines 39–41

With respect to the technologies, such as those regarding a bleaching solution, a magnetic recording layer, a polyester support and an antistatic agent, that are applicable to the silver halide photographic lightsensitive material of the present invention and with respect to the utilization of the present invention in Advanced Photo System, etc., reference can be made to US 2002/0042030 A1 (published on Apr. 11, 2002) and patents cited therein. Individual items and the locations where they are described will be listed below.

1. Bleaching solution: page 15 [0206];
2. Magnetic recording layer and magnetic particles: page 16 [0207] to [0213];
3. Polyester support: page 16 [0214] to page 17 [0218];
4. Antistatic agent: page 17 [0219] to [0221];
5. Sliding agent: page 17 [0222];
6. Matte agent: page 17 [0224];
7. Film cartridge: page 17 [0225] to page 18 [0227];
8. Use in Advanced Photo System: page 18 [0228], and [0238] to [0240];
9. Use in lens-equipped film: page 18 [0229]; and
10. Processing by minilab system: page 18 [0230] to [0237].

EXAMPLES

The present invention will be described in detail below with reference to the following Examples which however in no way limit the scope of the invention.

Example 1

Support

A support used in this example was formed by the following method.

(i) First Layer and Undercoat Layer

Glow discharge was performed on the two surfaces of a 90-$\mu$m thick polyethylenenaphthalate support at a processing ambient pressure of 26.6 Pa, an $H_2O$ partial pressure in the ambient gas of 75%, a discharge frequency of 30 kHz, an output of 2,500 W, and a processing intensity of 0.5 kV·A·min/m$^2$. One surface (back surface) of this support was coated with 5 mL/m$^2$ of a coating solution having the following composition as a first layer by using a bar coating method described in JP-B-58-4589, the disclosure of which is incorporated herein by reference.

| | |
|---|---|
| Conductive fine-grain dispersion (a water dispersion having an $SnO_2/Sb_2O_5$ grain concentration of 10%, a secondary aggregate having a primary grain size of 0.005 $\mu$m and an average grain size of 0.05 $\mu$m) | 50 parts by weight |
| Gelatin | 0.5 parts by mass |
| Water | 49 parts by mass |
| Polyglycerolpolyglycidyl ether | 0.16 parts by mass |
| Poly(polymerization degree 20) oxyethylenesorbitanmonolaurate | 0.1 part by mass |

In addition, after the first layer was formed by coating, the support was wound on a stainless-steel core 20 cm in diameter and heated at 110° C. (Tg of PEN support: 119° C.) for 48 hr so as to be given thermal hysteresis, thereby performing annealing. After that, the side (emulsion surface side) of the support away from the first layer side was coated with 10 mL/m$^2$ of a coating solution having the following composition as an undercoat layer for emulsions, by using a bar coating method.

| | |
|---|---|
| Gelatin | 1.01 parts by mass |
| Salicylic acid | 0.30 parts by mass |
| Resorcin | 0.40 parts by mass |
| Poly(polymerization degree 10) oxyethylenenonylphenyl ether | 0.11 parts by mass |
| Water | 3.53 parts by mass |
| Methanol | 84.57 parts by mass |
| n-Propanol | 10.08 parts by mass |

Furthermore, second and third layers to be described later were formed in this order on the first layer by coating. Subsequently, the opposite side was coated with multiple layers of a color negative light-sensitive material having a composition to be described later, thereby making a transparent magnetic recording medium having silver halide emulsion layers.

(ii) Second Layer (Transparent Magnetic Recording Layer)

(1) Dispersion of Magnetic Substance 1,100 parts by mass of a Co-deposited $\gamma$-$Fe_2O_3$ magnetic substance (average long axis length: 0.25 $\mu$m, $S_{BET}$: 39 m$^2$/g, Hc: 6.56×10$^4$ A/m, σ s: 77.1 Am$^2$/kg, σ r: 37.4 Am$^2$/kg), 220 parts by mass of water, and 165 parts by mass of a silane coupling agent [3-(poly(polymerization degree 10)oxyethynyl)oxypropyl trimethoxysilane] were added and well kneaded for 3 hr by an open kneader. This coarsely dispersed viscous solution was dried at 70° C. for 24 hr to remove water and heated at 110° C. for 1 hr to form surface-treated magnetic grains.

These grains were again kneaded for 4 hr by the following formulation by using an open kneader.

| | |
|---|---|
| Above-mentioned surface-treated magnetic grains | 855 g |
| Diacetylcellulose | 25.3 g |
| Methylethyl ketone | 136.3 g |
| Cyclohexanone | 136.3 g |

The resultant material was finely dispersed at 2,000 rpm for 4 hr by the following formulation by using a sand mill (1/4 G sand mill). Glass beads 1 mm in diameter were used as media.

| | |
|---|---|
| Above-mentioned kneaded solution | 45 g |
| Diacetylcellulose | 23.7 g |
| Methylethylketone | 127.7 g |
| Cyclohexanone | 127.7 g |

Furthermore, magnetic substance-containing intermediate solution was formed by the following formulation.

(2) Formation of Magnetic Substance-Containing Intermediate Solution

| | |
|---|---|
| Above-mentioned magnetic substance finely dispersed solution | 674 g |
| Diacetylcellulose solution (solid content 4.34%, solvent: methylethylketone/cyclohexanone = 1/1) | 24,280 g |
| Cyclohexanone | 46 g |

These materials were mixed, and the mixture was stirred by a disperser to form a "magnetic substance-containing intermediate solution".

An α-alumina polishing material dispersion of the present invention was formed by the following formulation.

(a) Sumicorundum AA-1.5 (Average Primary Grain Size 1.5 $\mu$m, Specific Surface Area 1.3 m$^2$/g) Formation of Grain Dispersion

| | |
|---|---|
| Sumikorandom AA-1.5 | 152 g |
| Silane coupling agent KBM 903 (manufactured by Shin-Etsu Silicone) | 0.48 g |
| Diacetylcellulose solution (solid content 4.5%, solvent: methylethylketone/cyclohexanone = 1/1) | 227.52 g |

The above formulation was finely dispersed at 800 rpm for 4 hr by using a ceramic-coated sand mill (1/4 G sand mill). Zirconia beads 1 mm in diameter were used as media.

(b) Colloidal Silica Grain Dispersion (Fine Grains)

"MEK-ST" manufactured by Nissan Chemical Industries, Ltd. was used.

"MEK-ST" was a colloidal silica dispersion containing methylethylketone as a dispersion medium and having an average primary grain size of 0.015 $\mu$m. The solid content is 30%.

(3) Formation of Second Layer Coating Solution

| | |
|---|---|
| Above-mentioned magnetic substance-containing intermediate solution | 19,053 g |

-continued

| | |
|---|---|
| Diacetylcellulose solution (solid content 4.5%, solvent: methylethylketone/cyclohexanone = 1/1) | 264 g |
| Colloidal silicon dispersion "MEK-ST" [dispersion b] (solid content 30%) | 128 g |
| AA-1.5 dispersion [dispersion a] | 12 g |
| Millionate MR-400 (manufactured by Nippon Polyurethane K.K.) diluted solution (solid content 20%, diluent solvent: methylethylketone/cyclohexanone = 1/1) | 203 g |
| Methylethylketone | 170 g |
| Cyclohexanone | 170 g |

A coating solution formed by mixing and stirring the above materials was coated in an amount of 29.3 mL/m$^2$ by using a wire bar. The solution was dried at 110° C. The thickness of the dried magnetic layer was 1.0 $\mu$m.

(iii) Third Layer (Higher Fatty Acid Ester Slipping Agent-Containing Layer)

(1) Formation of Undiluted Dispersion

A solution A presented below was dissolved at 100° C. and added to a solution B. The resultant solution mixture was dispersed by a high-pressure homogenizer to form an undiluted dispersion of a slipping agent.

| | |
|---|---|
| Solution A | |
| Compound below $C_6H_{13}CH(OH)(CH_2)_{10}COOC_{50}H_{101}$ | 399 parts by mass |
| Compound below n-$C_{50}H_{101}O(CH_2CH_2O)_{16}H$ | 177 parts by mass |
| Cyclohexanone | 830 parts by mass |
| Solution B | |
| Cyclohexanone | 8,600 parts by mass |

(2) Formation of Spherical Inorganic Grain Dispersion

A spherical inorganic grain dispersion [c1] was formed by the following formulation.

| | |
|---|---|
| Isopropyl alcohol | 93.54 parts by mass |
| Silane coupling agent KBM903 (manufactured by Shin-Etsu Silicone) compound 1-1: $(CH_3O)_3Si—(CH_2)_3—NH_2$) | 5.53 parts by mass |
| Compound 1 | 2.93 parts by mass |

Compound 1

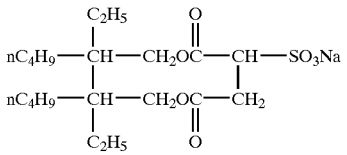

| | |
|---|---|
| SEAHOSTAR KEP50 (amorphous spherical silica, average grain size 0.5 $\mu$m, manufactured by NIPPON SHOKUBAT Co., Ltd.) | 88.00 parts by mass |

The above formulation was stirred for 10 min, and the following was further added.

| | |
|---|---|
| Diacetone alcohol | 252.93 parts by mass |

Under ice cooling and stirring, the above solution was dispersed for 3 hr by using the "SONIFIER450 (manufactured by BRANSON K.K.)" ultrasonic homogenizer, thereby completing the spherical inorganic grain dispersion cl.

(3) Formation of Spherical Organic Polymer Grain Dispersion

A spherical organic polymer grain dispersion [c2] was formed by the following formulation.

| | |
|---|---|
| XC99-A8808 (manufactured by TOSHIBA SILICONE K.K., spherical crosslinked polysiloxane grain, average grain size 0.9 $\mu$m) | 60 parts by mass |
| Methylethylketone | 120 parts by mass |
| Cyclohexanone (solid content 20%, solvent: methylethylketone/cyclohexanone = 1/1) | 120 parts by mass |

Under ice cooling and stirring, the above solution was dispersed for 2 hr by using the "SONIFIER450 (manufactured by BRANSON K.K.)" ultrasonic homogenizer, thereby completing the spherical organic polymer grain dispersion c2.

(4) Formation of Third Layer Coating Solution

The following components were added to 542 g of the aforementioned slipping agent undiluted dispersion to form a third layer coating solution.

| | |
|---|---|
| Diacetone alcohol | 5,950 g |
| Cyclohexanone | 176 g |
| Ethyl acetate | 1,700 g |
| Above-mentioned SEEHOSTA KEP50 dispersion [c1] | 53.1 g |
| Above-mentioned spherical organic polymer grain dispersion [c2] | 300 g |
| FC431 (manufactured by 3M K.K., solid content 50%, solvent: ethyl acetate) | 2.65 g |
| BYK310 (manufactured by BYK Chemi Japan K.K., solid content 25%) | 5.3 g |

The above third layer coating solution was coated in an amount of 10.35 mL/m$^2$ on the second layer, dried at 110° C., and further dried at 97° C. for 3 min.

(iv) Coating of Light-Sensitive Layers

The opposite side of the back layers obtained as above was coated with a plurality of layers to make a color negative film.

(Compositions of Light-Sensitive Layers)

The number corresponding to each component indicates the coating amount in units of g/m$^2$. The coating amount of a silver halide is indicated by the amount of silver.

(Sample 101)

| 1st layer (1st antihalation layer) | | |
|---|---|---|
| Black colloidal silver | silver | 0.074 |
| Silver iodobromide emulsion grain (average equivalent-sphere diameter 0.07 $\mu$m, silver iodide content 2 mol %) | silver | 0.010 |

-continued

| | | |
|---|---|---|
| Gelatin | | 0.740 |
| ExM-1 | | 0.068 |
| ExC-1 | | 0.002 |
| ExC-3 | | 0.002 |
| Cpd-2 | | 0.001 |
| F-8 | | 0.001 |
| HBS-1 | | 0.099 |
| HBS-2 | | 0.013 |
| 2nd layer (2nd antihalation layer) | | |
| Black colloidal silver | silver | 0.094 |
| Gelatin | | 0.667 |
| ExF-1 | | 0.002 |
| F-8 | | 0.001 |
| Solid disperse dye ExF-7 | | 0.100 |
| HBS-1 | | 0.066 |
| ExY-1 | | 0.039 |
| 3rd layer (Interlayer) | | |
| ExC-2 | | 0.050 |
| Cpd-1 | | 0.089 |
| Polyethylaclyrate latex | | 0.200 |
| HBS-1 | | 0.054 |
| Gelatin | | 0.458 |
| 4th layer (Low-speed red-sensitive emulsion layer) | | |
| Em-C | silver | 0.320 |
| Em-D | silver | 0.414 |
| ExC-1 | | 0.354 |
| ExC-2 | | 0.014 |
| ExC-3 | | 0.093 |
| ExC-4 | | 0.193 |
| ExC-5 | | 0.034 |
| ExC-6 | | 0.015 |
| ExC-8 | | 0.053 |
| ExC-9 | | 0.020 |
| Cpd-2 | | 0.025 |
| Cpd-4 | | 0.025 |
| Cpd-7 | | 0.015 |
| UV-2 | | 0.022 |
| UV-3 | | 0.042 |
| UV-4 | | 0.009 |
| UV-5 | | 0.075 |
| HBS-1 | | 0.274 |
| HBS-5 | | 0.038 |
| Gelatin | | 2.757 |
| 5th layer (Medium-speed red-sensitive emulsion layer) | | |
| Em-B | silver | 1.152 |
| ExM-5 | | 0.011 |
| ExC-1 | | 0.304 |
| ExC-2 | | 0.057 |
| ExC-3 | | 0.020 |
| ExC-4 | | 0.135 |
| ExC-5 | | 0.012 |
| ExC-6 | | 0.039 |
| ExC-8 | | 0.016 |
| ExC-9 | | 0.077 |
| Cpd-2 | | 0.056 |
| Cpd-4 | | 0.035 |
| Cpd-7 | | 0.020 |
| HBS-1 | | 0.190 |
| Gelatin | | 1.1346 |
| 6th layer (High-speed red-sensitive emulsion layer) | | |
| Em-A-1 | silver | 0.932 |
| ExC-1 | | 0.066 |
| ExC-3 | | 0.015 |
| ExC-6 | | 0.027 |
| ExC-8 | | 0.114 |
| ExC-9 | | 0.089 |
| ExC-10 | | 0.107 |
| ExY-3 | | 0.010 |
| Cpd-2 | | 0.070 |
| Cpd-4 | | 0.079 |
| Cpd-7 | | 0.030 |
| HBS-1 | | 0.314 |
| HBS-2 | | 0.120 |
| Gelatin | | 1.206 |

-continued

| | | |
|---|---|---|
| 7th layer (Interlayer) | | |
| Cpd-1 | | 0.078 |
| Cpd-6 | | 0.369 |
| Solid disperse dye ExF-4 | | 0.030 |
| HBS-1 | | 0.048 |
| Polyethylacrylate latex | | 0.088 |
| Gelatin | | 0.739 |
| 8th layer (layer for donating interlayer effect to red-sensitive layer) | | |
| Em-E | silver | 0.408 |
| Cpd-4 | | 0.034 |
| ExM-2 | | 0.121 |
| ExM-3 | | 0.002 |
| ExM-4 | | 0.035 |
| ExY-1 | | 0.018 |
| ExY-4 | | 0.038 |
| ExC-7 | | 0.036 |
| HBS-1 | | 0.343 |
| HBS-3 | | 0.006 |
| HBS-5 | | 0.030 |
| Gelatin | | 0.884 |
| 9th layer (Low-speed green-sensitive emulsion layer) | | |
| Em-H | silver | 0.276 |
| Em-I | silver | 0.238 |
| Em-J | silver | 0.325 |
| ExM-2 | | 0.344 |
| ExM-3 | | 0.055 |
| ExY-1 | | 0.018 |
| ExY-3 | | 0.014 |
| ExC-7 | | 0.004 |
| HBS-1 | | 0.505 |
| HBS-3 | | 0.012 |
| HBS-4 | | 0.095 |
| HBS-5 | | 0.055 |
| Cpd-5 | | 0.010 |
| Cpd-7 | | 0.020 |
| Gelatin | | 1.382 |
| 10th layer (Medium-speed green-sensitive emulsion layer) | | |
| Em-G | silver | 0.439 |
| ExM-2 | | 0.046 |
| ExM-3 | | 0.033 |
| ExM-5 | | 0.019 |
| ExY-3 | | 0.006 |
| ExC-6 | | 0.010 |
| ExC-7 | | 0.011 |
| ExC-8 | | 0.010 |
| ExC-9 | | 0.009 |
| HBS-1 | | 0.046 |
| HBS-3 | | 0.002 |
| HBS-4 | | 0.035 |
| HBS-5 | | 0.020 |
| Cpd-5 | | 0.004 |
| Cpd-7 | | 0.010 |
| Gelatin | | 0.446 |
| 11th layer (High-speed green-sensitive emulsion layer) | | |
| Em-F | silver | 0.497 |
| Em-H | silver | 0.286 |
| ExC-6 | | 0.007 |
| ExC-8 | | 0.012 |
| ExC-9 | | 0.014 |
| ExM-1 | | 0.019 |
| ExM-2 | | 0.056 |
| ExM-3 | | 0.013 |
| ExM-4 | | 0.034 |
| ExM-5 | | 0.039 |
| ExM-6 | | 0.021 |
| ExY-3 | | 0.005 |
| Cpd-3 | | 0.005 |
| Cpd-4 | | 0.007 |
| Cpd-5 | | 0.010 |
| Cpd-7 | | 0.020 |
| HBS-1 | | 0.248 |
| HBS-3 | | 0.003 |
| HBS-4 | | 0.094 |

-continued

| | | |
|---|---|---|
| HBS-5 | | 0.037 |
| Polyethylacrylate latex | | 0.099 |
| Gelatin | | 0.950 |
| 12th layer (Yellow filter layer) | | |
| Cpd-1 | | 0.090 |
| Solid disperse dye ExF-2 | | 0.070 |
| Solid disperse dye ExF-5 | | 0.010 |
| Oil-soluble dye ExF-6 | | 0.010 |
| HBS-1 | | 0.055 |
| Gelatin | | 0.589 |
| 13th layer (Low-speed blue-sensitive emulsion layer) | | |
| Em-M | silver | 0.327 |
| Em-N | silver | 0.174 |
| Em-O | silver | 0.097 |
| ExC-1 | | 0.006 |
| ExC-3 | | 0.033 |
| ExC-7 | | 0.014 |
| ExY-1 | | 0.088 |
| ExY-2 | | 0.404 |
| ExY-4 | | 0.056 |
| ExY-5 | | 0.404 |
| Cpd-2 | | 0.102 |
| Cpd-3 | | 0.004 |
| HBS-1 | | 0.337 |
| HBS-5 | | 0.070 |
| Gelatin | | 1.876 |
| 14th layer (High-speed blue-sensitive emulsion layer) | | |
| Em-L | silver | 0.421 |
| Em-K | silver | 0.421 |
| ExM-5 | | 0.012 |
| ExC-1 | | 0.010 |
| ExY-1 | | 0.041 |
| ExY-2 | | 0.119 |
| ExY-3 | | 0.008 |
| ExY-4 | | 0.070 |
| ExY-5 | | 0.120 |
| Cpd-2 | | 0.074 |
| Cpd-3 | | 0.001 |
| Cpd-7 | | 0.030 |
| HBS-1 | | 0.122 |
| Gelatin | | 0.905 |
| 15th layer (1st protective layer) | | |
| Silver iodobromide emulsion grain (average equivalent-sphere diameter 0.07 μm, silver iodide content 2 mol %) | silver | 0.278 |
| UV-1 | | 0.167 |
| UV-2 | | 0.066 |
| UV-3 | | 0.099 |
| UV-4 | | 0.013 |
| UV-5 | | 0.160 |
| F-11 | | 0.008 |
| S-1 | | 0.077 |
| HBS-1 | | 0.175 |
| HBS-4 | | 0.017 |
| Gelatin | | 1.297 |

-continued

| | |
|---|---|
| 16th layer (2nd protective layer) | |
| H-1 | 0.400 |
| B-1 (diameter 1.7 μm) | 0.050 |
| B-2 (diameter 1.7 μm) | 0.150 |
| B-3 | 0.029 |
| S-1 | 0.200 |
| Gelatin | 0.748 |

In addition to the above components, to improve the storage stability, processability, resistance to pressure, antiseptic and mildewproofing properties, antistatic properties, and coating properties, the individual layers contained W-1 to W-11, B-4 to B-6, F-1 to F-19, lead salt, platinum salt, iridium salt, and rhodium salt.

Preparation of Dispersions of Organic Solid Disperse Dyes

ExF-2 in the 12th layer was dispersed by the following method.

| | |
|---|---|
| Wet cake (containing 17.6 mass % of water) of ExF-2 | 2.800 kg |
| Sodium octylphenyldiethoxymethane sulfonate (31 mass % aqueous solution) | 0.376 kg |
| F-15 (7% aqueous solution) | 0.011 kg |
| Water | 4.020 kg |
| Total (pH was adjusted to 7.2 by NaOH) | 7.210 kg |

A slurry having the above composition was coarsely dispersed by stirring by using a dissolver. The resultant material was dispersed at a peripheral speed of 10 m/s, a discharge amount of 0.6 kg/min, and a packing ratio of 0.3-mm diameter zirconia beads of 80% by using an agitator mill until the absorbance ratio of the dispersion was 0.29, thereby obtaining a solid disperse dye ExF-2. The average grain size of the fine dye grains was 0.29 μm.

Following the same procedure as above, solid disperse dyes ExF-4 and ExF-7 were obtained. The average grain sizes of the fine dye grains were 0.28 and 0.49 μm, respectively. ExF-5 was dispersed by a microprecipitation dispersion method described in Example 1 of EP549,489A, the disclosure of which is incorporated herein by reference. The average grain size was found to be 0.06 μm.

The grain characteristics of emulsions Em-A-1 and Em-B to Em-O will be listed in Tables 1 to 5. With respect to the emulsions Em-A-1 to Em-O, the optimum gold sensitization, sulfur sensitization and selenium sensitization have been effected by addition of the optimum amount of spectral sensitizing dyes listed in Table 5.

TABLE 1

| Emulsion name | Layer used | Grain shape | Average equivalent-sphere diameter (μm) |
|---|---|---|---|
| Em-A-1 | High-speed red-sensitive layer | (111) main plane tabular grain | 0.95 |
| Em-B | Medium-speed red-sensitive layer | (111) main plane tabular grain | 0.69 |
| Em-C | Low-speed red-sensitive layer | (111) main plane tabular grain | 0.48 |
| Em-D | Low-speed red-sensitive layer | (111) main plane tabular grain | 0.31 |
| Em-E | Layer for donating interlayer effect to red-sensitive layer | (111) main plane tabular grain | 0.78 |
| Em-F | High-speed green-sensitive layer | (111) main plane tabular grain | 1.00 |
| Em-G | Medium-speed green-sensitive layer | (111) main plane tabular grain | 0.74 |

TABLE 1-continued

| Emulsion name | Layer used | Grain shape | Average equivalent-sphere diameter (μm) |
|---|---|---|---|
| Em-H | High- and low-speed green-sensitive layers | (111) main plane tabular grain | 0.74 |
| Em-I | Low-speed green-sensitive layer | (111) main plane tabular grain | 0.55 |
| Em-J | Low-speed green-sensitive layer | (111) main plane tabular grain | 0.44 |
| Em-K | High-speed blue-sensitive layer | (111) main plane tabular grain | 1.60 |
| Em-L | High-speed blue-sensitive layer | (111) main plane tabular grain | 1.30 |
| Em-M | Low-speed blue-sensitive layer | (111) main plane tabular grain | 0.81 |
| Em-N | Low-speed blue-sensitive layer | (111) main plane tabular grain | 0.40 |
| Em-O | Low-speed blue-sensitive layer | (100) main plane cubic grain | 0.21 |

TABLE 2

| Emulsion name | Average equivalent-circle diameter (μm)/variation coefficient (%) | Average thickness (μm)/variation coefficient (%) | Average aspect ratio | Ratio of tabular grains to all the grains in number (%) | Average thickness of core portion (μm) | Average number of dislocation lines per grain | Ratio of tabular grains satisfying requirement A* to all the grains in number (%) |
|---|---|---|---|---|---|---|---|
| Em-A-1 | 1.95/28 | 0.15/14 | 13 | 91 | 0.12 | 20 | 25 |
| Em-B | 1.14/35 | 0.17/15 | 6.7 | 90 | 0.12 | 15 | 35 |
| Em-C | 0.89/17 | 0.09/12 | 10 | 99 | 0.07 | 10 | 10 |
| Em-D | 0.40/20 | 0.09/9.3 | 4.5 | 98 | 0.07 | 10 | 0 |
| Em-E | 1.38/30 | 0.15/13 | 9.2 | 90 | 0.12 | 20 | 35 |
| Em-F | 1.74/34 | 0.22/16 | 7.9 | 91 | 0.13 | 20 | 10 |
| Em-G | 1.23/40 | 0.18/18 | 6.8 | 90 | 0.12 | 15 | 20 |
| Em-H | 1.39/25 | 0.14/11 | 9.9 | 91 | 0.12 | 20 | 15 |
| Em-I | 0.79/30 | 0.14/13 | 5.5 | 97 | 0.13 | 30 | 0 |
| Em-J | 0.53/30 | 0.17/18 | 3.2 | 97 | 0.10 | 20 | 0 |
| Em-K | 3.00/25 | 0.31/21 | 10 | 99 | 0.16 | 15 | 0 |
| Em-L | 2.20/24 | 0.34/22 | 7 | 98 | 0.14 | 20 | 0 |
| Em-M | 1.10/30 | 0.23/18 | 4.7 | 97 | 0.13 | 20 | 5 |
| Em-N | 0.55/32 | 0.13/16 | 4.6 | 96 | 0.11 | 20 | 0 |
| Em-O | 0.21/20 | 0.21/20 | 1 | — | — | — | — |

*Requirement A: tabular grains having (111) faces as main planes, the tabular grains: (i) composed of silver iodobromide or silver chloroiodobromide; (ii) having an equivalent circle diameter of 1.0 μm or more and a thickness of 0.15 μm or less; and (iii) composed of core portions of 0.1 μm or less thickness free of growth ring structure and composed of silver iodobromide and shell portions having ten or more dislocation lines.

TABLE 3

| Emulsion name | Average silver iodide content (mol %)/inter-grain variation coefficient (%) | Surface silver iodide content (mol %) | Average silver chloride content (mol %)/inter-grain variation coefficient (%) | Surface silver chloride content (mol %) | Twin plane spacing (μm)/variation coefficient (%) | (100) face ratio in side planes (%) |
|---|---|---|---|---|---|---|
| Em-A-1 | 4.5/10 | 3.90 | 0 | 0 | 0.011/30 | 20 |
| Em-B | 5.5/11 | 5.00 | 0 | 0 | 0.010/30 | 30 |
| Em-C | 1.5/10 | 3.70 | 4.7/8.0 | 16 | 0.010/31 | 25 |
| Em-D | 1.1/11 | 5.00 | 12/9.0 | 23 | 0.009/29 | 25 |
| Em-E | 5.3/10 | 5.90 | 0 | 0 | 0.012/30 | 35 |
| Em-F | 5.1/10 | 3.90 | 0 | 0 | 0.012/30 | 20 |
| Em-G | 6.3/13 | 5.60 | 0 | 0 | 0.010/30 | 30 |
| Em-H | 5.3/14 | 5.97 | 0 | 0 | 0.011/30 | 30 |
| Em-I | 6.3/12 | 7.39 | 0 | 0 | 0.016/32 | 20 |
| Em-J | 2.0/14 | 5.68 | 0 | 0 | 0.016/32 | 35 |
| Em-K | 5.8/7.0 | 3.88 | 0 | 0 | 0.010/29 | 40 |
| Em-L | 6.1/8.0 | 5.50 | 0 | 0 | 0.017/33 | 20 |
| Em-M | 6.3/9.0 | 1.90 | 0 | 0 | 0.019/30 | 30 |
| Em-N | 4.0/10 | 5.50 | 0 | 0 | 0.020/31 | 30 |
| Em-O | 3.8/9.0 | 4.50 | 0 | 0 | — | — |

TABLE 4

| Emulsion name | Characteristics of grains accounting for 70% or more of the total projected area | Silver amount ratio of grain structure (%) and halogen composition (listed in order from center of grain); <> indicates epitaxial junction |
|---|---|---|
| Em-A-1 | (111) main plane tabular grain | (11%)AgBr/(35%)$AgBr_{97}I_3$/(18%)AgBr/(9%)$AgBr_{62}I_{38}$/(27%)AgBr |
| Em-B | (111) main plane tabular grain | (7%)AgBr/(31%)$AgBr_{97}I_3$/(16%)AgBr/(12%)$AgBr_{62}I_{38}$/(34%)AgBr |
| Em-C | (111) main plane tabular grain | (1%)AgBr/(77%)$AgBr_{99}I_1$/(9%)$AgBr_{95}I_5$/(13%) <$AgBr_{63}Cl_{35}I_2$> |
| Em-D | (111) main plane tabular grain | (57%)AgBr/(14%)$AgBr_{96}I_4$/(29%) <$AgBr_{57}Cl_{41}I_2$> |
| Em-E | (111) main plane tabular grain | (13%)AgBr/(36%)$AgBr_{97}I_3$/(7%)AgBr/(11%)$AgBr_{62}I_{38}$/(33%)AgBr |
| Em-F | (111) main plane tabular grain | (11%)AgBr/(35%)$AgBr_{97}I_3$/(18)AgBr/(4%)AgI/(32)AgBr |
| Em-G | (111) main plane tabular grain | (7%)AgBr/(31%)$AgBr_{97}I_3$/(15%)AgBr/(14%)$AgBr_{62}I_{38}$/(33%)AgBr |
| Em-H | (111) main plane tabular grain | (14%)AgBr/(36%)$AgBr_{97}I_3$/(7%)AgBr/(11%)$AgBr_{62}I_{38}$/(32%)AgBr |
| Em-I | (111) main plane tabular grain | (15%)AgBr/(44%)$AgBr_{97}I_3$/(11%)AgBr/(5%)AgI/(25%)AgBr |
| Em-J | (111) main plane tabular grain | (60%)AgBr/(2%)AgI/(38%)AgBr |
| Em-K | (111) main plane tabular grain | (68%)$AgBr_{93}I_7$/(21%)AgBr/(1%)AgI/(10%)AgBr |
| Em-L | (111) main plane tabular grain | (8%)AgBr/(10%)$AgBr_{95}I_5$/(52%)$AgBr_{93}I_7$/(11%)AgBr/(2%)AgI/(17%)AgBr |
| Em-M | (111) main plane tabular grain | (12%)AgBr/(43%)$AgBr_{90}I_{10}$/(14%)AgBr/(2%)AgI/(29%)AgBr |
| Em-N | (111) main plane tabular grain | (58%)AgBr/(4%)AgI/(38%)AgBr |
| Em-O | (111) main plane tabular grain | (6%)AgBr/(94%)$AgBr_{96}I_4$ |

TABLE 5

| Emulsion name | Sensitizing dye | Dopant |
|---|---|---|
| Em-A-1 | 1, 3, 4 | $K_2IrCl_6$, $K_4Fe(CN)_6$ |
| Em-B | 2, 3, 4 | $K_2IrCl_6$, $K_2IrCl_5(H_2O)$, $K_4Ru(CN)_6$ |
| Em-C | 1, 3, 4 | $K_2IrCl_6$, $K_4Fe(CN)_6$ |
| Em-D | 1, 3, 4 | $K_2IrCl_6$, $K_4Fe(CN)_6$ |
| Em-E | 5, 10 | $K_4Fe(CN)_6$ |
| Em-F | 5, 6, 9 | $K_4Ru(CN)_6$ |
| Em-G | 5, 6, 9 | $K_2IrCl_6$, $K_4Fe(CN)_6$ |
| Em-H | 5, 6, 7, 8, 9 | $K_2IrCl_6$, $K_4Fe(CN)_6$ |
| Em-I | 6, 8, 9 | $K_2IrCl_6$ |
| Em-J | 5, 6, 7 | $K_2IrCl_6$, $K_4Fe(CN)_6$ |
| Em-K | 14 | — |
| Em-L | 12 | — |
| Em-M | 14 | — |
| Em-N | 12, 13 | — |
| Em-O | 11, 13 | $K_2IrCl_6$ |

The sensitizing dyes described in Table 5 will be shown below.

Sensitizing dye 1

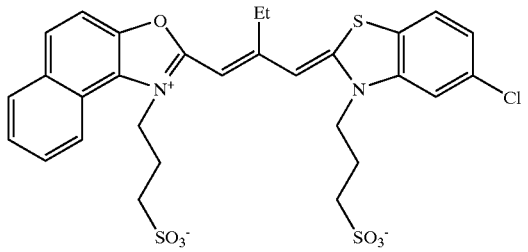

Sensitizing dye 2

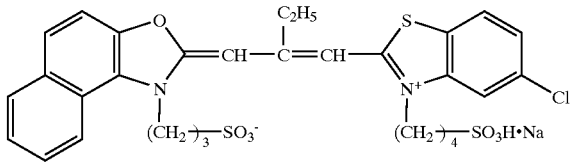

-continued

Sensitizing dye 3

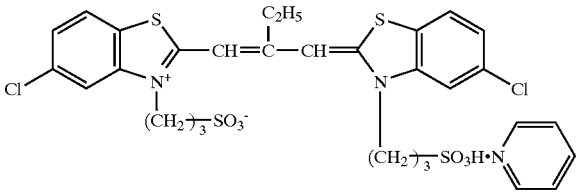

Sensitizing dye 4

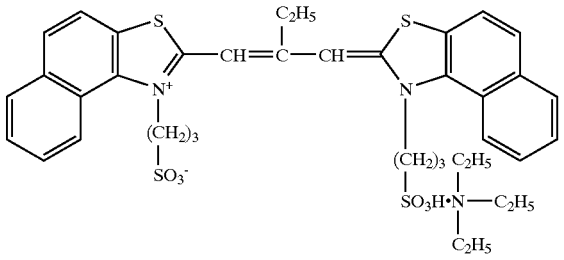

Sensitizing dye 5

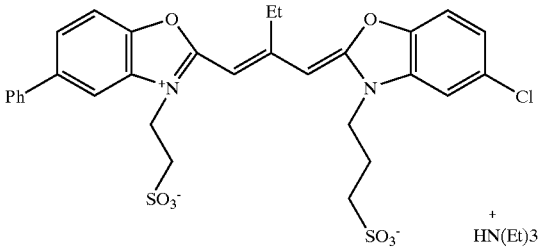

Sensitizing dye 6

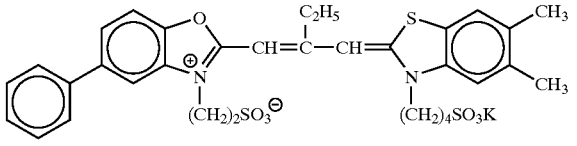

-continued

Sensitizing dye 7

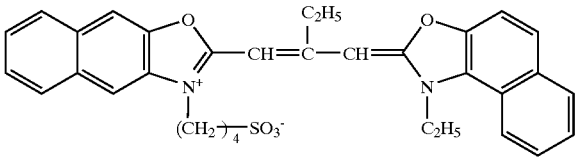

Sensitizing dye 8

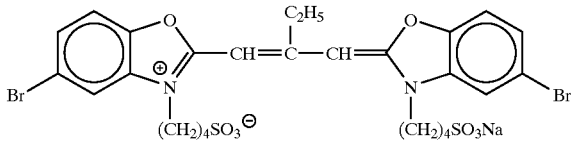

Sensitizing dye 9

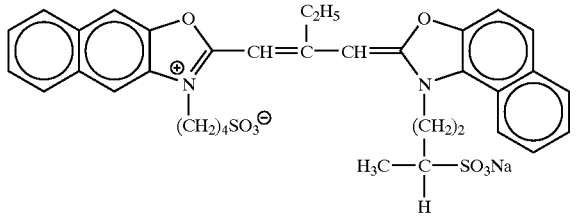

Sensitizing dye 10

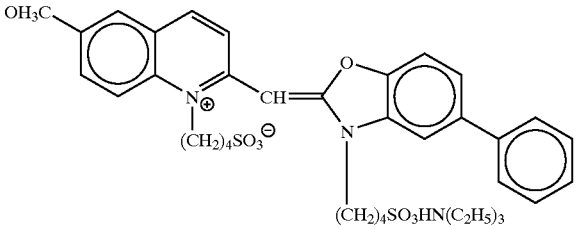

Sensitizing dye 11

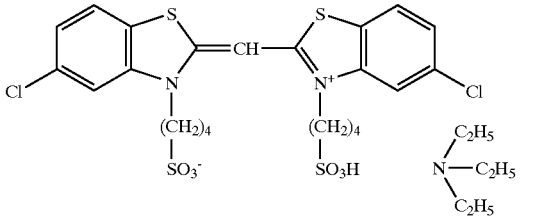

-continued

Sensitizing dye 12

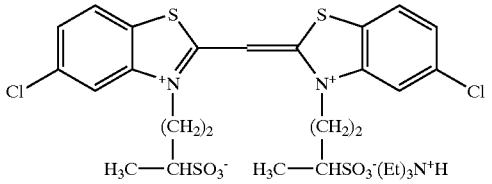

Sensitizing dye 13

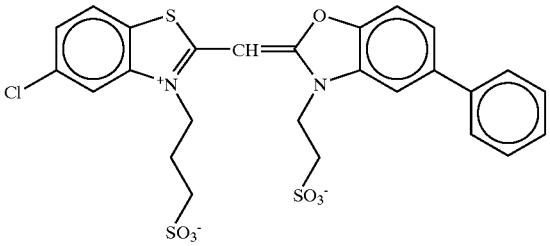

Sensitizing dye 14

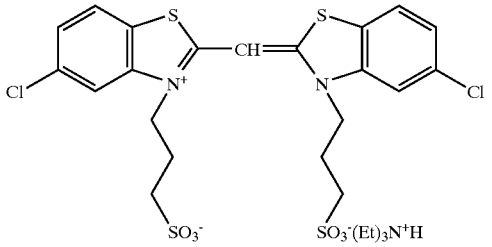

In the preparation of tabular grains, low-molecular-weight gelatins have been used in accordance with Examples of JP-A-1-158426.

With respect to the emulsions Em-K to Em-N, reduction sensitization thereof has been carried out at the time of grain formation.

With respect to the emulsion Em-H, dislocation has been introduced with the use of iodide ion release agent in accordance with Examples of JP-A-6-11782.

With respect to the emulsion Em-E, dislocation has been introduced with the use of silver iodide fine grains having been prepared just before addition in a separate chamber equipped with magnetic coupling induction type agitator as described in JP-A-10-43570.

The compounds used in the individual layers will be shown below.

ExF-1

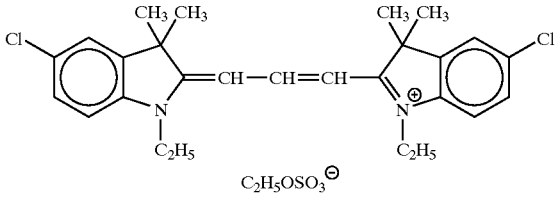

ExF-2

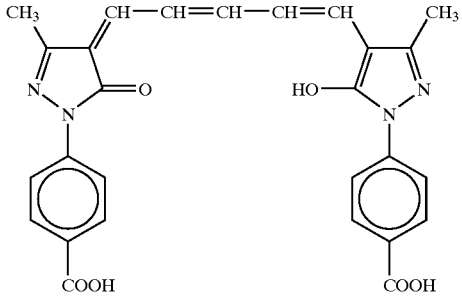

-continued
ExF-4
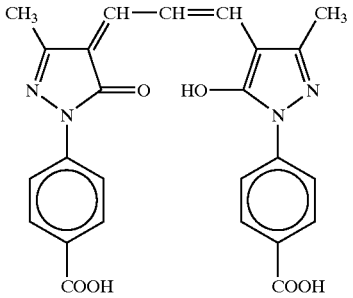
ExF-5
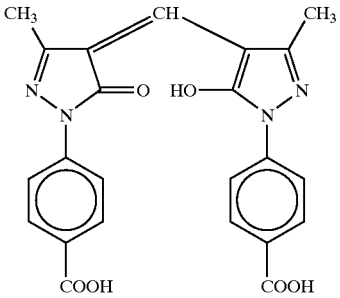
ExF-6
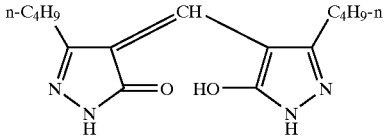
ExF-7
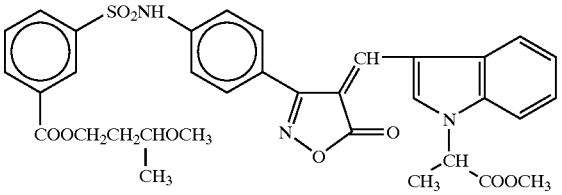
ExC-1
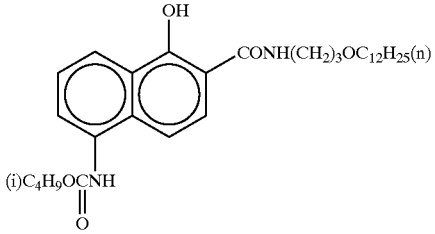
ExC-2
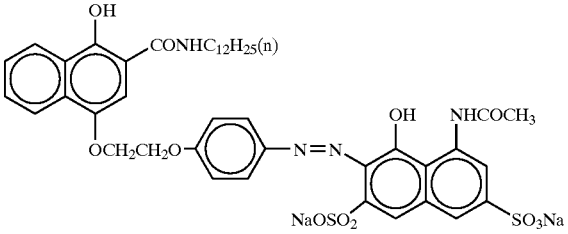
ExC-3
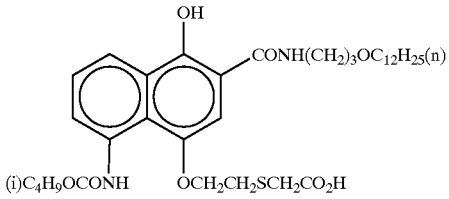
ExC-4
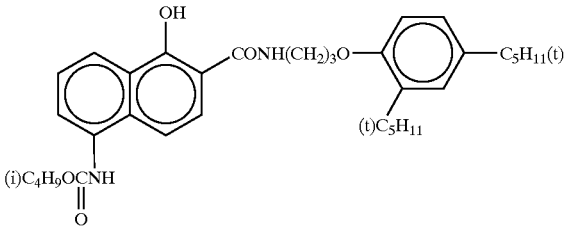
ExC-5
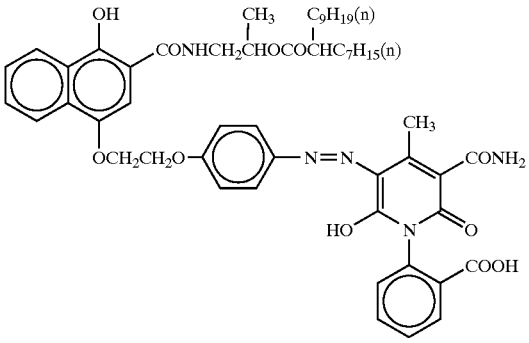
ExC-6
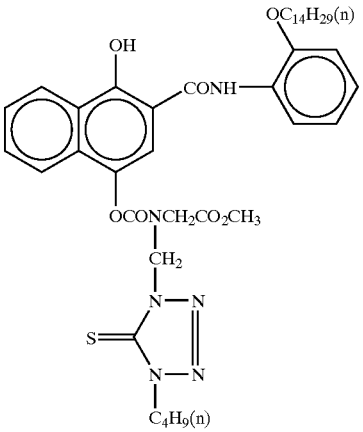

-continued
ExC-7
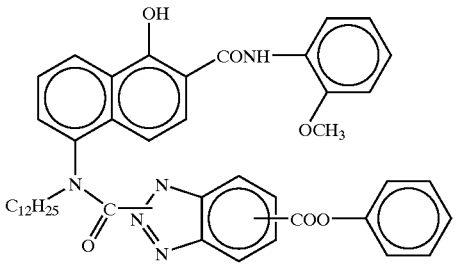
ExC-8
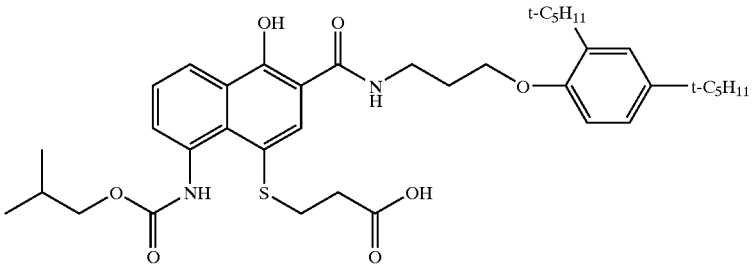
ExC-9
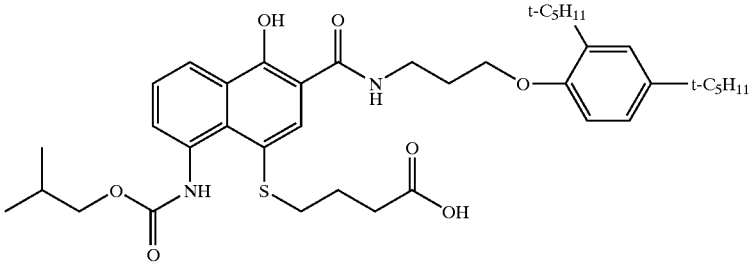
ExC-10
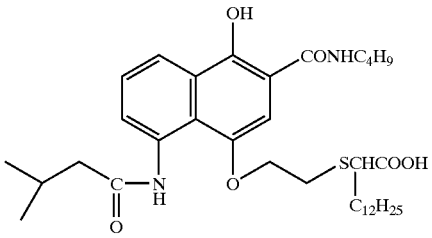
ExM-1
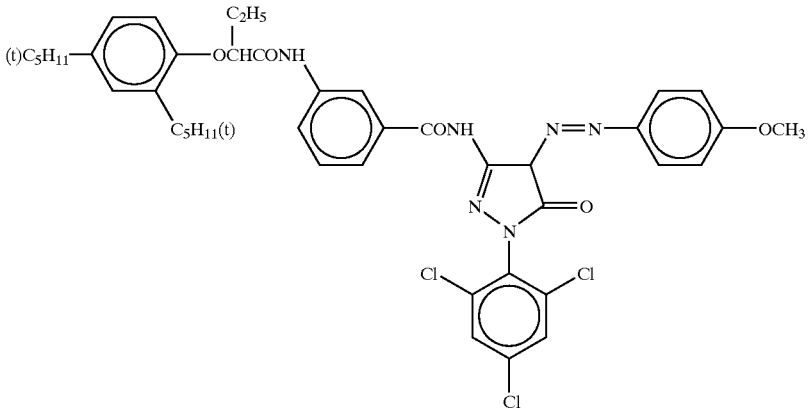

-continued
ExM-2
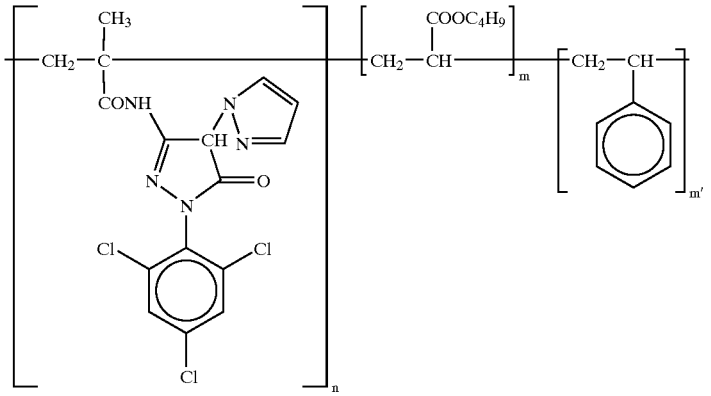
n = 50
m = 25
m′ = 25
mol. wt. about 20,000
ExM-3
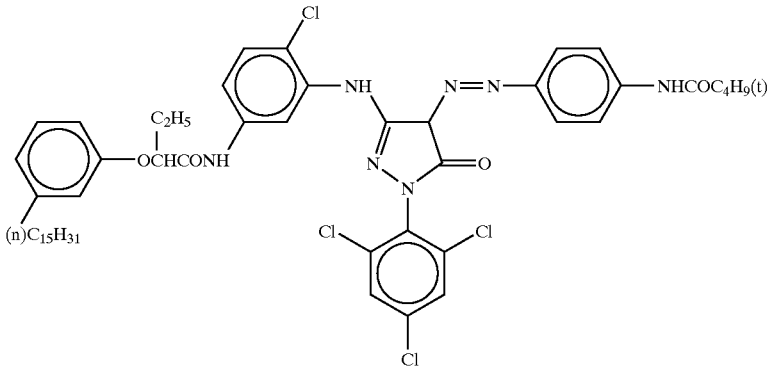
ExM-4
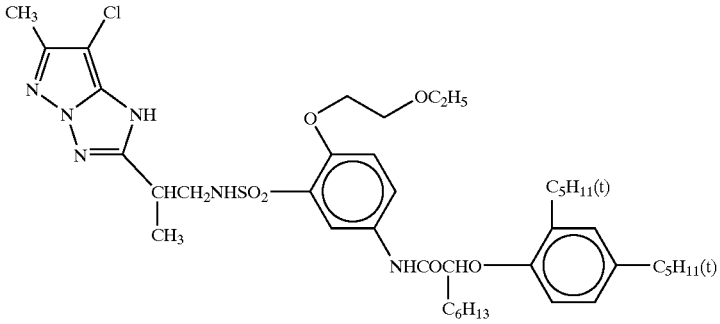
ExM-5
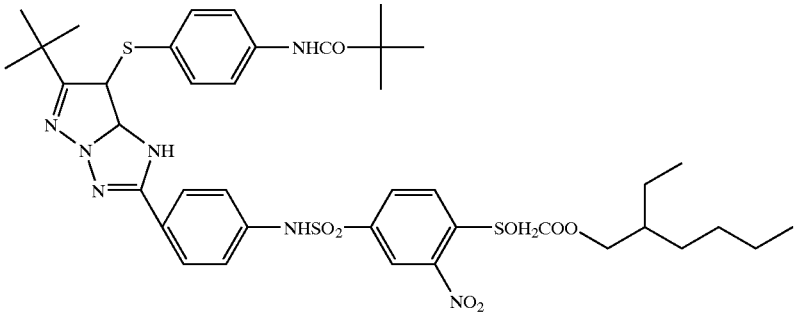

-continued
ExM-6
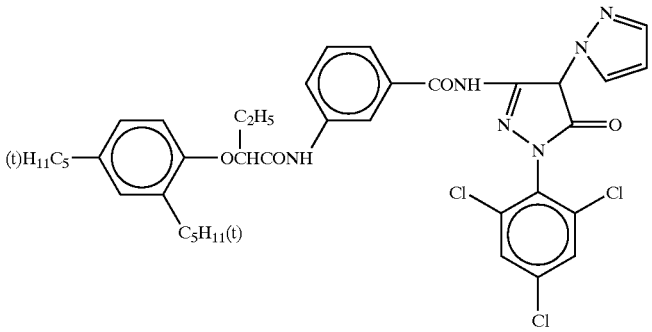
ExY-1
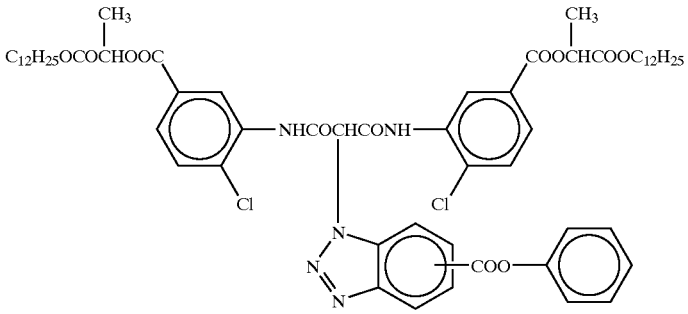
ExY-2
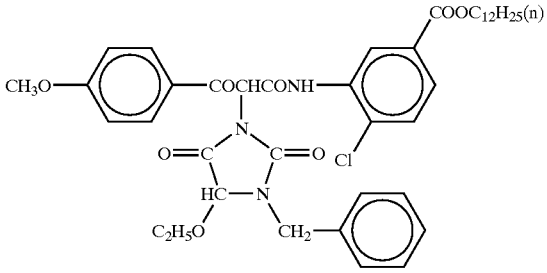
ExY-3
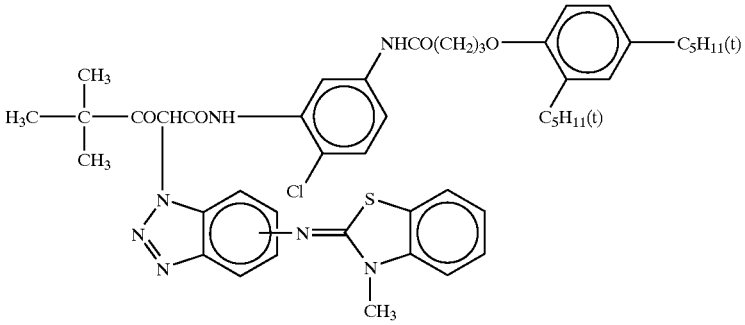
ExY-4
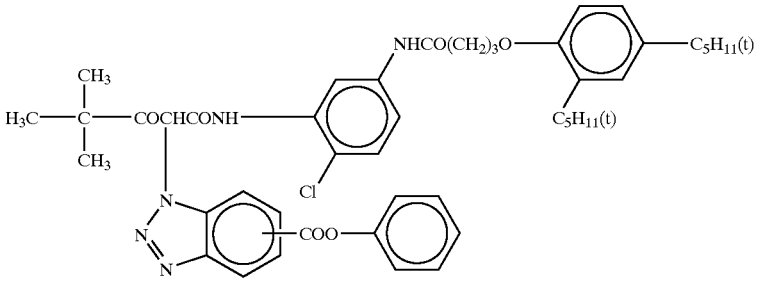

-continued
ExY-5
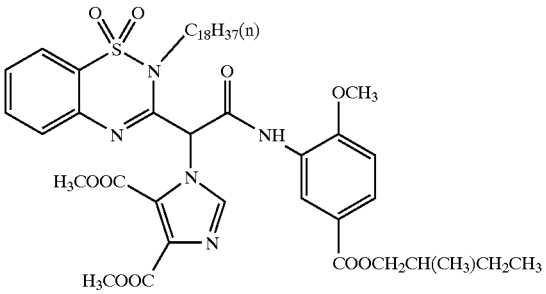
Cpd-1
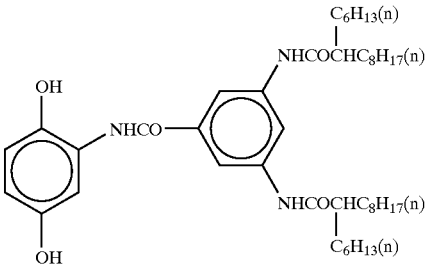
Cpd-2
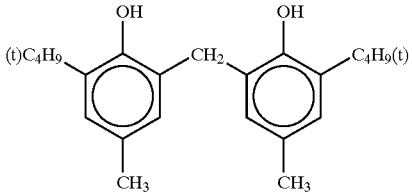
Cpd-3
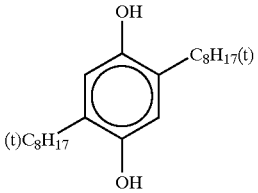
Cpd-4
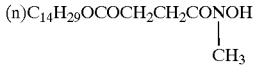
Cpd-5
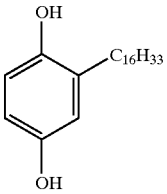
Cpd-6
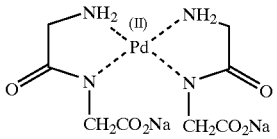
Cpd-7
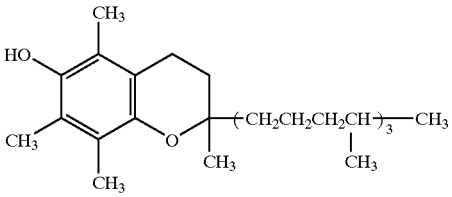
UV-1
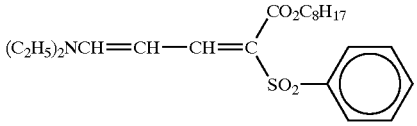
UV-2
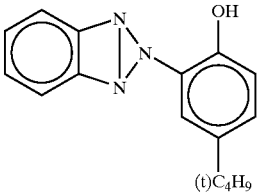
UV-3
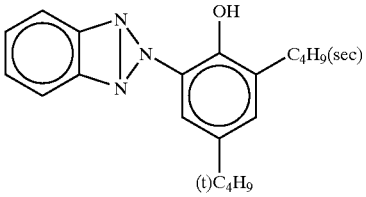
UV-4
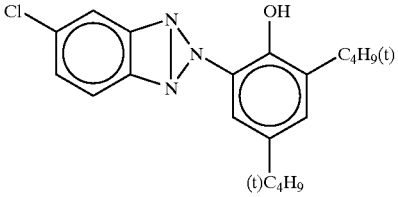
UV-5
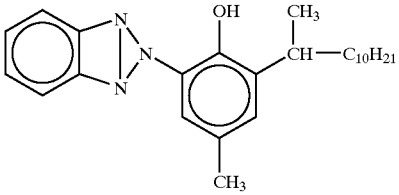
B-1
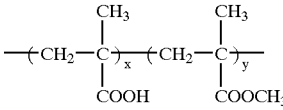
x/y = 10/90 (mass ratio)
Weight-average molecular
weight: about 35,000

-continued
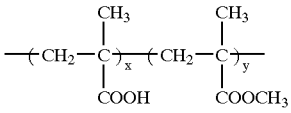
x/y = 40/60 (mass ratio)
Weight-average molecular weight: about 20,000
B-2
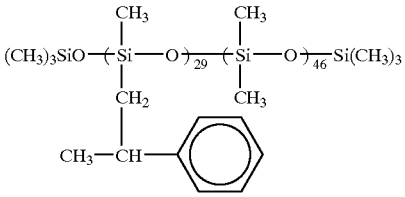
(mole ratio)
Weight-average molecular weight: about 8,000
B-3
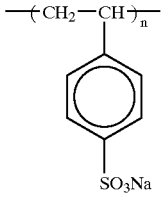
Weight-average molecular weight: about 750,000
B-4
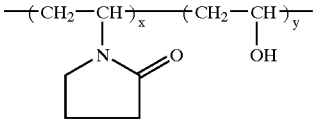
x/y = 70/30 (mass ratio)
Weight-average molecular weight: about 17,000
B-5
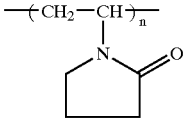
Weight-average molecular weight: about 10,000
B-6
Tricresyl phosphate
HBS-1
Di-n-butyl phthalate
HBS-2
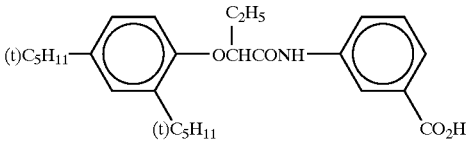
HBS-3
Tri (2-ethylhexyl) phosphate
HBS-4
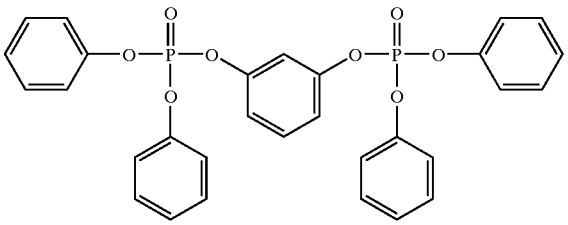
HBS-5
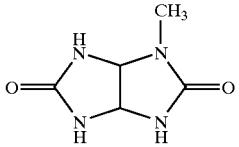
S-1
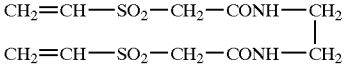
H-1
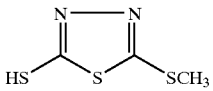
F-1
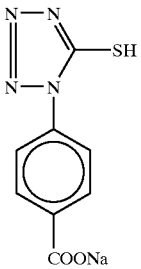
F-2

-continued
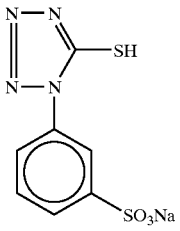
F-3
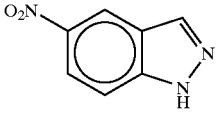
F-4
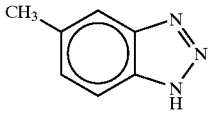
F-5
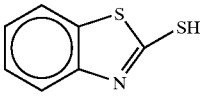
F-6
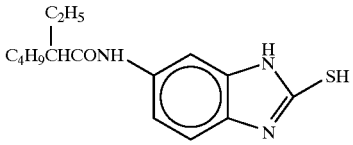
F-7
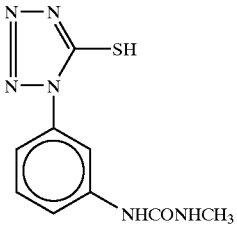
F-8
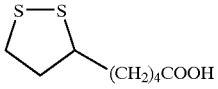
F-9
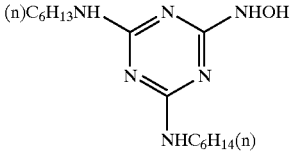
F-10
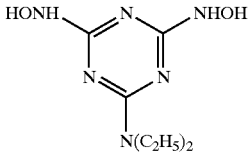
F-11
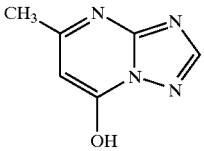
F-12
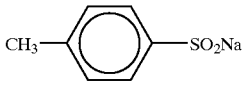
F-13
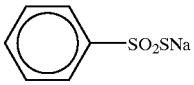
F-14
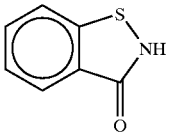
F-15
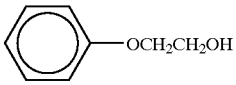
F-16
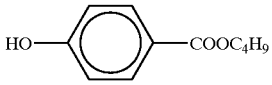
F-17
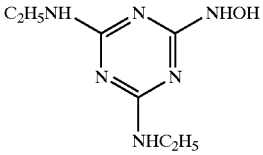
F-18
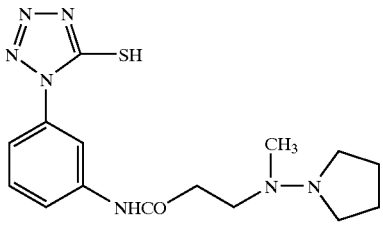
F-19
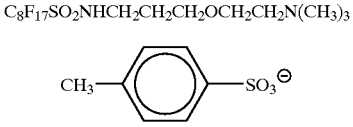
W-1

-continued

W-2

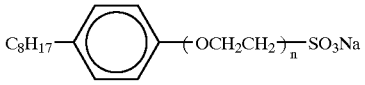

n = 2 to 4

W-3

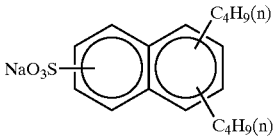

W-4

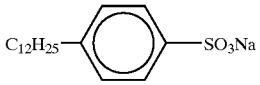

W-5

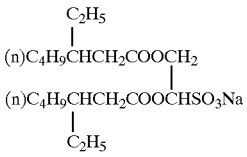

W-6

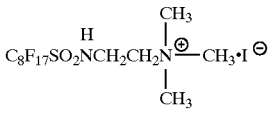

W-7

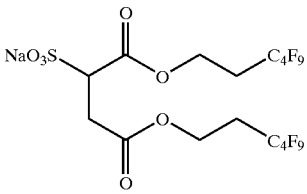

W-8

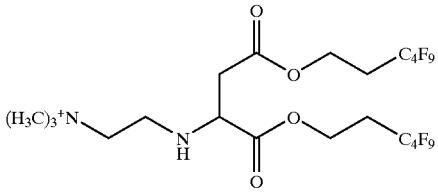

W-9

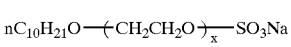

x = 1 to 3

W-10

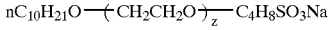

z = 1 to 3

W-11

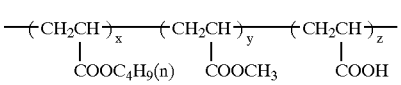

x/y/z = 20/60/20
(mass ratio)
Weight-average molecular weight:
about 36,000

The thus obtained silver halide color photographic light-sensitive material is referred to as sample 101.

(Samples 102 to 113)

Samples 102 to 113 were prepared by replacing the emulsion Em-A-1 of the 6th layer of the sample 101 as indicated in Table 6 and by adding compounds of the present invention to the 6th layer as indicated in Table 6. The characteristics of emulsions Em-A-2 to Em-A-6 are listed in Table 6.

TABLE 6

| Sample | Emulsion name | Layer used | Grain shape | Average equivalent-sphere diameter (μm) |
|---|---|---|---|---|
| 101 | Em-A-1 | High-speed red-sensitive layer | (111) main plane tabular grain | 0.95 |
| 102 | Em-A-1 | High-speed red-sensitive layer | (111) main plane tabular grain | 0.95 |
| 103 | Em-A-2 | High-speed red-sensitive layer | (111) main plane tabular grain | 0.95 |
| 104 | Em-A-3 | High-speed red-sensitive layer | (111) main plane tabular grain | 0.95 |
| 105 | Em-A-2 | High-speed red-sensitive layer | (111) main plane tabular grain | 0.95 |
| 106 | Em-A-4 | High-speed red-sensitive layer | (111) main plane tabular grain | 0.95 |
| 107 | Em-A-4 | High-speed red-sensitive layer | (111) main plane tabular grain | 0.95 |
| 108 | Em-A-4 | High-speed red-sensitive layer | (111) main plane tabular grain | 0.95 |
| 109 | Em-A-4 | High-speed red-sensitive layer | (111) main plane tabular grain | 0.95 |

TABLE 6-continued

| | | | | |
|---|---|---|---|---|
| 110 | Em-A-5 | High-speed red-sensitive layer | (111) main plane tabular grain | 0.95 |
| 111 | Em-A-5 | High-speed red-sensitive layer | (111) main plane tabular grain | 0.95 |
| 112 | Em-A-6 | High-speed red-sensitive layer | (111) main plane tabular grain | 0.95 |
| 113 | Em-A-6 | High-speed red-sensitive layer | (111) main plane tabular grain | 0.95 |

| Sample | Average equivalent-circle diameter (μm)/ variation coefficient (%) | Average thickness (μm)/ variation coefficient (%) | Average aspect ratio | Ratio of tabular grains to all the grain in number (%) | Average thickness of core portion (μm) |
|---|---|---|---|---|---|
| 101 | 1.95/28 | 0.15/14 | 13 | 97 | 0.12 |
| 102 | 1.95/28 | 0.15/14 | 13 | 97 | 0.12 |
| 103 | 2.10/30 | 0.13/14 | 16 | 97 | 0.10 |
| 104 | 2.10/30 | 0.13/14 | 16 | 97 | 0.10 |
| 105 | 2.10/30 | 0.13/14 | 16 | 97 | 0.10 |
| 106 | 2.20/32 | 0.12/14 | 18 | 97 | 0.09 |
| 107 | 2.20/32 | 0.12/14 | 18 | 97 | 0.09 |
| 108 | 2.20/32 | 0.12/14 | 18 | 97 | 0.09 |
| 109 | 2.20/32 | 0.12/14 | 18 | 97 | 0.09 |
| 110 | 1.95/28 | 0.15/14 | 13 | 97 | 0.10 |
| 111 | 1.95/28 | 0.15/14 | 13 | 97 | 0.10 |
| 112 | 1.83/27 | 0.17/14 | 11 | 97 | 0.10 |
| 113 | 1.83/27 | 0.17/14 | 11 | 97 | 0.10 |

| Sample | Average number of dislocation lines per grain | Ratio of tabular grains satisfying requirement A* to all the grains in number (%) | Compound of the present invention (0.156 g/m$^2$) | Relative sensitivity | Graininess | Remark |
|---|---|---|---|---|---|---|
| 101 | 20 | 25 | No | 100 | 100 | Comp. |
| 102 | 20 | 25 | HET3 | 105 | 100 | Comp. |
| 103 | 20 | 40 | No | 101 | 100 | Comp. |
| 104 | 5 | 30 | HET3 | 105 | 101 | Comp. |
| 105 | 20 | 60 | HET3 | 120 | 99 | Inv. |
| 106 | 20 | 80 | HET3 | 130 | 99 | Inv. |
| 107 | 20 | 80 | (2) | 150 | 99 | Inv. |
| 108 | 20 | 80 | (59) | 160 | 99 | Inv. |
| 109 | 20 | 80 | (60) | 145 | 99 | Inv. |
| 110 | 20 | 50 | No | 100 | 100 | Comp. |
| 111 | 20 | 50 | HET3 | 115 | 99 | Inv. |
| 112 | 20 | 40 | No | 97 | 100 | Comp. |
| 113 | 20 | 40 | HET3 | 105 | 99 | Comp. |

*Requirement A: tabular grains having (111) faces as main planes, the tabular grains: (i) composed of silver iodobromide or silver chloroiodobromide; (ii) having an equivalent circle diameter of 1.0 μm or more and a thickness of 0.15 μm or less; and (iii) composed of core portions of 0.1 μm or less thickness free of growth ring structure and composed of silver iodobromide and shell portions having ten or more dislocation lines.

The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |

-continued (Processing steps)

| Step | Time | Temperature | Replenishment rate* | Tank volume |
|---|---|---|---|---|
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex. 1)

The stabilizer and the fixing solution were counterflowed in the order of (2)→(1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide sensitized material, respectively. Note also that each cross-over time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | [Tank solution] (g) | [Replenisher] (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl) amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |

(Fixer (1) Tank Solution)

A 5:95 mixture (v/v) of the above bleaching tank solution and the below fixing tank solution pH 6.8

| (Fixer (2)) | [Tank solution] (g) | [Replenisher] (g) |
|---|---|---|
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-mononyl phenylether (average polymerization degree 10) | 0.2 |
| 1,2-benzisothiazoline-3-on sodium | 0.10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

(Estimation 1 Sensitivity)

The obtained samples were sequentially subjected to continuous wedge exposure for 1/100 sec through gelatin filter SC-39 manufactured by Fuji Photo Film Co., Ltd., color development processing described above and determination of sensito-curves, from which the photographic speed (S0.2Y) thereof at cyan density fog+0.2 was estimated. Respective values indicated are in terms of the speed relative to that of the sample 101. The greater the value, the higher the speed and thus the greater the preference.

(Estimation 2 Graininess)

The above samples were subjected to uniform exposure with a light intensity capable of realizing a density of fog density plus 0.2 and to the above development processing. After the development processing, the graininess was measured by the method described on page 619 of "The Theory of the Photographic Process" published by Macmillan.

It is apparent from Table 6 that the silver halide photographic lightsensitive materials of the present invention exhibit high photographic speed and are excellent in graininess.

Example 2

The thickness of the protective layer of the sample 101 was 3.5 μm. Samples 201 to 217 were prepared by regulating the amounts of gelatin used in the 15th layer and 16th layer of the sample 101 so that the thickness of the protective layer became 2.5 μm or 1.5 μm, by replacing the emulsion Em-A-1 of the 6th layer with emulsions Em-A-4 to Em-A-6 specified in Table 6, and by adding compounds of the present invention to the 6th layer. The constitution particulars thereof will be listed in Table 7.

(Estimation 1 sensitivity)

The estimation was effected in the same manner as in Example 1.

(Estimation 2 Graininess)

The estimation was effected in the same manner as in Example 1.

(Estimation 3 Sharpness)

The obtained samples were sequentially subjected to 1/100 sec exposure through gelatin filter SC-39 manufactured by Fuji Photo Film Co., Ltd. so as to effect white exposure writing of a pattern for MTF estimation and to the above color development processing. The sharpness of cyan density was expressed in terms of value relative to that of the sample 201. The greater the value, the higher the sharpness and thus the greater the preference.

Estimation results will be listed in Table 7. It is apparent from the results that the silver halide color photographic lightsensitive material which exhibits high photographic speed and is excellent in graininess and sharpness can be obtained by the combination according to the present invention.

TABLE 7

| Sample | Emulsion name | Layer used | Ratio of tabular grains satisfying requirement A* to all the grains in number (%) |
|---|---|---|---|
| 201 | Em-A-1 | High-speed red-sensitive layer | 25 |
| 202 | Em-A-1 | High-speed red-sensitive layer | 25 |
| 203 | Em-A-1 | High-speed red-sensitive layer | 25 |
| 204 | Em-A-1 | High-speed red-sensitive layer | 25 |
| 205 | Em-A-4 | High-speed red-sensitive layer | 80 |
| 206 | Em-A-4 | High-speed red-sensitive layer | 80 |
| 207 | Em-A-4 | High-speed red-sensitive layer | 80 |
| 208 | Em-A-4 | High-speed red-sensitive layer | 80 |
| 209 | Em-A-4 | High-speed red-sensitive layer | 80 |
| 210 | Em-A-4 | High-speed red-sensitive layer | 80 |
| 211 | Em-A-4 | High-speed red-sensitive layer | 80 |
| 212 | Em-A-5 | High-speed red-sensitive layer | 50 |
| 213 | Em-A-5 | High-speed red-sensitive layer | 50 |
| 214 | Em-A-5 | High-speed red-sensitive layer | 50 |
| 215 | Em-A-5 | High-speed red-sensitive layer | 50 |
| 216 | Em-A-6 | High-speed red-sensitive layer | 40 |
| 217 | Em-A-6 | High-speed red-sensitive layer | 40 |

| Sample | Compound of the present inventin (0.156 g/m$^2$) | Sam of protective layer thickness ($\mu$m) | Relative sensitivity | Graininess | Relative sharpness | Remark |
|---|---|---|---|---|---|---|
| 201 | No | 3.5 | 100 | 100 | 100 | Comp. |
| 202 | HET3 | 3.5 | 105 | 100 | 100 | Comp. |
| 203 | No | 2.5 | 101 | 100 | 107 | Comp. |
| 204 | HET3 | 2.5 | 105 | 100 | 105 | Comp. |
| 205 | No | 3.5 | 110 | 99 | 92 | Comp. |
| 206 | HET3 | 3.5 | 130 | 99 | 93 | Inv. |
| 207 | No | 2.5 | 118 | 99 | 109 | Inv. |
| 208 | HET3 | 1.5 | 150 | 99 | 120 | Inv. |
| 209 | (2) | 1.5 | 168 | 99 | 121 | Inv. |
| 210 | (59) | 1.5 | 177 | 99 | 118 | Inv. |
| 211 | (60) | 1.5 | 163 | 99 | 119 | Inv. |
| 212 | No | 3.5 | 100 | 100 | 100 | Comp. |
| 213 | HET3 | 3.5 | 115 | 100 | 101 | Inv. |
| 214 | No | 1.5 | 112 | 100 | 117 | Inv. |
| 215 | HET3 | 1.5 | 125 | 100 | 115 | Inv. |
| 216 | No | 3.5 | 97 | 100 | 101 | Comp. |
| 217 | HET3 | 1.5 | 105 | 99 | 103 | Comp. |

* Requirement A: tabular grains having (111) faces as main planes, the tabular grains: (i) composed of silver iodobromide or silver chloroiodobromide; (ii) having an equivalent circle diameter of 1.0 $\mu$m or more and a thickness of 0.15 $\mu$m or less; and (iii) composed of core portions of 0.1 $\mu$m or less thickness free of growth ring structure and composed of silver iodobromide and shell portions having ten or more dislocation lines.

Example 3

Emulsion of the present invention having the same average equivalent sphere diameter as in the emulsion Em-B was produced. This emulsion satisfied all the requirements for the emulsion of the present invention. The emulsion Em-B of the 5th layer (medium-speed red-sensitive emulsion layer) of the sample 101 was replaced with this emulsion, and compound HET-3 of the present invention was added to the 5th layer (medium-speed red-sensitive emulsion layer) in an amount of 0.156 g/m$^2$. Further, the thickness of the protective layer was changed, thereby obtaining an intended silver halide color photographic lightsensitive material. It was recognized that the thus produced silver halide color photographic lightsensitive material of the present invention as well exerted the same excellent effects as in Example 2.

Example 4

Emulsion of the present invention having the same average equivalent sphere diameter as in the emulsion Em-F was produced. This emulsion satisfied all the requirements for the emulsion of the present invention. The emulsion Em-F of the 11th layer (high-speed green-sensitive emulsion layer) of the sample 101 was replaced with the above emulsion, and compound HET-3 of the present invention was added to the 11th layer (high-speed green-sensitive emulsion layer) in an amount of 0.156 g/m$^2$. Further, the thickness of the protective layer was changed, thereby obtaining an intended silver halide color photographic lightsensitive material. It was recognized that the thus produced silver halide color photographic lightsensitive material of the present invention as well exerted the same excellent effects as in Example 2.

What is claimed is:

1. A silver halide color photographic lightsensitive material comprising a support and, superimposed thereon, at least one blue-sensitive silver halide emulsion layer, green-sensitive silver halide emulsion layer, red-sensitive silver halide emulsion layer and protective layer, which silver halide color photographic lightsensitive material contains at least one compound capable of increasing photographic speed, the compound having at least three heteroatoms in its molecule, and wherein at least one layer of the silver halide emulsion layers comprises an emulsion, the emulsion consisting of a photosensitive silver halide emulsion wherein 50% or more in number of all the silver halide grains are occupied by tabular grains having (111) faces as main planes, the tabular grains: (i) composed of silver iodobromide or silver chloroiodobromide; (ii) having an equivalent circle diameter of 1.0 $\mu$m or more and a thickness of 0.15 $\mu$m or less; and (iii) composed of core portions of 0.1 $\mu$m or less thickness free of growth ring structure and composed of silver iodobromide and shell portions having ten or more dislocation lines.

2. The silver halide color photographic lightsensitive material according to claim 1, wherein the sum of protective layer thicknesses is 3 $\mu$m or less.

3. The silver halide color photographic lightsensitive material according to claim 1, wherein the compound capable of increasing photographic speed, the compound having at least three heteroatoms in its molecule, is a 1,3,4,6-tetraazaindene compound.

4. The silver halide color photographic lightsensitive material according to claim 2, wherein the compound capable of increasing photographic speed, the compound having at least three heteroatoms in its molecule, is a 1,3,4,6-tetraazaindene compound.

5. The silver halide color photographic lightsensitive material according to claim 1, wherein the compound capable of increasing photographic speed, the compound having at least three heteroatoms in its molecule, is represented by the following general formula (A) or general formula (B):

General Formula (A)

(A)

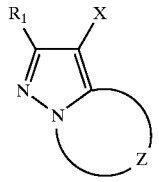

in the general formula (A), $R_1$ represents a hydrogen atom or a substituent, Z represents a nonmetallic atom group required for forming a 5-membered azole ring containing 2 to 4 nitrogen atoms, where the azole ring may have a substituent, including a condensed ring, and X represents a hydrogen atom or a substituent;

General formula (B)

(B)

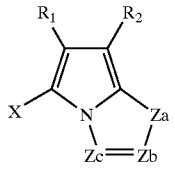

in the general formula (B), Za represents —NH— or —CH($R_3$)—, each of Zb and Zc independently represents —C($R_4$)═ or —N═, each of $R_1$, $R_2$ and $R_3$ independently represents an electron withdrawing group whose Hammett substituent constant σp value is in the range of 0.2 to 1.0, $R_4$ represents a hydrogen atom or a substituent, provided that when there are two $R_4$s in the formula, the two $R_4$s may be identical with or different from each other, and X represents a hydrogen atom or a substituent.

6. The silver halide color photographic lightsensitive material according to claim 2, wherein the compound capable of increasing photographic speed, the compound having at least three heteroatoms in its molecule, is represented by the following general formula (A) or general formula (B):

General Formula (A)

(A)

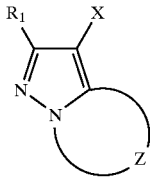

in the general formula (A), $R_1$ represents a hydrogen atom or a substituent, Z represents a nonmetallic atom group required for forming a 5-membered azole ring containing 2 to 4 nitrogen atoms, where the azole ring may have a substituent, including a condensed ring, and X represents a hydrogen atom or a substituent;

General formula (B)

(B)

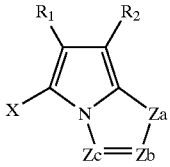

in the general formula (B), Za represents —NH— or —CH($R_3$)—, each of Zb and Zc independently represents —C($R_4$)═ or —N═, each of $R_1$, $R_2$ and $R_3$ independently represents an electron withdrawing group whose Hammett substituent constant σp value is in the range of 0.2 to 1.0, $R_4$ represents a hydrogen atom or a substituent, provided that when there are two $R_4$s in the formula, the two $R_4$s may be identical with or different from each other, and X represents a hydrogen atom or a substituent.

7. The silver halide color photographic lightsensitive material according to claim 3, wherein the compound capable of increasing photographic speed, the compound having at least three heteroatoms in its molecule, is represented by the following general formula (A) or general formula (B):

General Formula (A)

(A)

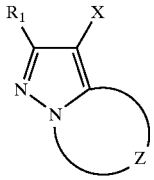

in the general formula (A), $R_1$ represents a hydrogen atom or a substituent, Z represents a nonmetallic atom group required for forming a 5-membered azole ring containing 2 to 4 nitrogen atoms, where the azole ring may have a substituent, including a condensed ring, and X represents a hydrogen atom or a substituent;

General formula (B)

(B)

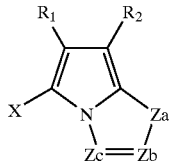

in the general formula (B), Za represents —NH— or —CH($R_3$)—, each of Zb and Zc independently represents —C($R_4$)= or —N=, each of $R_1$, $R_2$ and $R_3$ independently represents an electron withdrawing group whose Hammett substituent constant σp value is in the range of 0.2 to 1.0, $R_4$ represents a hydrogen atom or a substituent, provided that when there are two $R_4$s in the formula, the two $R_4$s may be identical with or different from each other, and X represents a hydrogen atom or a substituent.

8. The silver halide color photographic lightsensitive material according to claim 4, wherein the compound capable of increasing photographic speed, the compound having at least three heteroatoms in its molecule, is represented by the following general formula (A) or general formula (B):

General Formula (A)

(A)

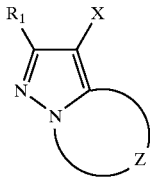

in the general formula (A), $R_1$ represents a hydrogen atom or a substituent, Z represents a nonmetallic atom group required for forming a 5-membered azole ring containing 2 to 4 nitrogen atoms, where the azole ring may have a substituent, including a condensed ring, and X represents a hydrogen atom or a substituent;

General formula (B)

(B)

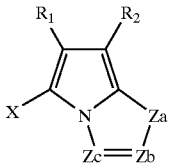

in the general formula (B), Za represents —NH— or —CH($R_3$)—, each of Zb and Zc independently represents —C($R_4$)= or —N=, each of $R_1$, $R_2$ and $R_3$ independently represents an electron withdrawing group whose Hammett substituent constant σp value is in the range of 0.2 to 1.0, $R_4$ represents a hydrogen atom or a substituent, provided that when there are two $R_4$s in the formula, the two $R_4$s may be identical with or different from each other, and X represents a hydrogen atom or a substituent.

* * * * *